US007814851B2

(12) United States Patent
Tashiro

(10) Patent No.: US 7,814,851 B2
(45) Date of Patent: Oct. 19, 2010

(54) SEWING DATA CREATION APPARATUS AND COMPUTER-READABLE RECORDING MEDIUM STORING A SEWING DATA CREATION PROGRAM

(75) Inventor: Noriharu Tashiro, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 431 days.

(21) Appl. No.: 11/987,366

(22) Filed: Nov. 29, 2007

(65) Prior Publication Data

US 2008/0127871 A1 Jun. 5, 2008

(30) Foreign Application Priority Data

Nov. 30, 2006 (JP) ..... 2006-324785

(51) Int. Cl.
*D05B 21/00* (2006.01)
*D05B 19/08* (2006.01)
*D05C 9/06* (2006.01)

(52) U.S. Cl. ..... 112/470.01; 112/102.5; 700/137

(58) Field of Classification Search ..... 112/102, 112/102.5, 117, 118, 470.01, 470.04, 470.18, 112/475.01, 475.05, 475.08, 475.19; 700/130–138
See application file for complete search history.

(56) References Cited

U.S. PATENT DOCUMENTS 4,388,883 A * 6/1983 Hirota et al. ..... 112/102.5
4,413,574 A * 11/1983 Hirota et al. ..... 112/470.04
4,499,838 A * 2/1985 Voza ..... 112/475.19
5,189,623 A * 2/1993 Komuro et al. ..... 700/138
5,261,341 A 11/1993 Asano
5,283,748 A 2/1994 Muramatsu
5,839,380 A 11/1998 Muto
5,867,391 A 2/1999 Muto
5,957,068 A 9/1999 Mizuno
5,960,726 A * 10/1999 Yamada ..... 112/102.5
6,098,559 A 8/2000 Hirose
6,161,491 A 12/2000 Takenoya et al.
6,430,460 B1 8/2002 Taguchi
6,629,015 B2 * 9/2003 Yamada ..... 700/138
6,968,255 B1 11/2005 Dimaridis et al.
7,680,558 B2 3/2010 Yamada

FOREIGN PATENT DOCUMENTS

JP A 4-240474 8/1992

(Continued)

OTHER PUBLICATIONS

Jun. 3, 2010 Notice of Allowance issued in U.S. Appl. No. 11/987,363.

*Primary Examiner*—Ismael Izaguirre
(74) *Attorney, Agent, or Firm*—Oliff & Berridge, PLC

(57) ABSTRACT

A sewing data creation apparatus for creating sewing data required for sewing by a sewing machine may include a unit pattern storage device to store pattern data of a unit pattern of a predetermined design. The apparatus may further include a pattern disposition device that determines a position of the unit pattern stored in the unit pattern storage device on a stitch path, the stitch path including a curve-like portion. Also, the apparatus may include a sewing data creation device that creates the sewing data for forming stitches on the stitch path and stitches of the unit pattern at the position determined by the pattern disposition device.

18 Claims, 61 Drawing Sheets

FOREIGN PATENT DOCUMENTS

| | | |
|---|---|---|
| JP | A 7-289760 | 11/1995 |
| JP | A 8-84876 | 4/1996 |
| JP | A 9-137357 | 5/1997 |
| JP | B2 2867713 | 12/1998 |
| JP | A 2002-95881 | 4/2002 |
| JP | B2 3499607 | 12/2003 |

* cited by examiner

FIG. 29

800

| | | | | | | |
|---|---|---|---|---|---|---|
| SCHEMATIC DIAGRAM | P802, seg802, P801, seg801 | | | | | |
| COORDINATE | x | y | x | y | x | y |
| INITIAL STITCH PATH | LARGE | SMALL | = | LARGE | SMALL | SMALL |
| SELECTED SIDE LINE SEGMENT | = | SMALL | LARGE | LARGE | SMALL | LARGE |
| SCHEMATIC DIAGRAM | | | | | | |
| COORDINATE | x | y | x | y | x | y |
| INITIAL STITCH PATH | LARGE | LARGE | = | SMALL | SMALL | LARGE |
| SELECTED SIDE LINE SEGMENT | LARGE | SMALL | SMALL | SMALL | = | LARGE |
| SCHEMATIC DIAGRAM | | | | | | |
| COORDINATE | x | y | x | y | x | y |
| INITIAL STITCH PATH | LARGE | LARGE | LARGE | SMALL | SMALL | = |
| SELECTED SIDE LINE SEGMENT | LARGE | = | SMALL | SMALL | SMALL | LARGE |
| SCHEMATIC DIAGRAM | | | | | | |
| COORDINATE | x | y | x | y | x | y |
| INITIAL STITCH PATH | LARGE | = | SMALL | LARGE | SMALL | SMALL |
| SELECTED SIDE LINE SEGMENT | LARGE | SMALL | LARGE | LARGE | SMALL | = |

x
y

RELATED ART

RELATED ART

SEWING DATA CREATION APPARATUS AND COMPUTER-READABLE RECORDING MEDIUM STORING A SEWING DATA CREATION PROGRAM

CROSS-REFERENCE TO RELATED APPLICATION

This application claims priority from Japanese Patent Application No. 2006-324785, filed Nov. 30, 2006, the disclosure of which is hereby incorporated by reference in its entirety.

BACKGROUND

The present disclosure generally relates to technical fields including a sewing data creation apparatus and a sewing data creation program recorded on a computer-readable recording medium. More specifically, the disclosure relates to a sewing data creation apparatus and a sewing data creation program recorded on a computer-readable recording medium, both of which may create sewing data used to form stippling stitches.

In the related art, a stippling stitch has been known as one type of stitch for quilting. In a quilting process, an inner cotton is placed between a main fabric and a lining and they are sewn together with a stitch pattern such as a line or a curve. For example, a stitch 902 shown in FIG. 60 is a stippling stitch, which is sewn onto a sewing area 901 to form a design. The stippling stitch is formed in a complicated curve that does not intersect itself. Conventionally, most decorative patterns such as the stippling stitch have been sewn by hand, whereas recently, more and more people desire to easily sew the stippling stitch by a sewing machine.

However, a problem occurs with a stippling stitch when the stitch line intersects itself, a part of the stitch line is too close to other parts of the stitch, the stitch line creates a high density portion and a low density portion in a sewing area, the stitch line has stitches with uneven stitch lengths, or the stitch line forms a curve with a pointed portion. In other words, a stippling stitch may be considered to be beautiful if the stitch line creates a smooth curve that is well balanced and evenly arranged in a sewing area, does not intersect itself, has no part of the stitch too close to other parts of the stitch, and has uniform stitch lengths.

Moreover, a stippling stitch may be decorated with a plurality of small decorative patterns. For example, as shown in FIG. 61, small plant leaf-like decorative patterns 913 are attached on either side of a stippling stitch 912 in a sewing area 911. Although it is assumed that such exquisite decorative patterns may be sewn by hand, they may preferably be sewn, like a stippling stitch, by a sewing machine. These decorative patterns may be considered to be beautiful and high quality when they have even sizes and are disposed on the stippling stitch at predetermined intervals in a balanced manner.

Further, an embroidery data creation apparatus may transform a part of a profile line of an embroidery pattern to be sewn into a Bezier curve (see, for example, Japanese Patent Application Laid Open Publication No. Hei 9-137357).

SUMMARY

However, there is a problem in that a sewing operator must be highly skilled to sew a stitch line by a sewing machine while moving a cloth by hand in such a manner that the stitch line makes a curve. The curve is smooth, well-balanced, and evenly arranged in the sewing area, does not intersect itself, has no part of the stitch too close to other parts of the stitch, and has uniform stitch lengths. Further, a conventional embroidery data creation apparatus only changes a profile line of an embroidery design into curves and cannot arrange stitches evenly in the embroidery design in a balanced manner. Also, in order to dispose a plurality of small decorative patterns on a stippling stitch at predetermined intervals in a balanced manner, or sew the patterns with equal sizes onto a cloth with a sewing machine while moving the cloth by hand, the operator must be even more skilled. Therefore, general operators and beginners may hardly sew such exquisite decorative patterns with a sewing machine.

Exemplary embodiments provide a sewing data creation apparatus and a sewing data creation program recorded on a computer-readable recording medium that may create sewing data used to easily sew a stippling stitch having decorative patterns thereon with a sewing machine.

Exemplary embodiments provide a sewing data creation apparatus for creating sewing data used for sewing by a sewing machine including a unit pattern storage device that stores pattern data of a unit pattern of a predetermined design, a pattern disposition device that determines a position of the unit pattern stored in the unit pattern storage device on a stitch path, the stitch path including at least a curve-like portion, and a sewing data creation device that creates the sewing data for forming stitches on the stitch path and stitches of the unit pattern at the position determined by the pattern disposition device.

Exemplary embodiments provide a computer-readable recording medium storing a computer sewing data creation program for creating sewing data used for sewing by a sewing machine, the program including unit pattern instructions for acquiring pattern data of a unit pattern of a predetermined design, pattern disposition instructions for determining a position of the unit pattern acquired in the unit pattern acquisition instructions on a stitch path, the stitch path including at least a curve-like portion, and sewing data creation instructions for creating the sewing data used to form stitches on the stitch path and stitches of the unit pattern at the position determined in the pattern disposition instructions.

BRIEF DESCRIPTION OF THE DRAWINGS

Exemplary embodiments will be described below in detail with reference to the accompanying drawings in which:

FIG. 29 is a schematic diagram showing various cases of selecting a first candidate for the next branch point;

DETAILED DESCRIPTION OF EMBODIMENTS

Figure 61:
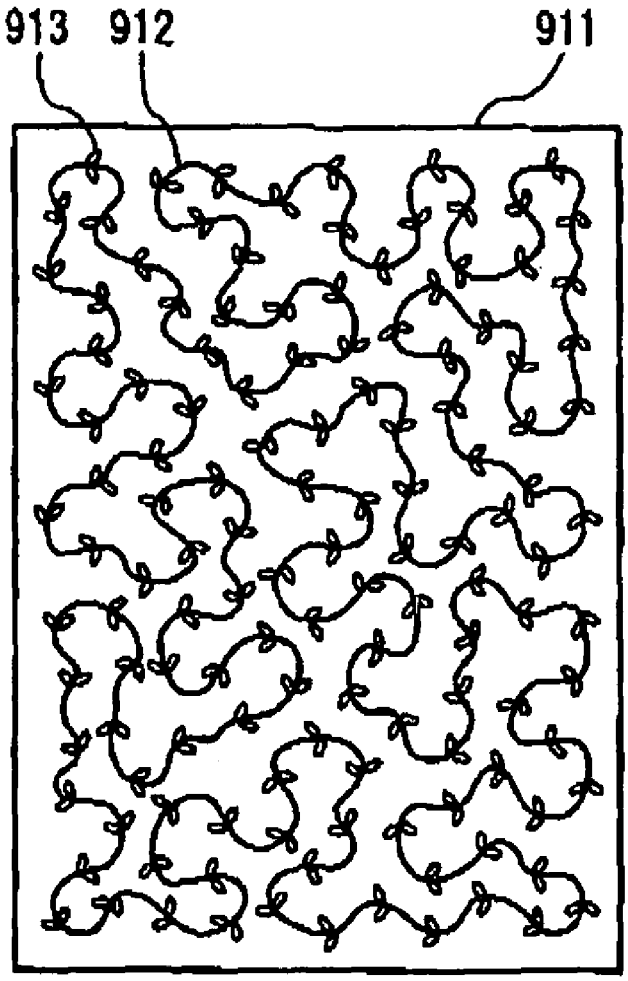
FIG. 61 is a schematic diagram showing a state where a stippling stitch with decorative patterns thereon has been sewn.

Hereinafter, sewing data creation apparatus 1 according to exemplary embodiments will be described with reference to drawings. The sewing data creation apparatus 1 may create sewing data used to form a stippling stitch by an embroidery sewing machine 3 in an area specified as a sewing area. To the stippling stitch, decorative patterns 913 such as shown in FIG. 61 may be added.

Figure 1:
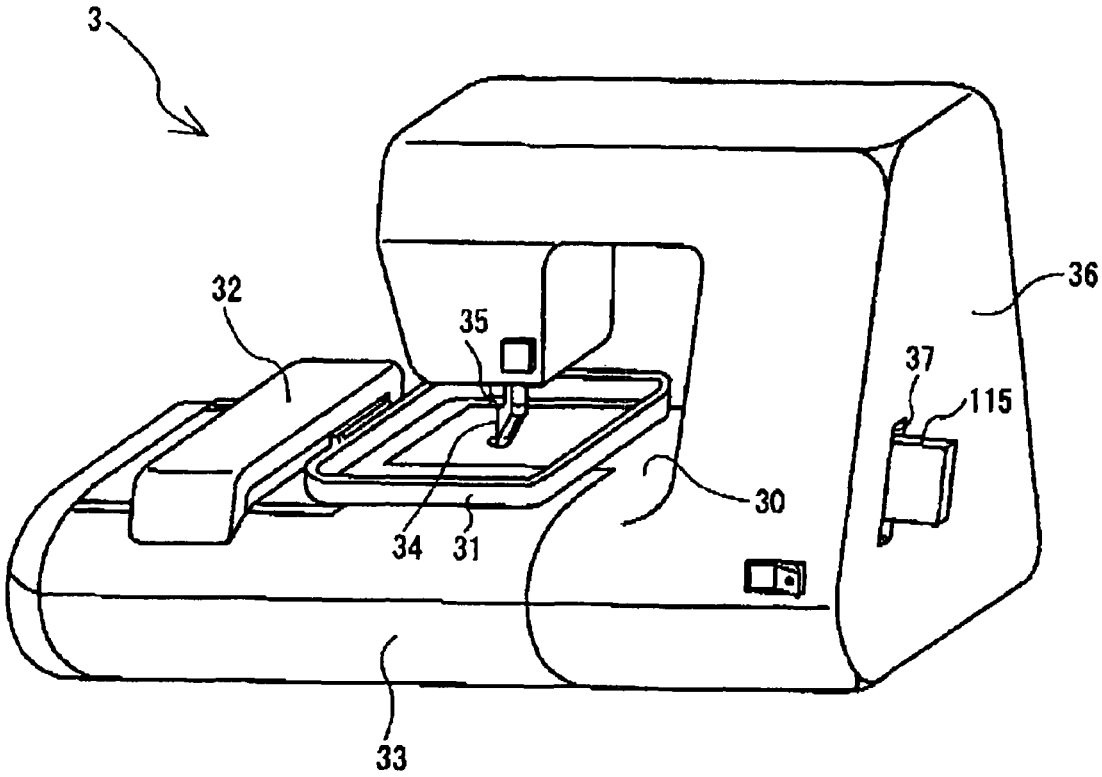
FIG. 1 is an external view of an embroidery sewing machine.

First, the embroidery sewing machine 3 is described below. The embroidery sewing machine 3 shown in FIG. 1 may include a needle bar mechanism (not shown) that may vertically drive a needle bar 35 to which a sewing needle 34 may be attached, a thread take-up mechanism (not shown), and a shuttle mechanism (not shown). The embroidery sewing machine 3 may further include a Y-directional drive mechanism (not shown) and an X-directional drive mechanism (not shown). The Y-directional drive mechanism may shift an embroidery frame 31 placed on a sewing machine bed 30 that holds a work cloth (not shown) for sewing in a cross direction of the embroidery sewing machine 3 (cross direction of the paper). The X-directional drive mechanism may shift the Y-directional drive mechanism in a right-and-left direction of the embroidery sewing machine 3 (right-and-left direction of the paper). The Y-directional drive mechanism may be housed in a carriage cover 32 and the X-directional drive mechanism may be housed in a body case 33. The embroidery sewing machine 3 may perform sewing by cooperating with the needle bar mechanism, the thread take-up mechanism and the shuttle mechanism, while moving the embroidery frame 31 by the Y-directional and X-directional drive mechanisms, thereby forming stitches of a predetermined design on the work cloth. A sewing machine motor (not shown), which drives the needle bar mechanism, the thread take-up mechanism, and the shuttle mechanism and the motors (not shown), which respectively drive the Y-directional and X-directional drive mechanisms, may be controlled by a control device, for example, a microcomputer built in the embroidery sewing machine 3. Further, the embroidery sewing machine 3 may have a memory card slot 37 formed on a side surface of its pillar 36. By inserting a memory card 115 storing an embroidery data into the memory card slot 37, the embroidery data, which may be created in the embroidery data creation apparatus 1 may be supplied to the embroidery sewing machine 3. The embroidery sewing machine 3 and the embroidery data creation apparatus 1 may also be connected to each other with a cable, thereby directly supplying the embroidery data without a recording medium, such as a memory card.

Figure 2:
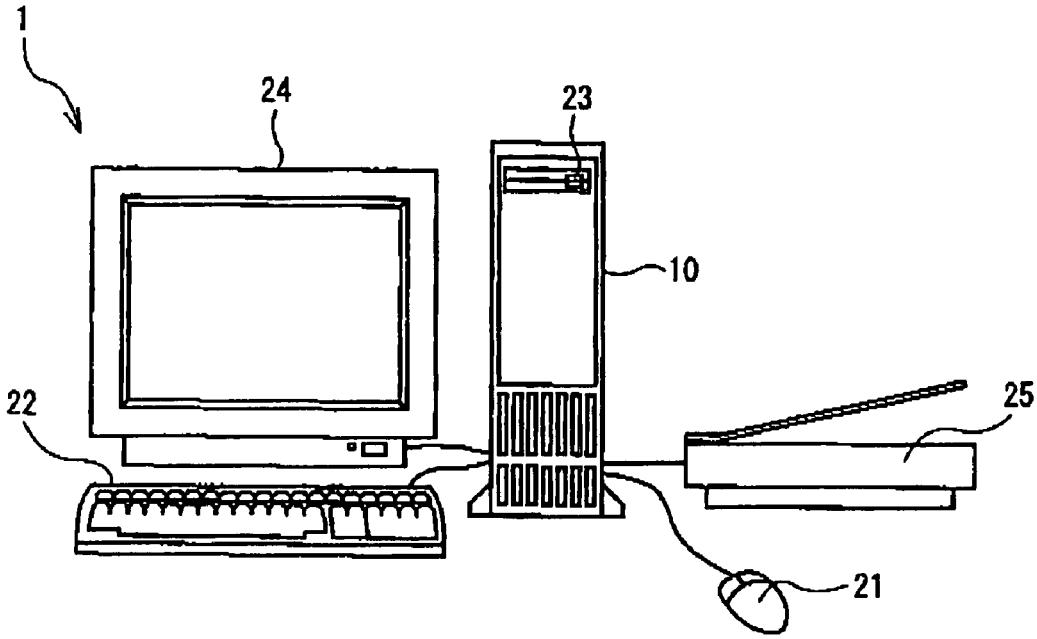
FIG. 2 is an overall configuration diagram of a physical configuration of a sewing data creation apparatus.
Figure 3:
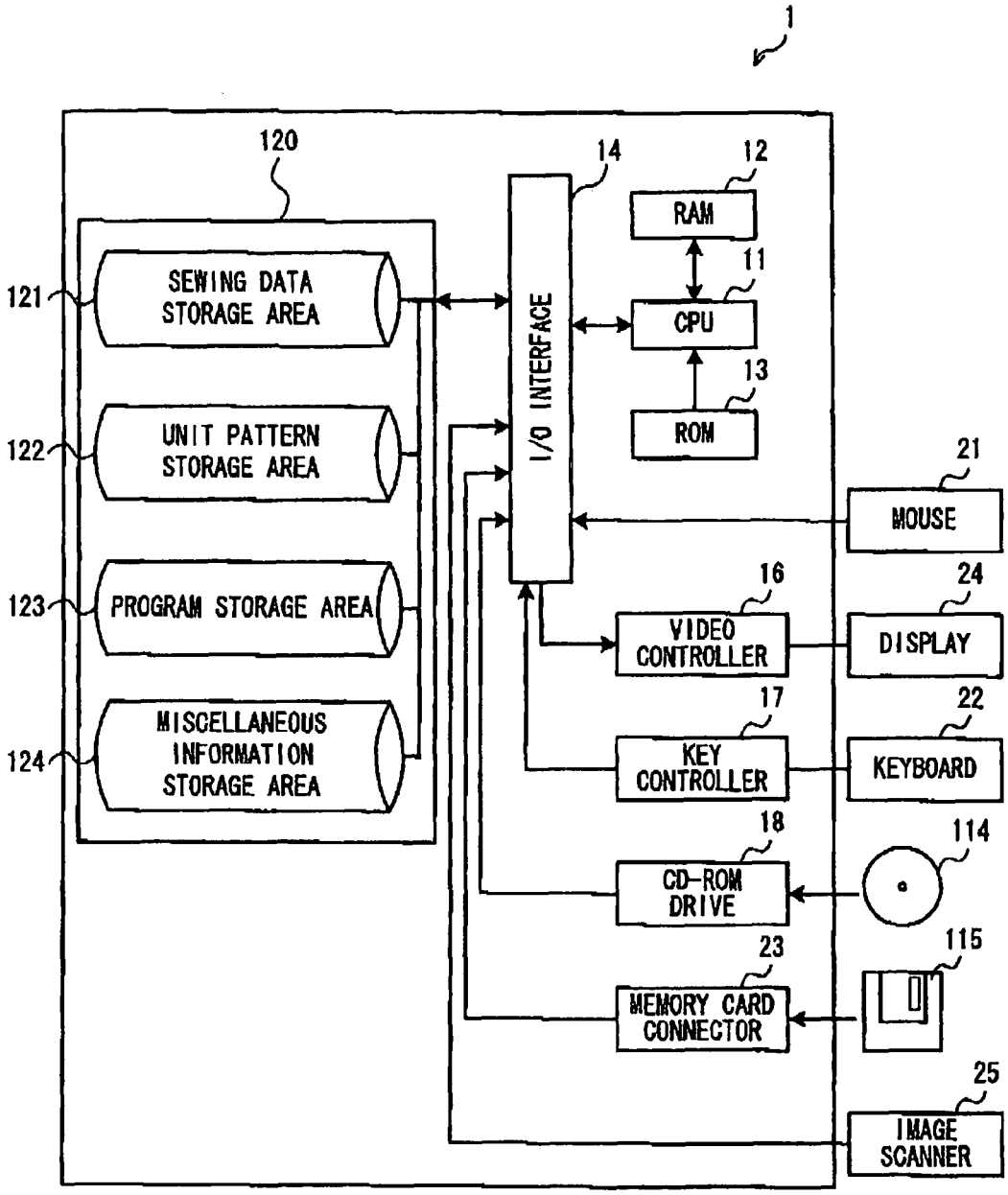
FIG. 3 is a block diagram of an electrical configuration of the sewing data creation apparatus.
Figure 4:
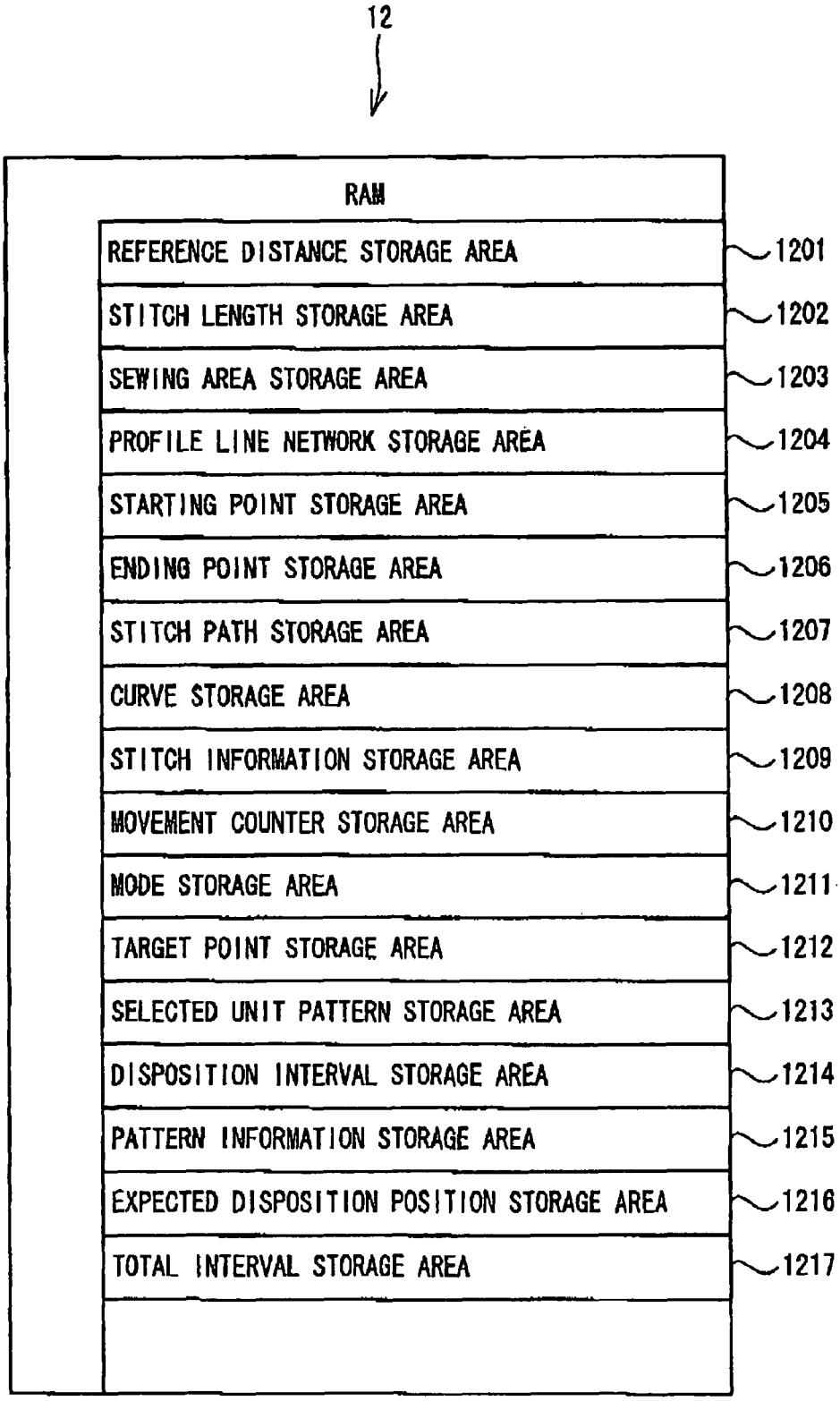
FIG. 4 is a schematic diagram of a configuration of a RAM.

Next, an exemplary embodiment of the embroidery data creation apparatus 1 will be described below with reference to FIGS. 2-4. As shown in FIG. 2, the embroidery data creation apparatus 1 may include an apparatus body 10 which may be a so-called personal computer, a mouse 21, a keyboard 22, a memory card connector 23, a display 24, and an image scanner 25, each of which may be connected to the apparatus body 10. The shapes of the apparatus body 10, the mouse 21, the keyboard 22, the memory card connector 23, the display 24, and the image scanner 25 are not limited to those shown in FIG. 2. For example, the apparatus body 10 may be a tower type, and a transverse-mounted type or a notebook type in which the display 24 and the keyboard 22 are integrated. Further, rather than being a so-called personal computer, the apparatus body 10 may also be a dedicated one. Also, the image scanner 25, if not used, need not be connected to the embroidery data creation apparatus 1.

Next, an exemplary embodiment of the electrical constitution of the embroidery data creation apparatus 1 will be described below with reference to the block diagram in FIG. 3. As shown in FIG. 3, the embroidery data creation apparatus 1 may also be equipped with a CPU 11 serving as a controller, which may control the embroidery data creation apparatus 1. A RAM 12 that may temporarily store a variety of kinds of data, a ROM 13 that may store BIOS, and an I/O interface 14 that may mediate outgoing and incoming data that may be connected to the CPU 11. To the I/O interface 14, a hard disk drive 120 having at least a sewing data storage area 121, a unit pattern storage area 122, a program storage area 123, and a miscellaneous information storage area 124 may be connected.

The sewing data storage area 121 may store sewing data created by the sewing data creation program and to be read into the embroidery sewing machine 3. The unit pattern storage area 122 may store the shape of a pattern (unit pattern) to be attached as a decorative pattern to a stippling stitch. The program storage area 123 may store the sewing data creation program to be executed by the CPU 11. The miscellaneous information storage area 124 may store other information to be used in the sewing data creation apparatus 1. The program may be stored in the ROM 13 if the sewing data creation apparatus 1 is a dedicated apparatus not equipped with the hard disk drive 120.

The mouse 21, a video controller 16, a key controller 17, a CD-ROM drive 18, the memory card connector 23, and the image scanner 25 may be connected to the I/O interface 14. The display 24 may be connected to the video controller 16, and the keyboard 22 may be connected to the key controller 17. The CD-ROM 114 to be inserted into the CD-ROM drive 18 may store the sewing data creation program, which may be a control program for the sewing data creation apparatus 1. At the time of introduction, the control program may be set up from the CD-ROM 114 to the hard disk drive 120 and stored in the program storage area 123. Further, through the memory card connector 23, information may be read from and written into the memory card 115.

Next, an exemplary embodiment of the storage areas provided in the RAM 12 will be described below with reference to FIG. 4. As shown in FIG. 4, the RAM 12 may have a reference distance storage area 1201, a stitch length storage area 1202, a sewing area storage area 1203, a profile line network storage area 1204, a starting point storage area 1205, an ending point storage area 1206, a stitch path storage area 1207, a curve storage area 1208, a stitch information storage area 1209, a movement counter storage area 1210, a mode storage area 1211, a target point storage area 1212, a selected unit pattern storage area 1213, a disposition interval storage area 1214, a pattern information storage area, 1215, an expected disposition position storage area 1216, and a total interval storage area 1217. The RAM 12 may further be provided with other various storage areas.

Figure 12:
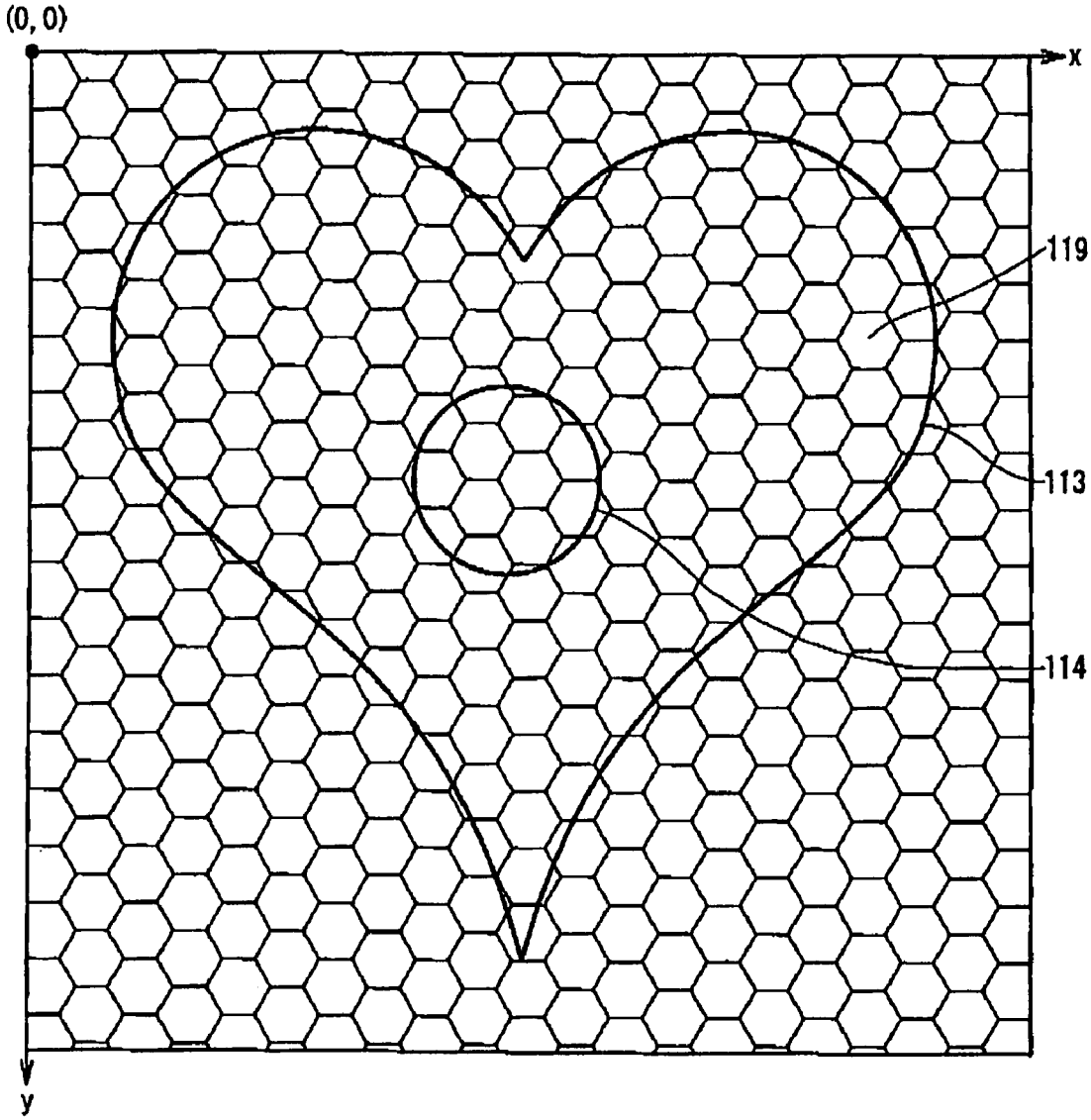
FIG. 12 is a schematic diagram of a process for disposing a profile line network in the sewing area.

The reference distance storage area 1201 may store a reference distance that may be used as a reference when determining the size of a unit area (see FIG. 12). The stitch length storage area 1202 may store a stitch length for the stitches to be sewn. The sewing area storage area 1203 may store a sewing area, that is, an area where sewing is to be performed. The profile line network storage area 1204 may store coordinate information of points and connection information between the points, which indicate a profile line network (see FIG. 12) that may be formed by arranging unit areas with a predetermined shape in a sewing area and connecting the profile lines of the unit areas. The starting point storage area 1205 and the ending point storage area 1206 may respectively store coordinates of a starting point and an ending point, which may be specified by a user in the sewing area. The stitch path storage area 1207 may store information indicating a stitch path (path for sewing) set on the profile line network, such as coordinates of branch points on the stitch path in order from the starting point to the ending point. The curve storage area 1208 may store information indicating a curve path obtained by transforming the stitch path, such as coordinates of a plurality of points that form the curve path. The stitch information storage area 1209 may store information indicating stitches to be disposed on the curve path, such as coordinates of needle drop points for the stitches. The movement counter storage area 1210 may store a value of a movement counter that may be used when creating the stitch path. The mode storage area 1211 may store a value that indicates a mode, which may be employed when creating the stitch path. The target point storage area 1212 may store a value that indicates a branch point, which may be focused on as a target point when moving a stitch path.

The selected unit pattern storage area 1213 may store information that indicates a unit pattern selected by a user as a decorative pattern (see FIG. 61) to be attached to a stippling stitch. The disposition interval storage area 1214 may store an interval at which unit patterns may be placed. The pattern information storage area 1215 may store information that indicates a position to which a unit pattern may be disposed. The expected disposition position storage area 1216 may store information that indicates a position to which a unit pattern may be disposed. The total interval storage area 1217 may store a distance between a current expected disposition position and a previous disposition position of the unit pattern.

Next, exemplary embodiments of operations of the sewing data creation apparatus 1 will be described below with reference to FIGS. 5-22. For example, the operations will be described here from a process of disposing a stitch path 410 in a sewing area to a process of creating a curve path 610 on which stitches are disposed based on the stitch path. In the following description, an overall sewing area 110 with the shape of a heart from which a circular hole may be cut out as shown in FIG. 9 is employed as an example. The outer peripheral profile line of the heart shape of the overall sewing area 110 is hereinafter referred to as an outer profile line 111, and the profile line of the circular hole is hereinafter referred to as an inner profile line 112. Processing described below may be performed by the CPU 11 in accordance with the sewing data creation program stored in the program storage area 123.

Figure 5:
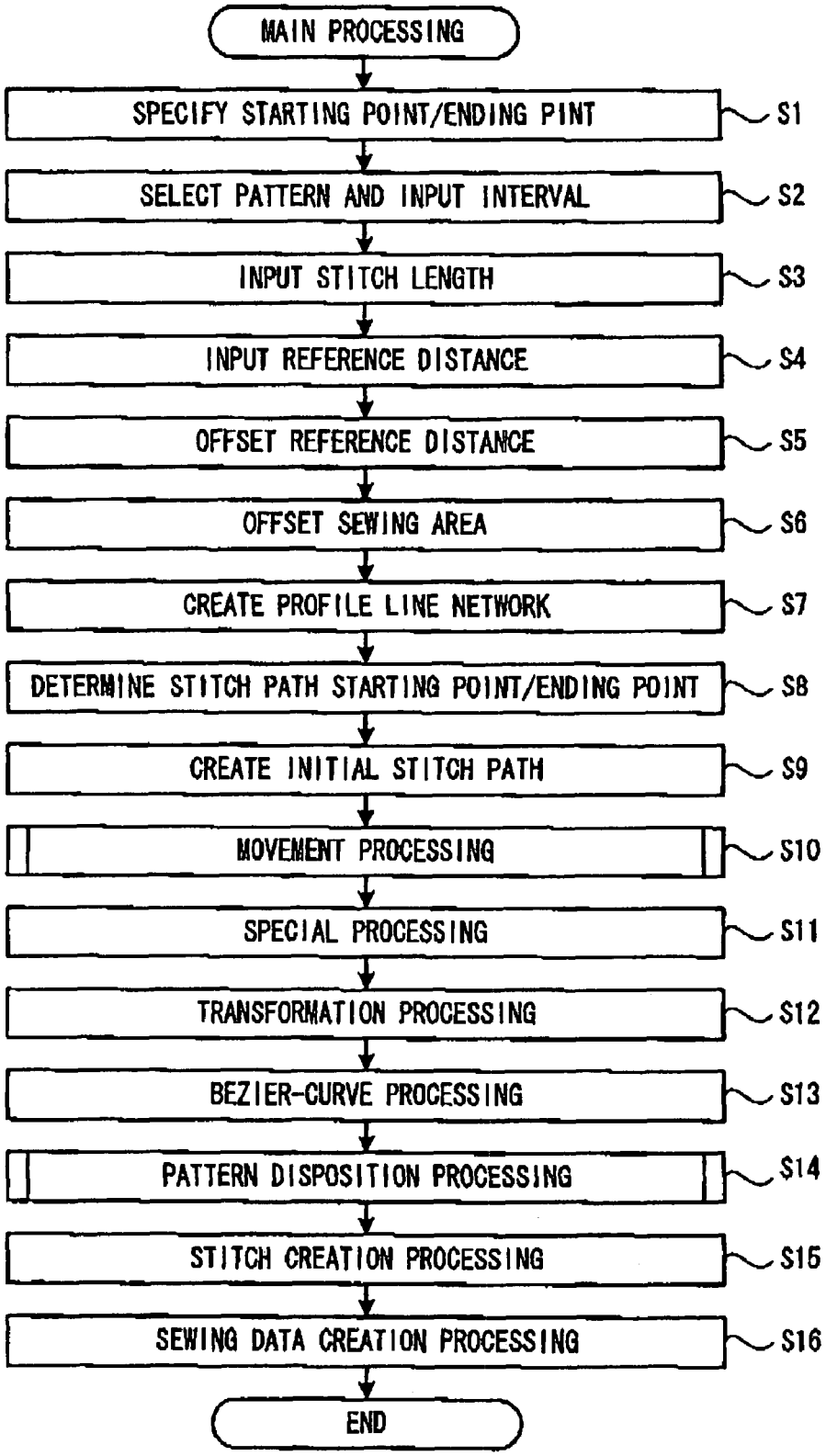
FIG. 5 is a flowchart of main processing by the sewing data creation apparatus.

As shown in FIG. 5, first a starting point and an ending point may be specified (S1). More specifically, for example, a screen showing the sewing area may be displayed on the display 24, with a message to prompt a user to enter the starting point. The starting point may be specified by clicking the mouse at an arbitrary point on the profile line of the sewing area in accordance with the message, and the information of coordinates indicating the position where the mouse was clicked may be stored in the starting point storage area 1205. The ending point may be specified by clicking the mouse at an arbitrary point on the profile line of the sewing area in accordance with the message which prompts the entry of the ending point. Then, the coordinate information indicating the position where the mouse was clicked may be stored in the ending point storage area 1206. Here, positions indicated in FIG. 10 may have been specified as a starting point SP and an ending point EP. In the drawings showing the sewing area, the horizontal direction and the vertical direction may be set as an X-axis and Y-axis, respectively, and a coordinate system may be given where the x-axis value increases rightward and the y-axis value increases downward.

Next, a unit pattern to be attached as a decorative pattern may be selected and its disposition interval may be inputted (S2). At this time, on the display 24, a screen may show a list of the unit patterns stored in the unit pattern storage area 122. If the user enters a unit pattern to be attached as a decorative pattern by manipulating the mouse 21 or the keyboard 22, the entry may be accepted and information of the selected unit pattern may be stored in the selected unit pattern storage area 1213 in the RAM 12. Subsequently, a screen for an entry of a disposition interval of the unit pattern may appear on the display 24. If the user enters the disposition interval, the entry may be accepted and the disposition interval may be stored in the disposition interval storage area 1214.

Subsequently, entry of a stitch length may be accepted (S3). For example, an entry screen of the stitch length may be displayed, a value entered into an input field by the user may be accepted, and the value may be stored in the stitch length storage area 1202 as the stitch length. Subsequently, the entry of a reference distance may be accepted (S4). For example, an entry screen of the reference distance may be displayed, a value input entered into an input field by the user may be accepted, and the value may be stored in the reference distance storage area 1201 as the reference distance. The reference distance may be used to determine the length of a size of a regular hexagon, which provides a unit area.

Then, offset processing on the reference distance may be performed (S5). In the present embodiment, when attaching decorative patterns (unit patterns) to the stippling stitch, the reference distance may be increased by the size of the unit pattern so that the decorative patterns do not overlap with each other. The unit pattern storage area 122 may store the shapes of the unit patterns, reference points (disposition reference points), which may be used when disposing unit patterns with the specific shape, and values (heights) by which these unit patterns may protrude from a curve path when they are disposed on it. Accordingly, the height of the unit pattern, which may be stored in the selected unit pattern storage area 1213, may be added to a value which inputted in S4 and stored in the reference distance storage area 1201.

Figure 19:
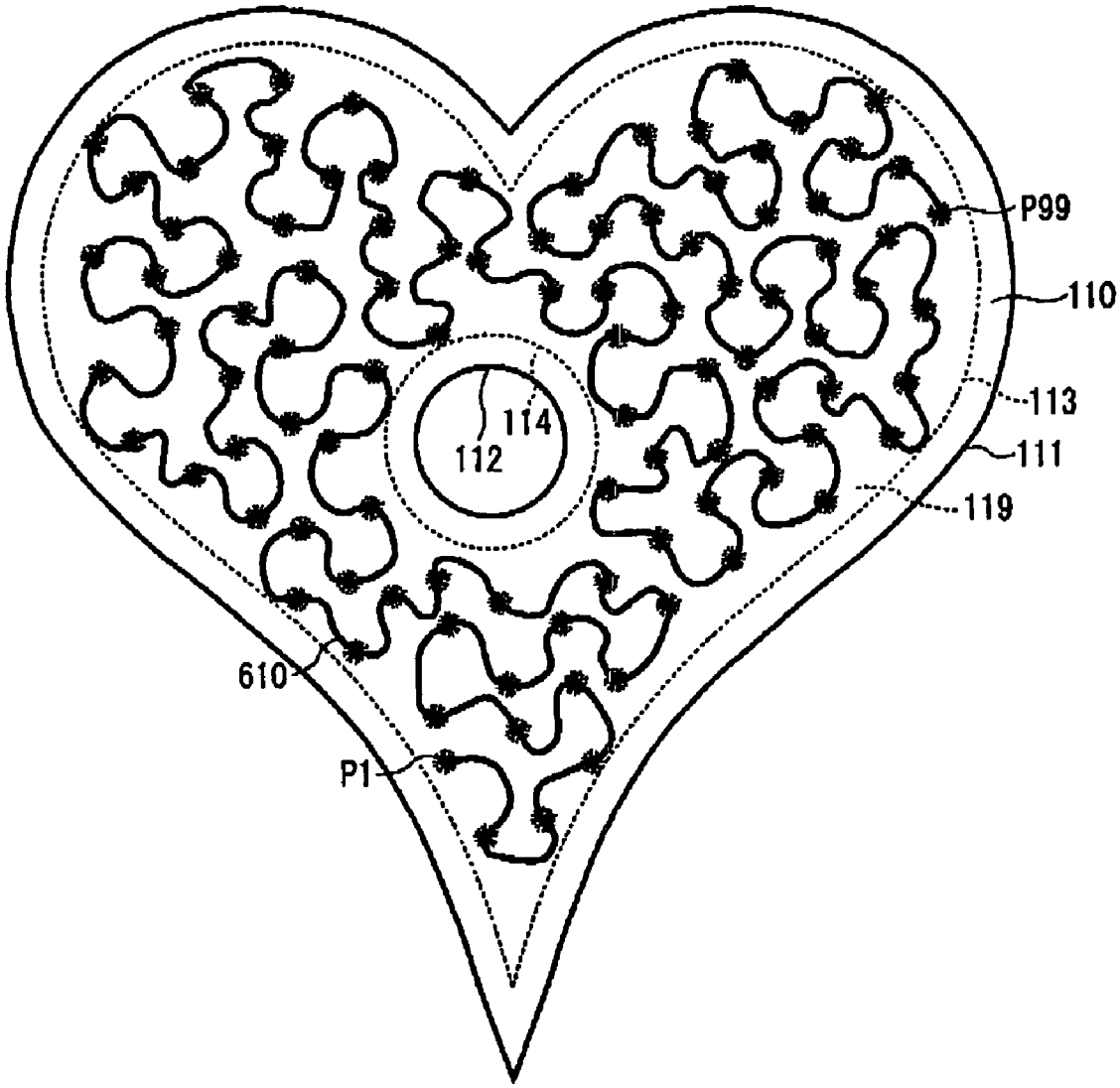
FIG. 19 is a schematic diagram of a state where the unit patterns are disposed on the curve path.
Figure 20:
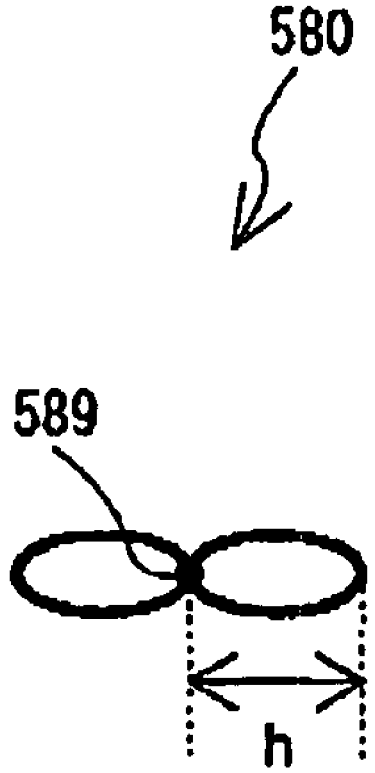
FIG. 20 is a schematic diagram of the unit pattern.
Figure 21:
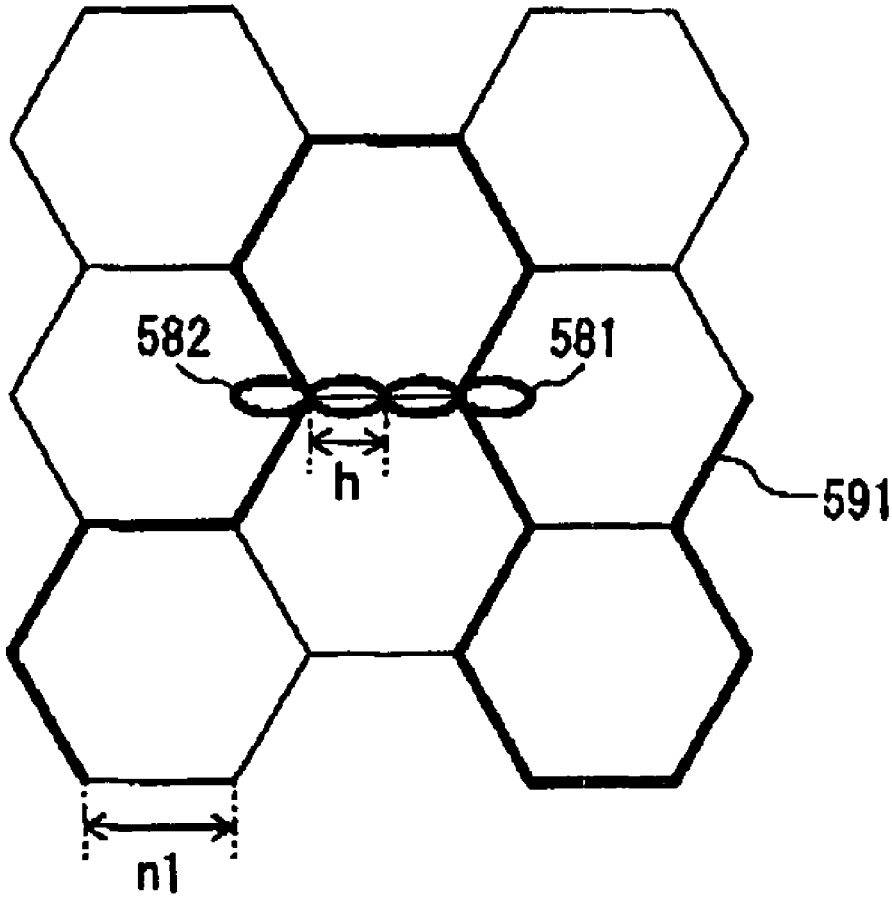
FIG. 21 is a schematic diagram of a state where the unit pattern is disposed on a stitch path which is generated without giving an offset to a reference distance.
Figure 22:
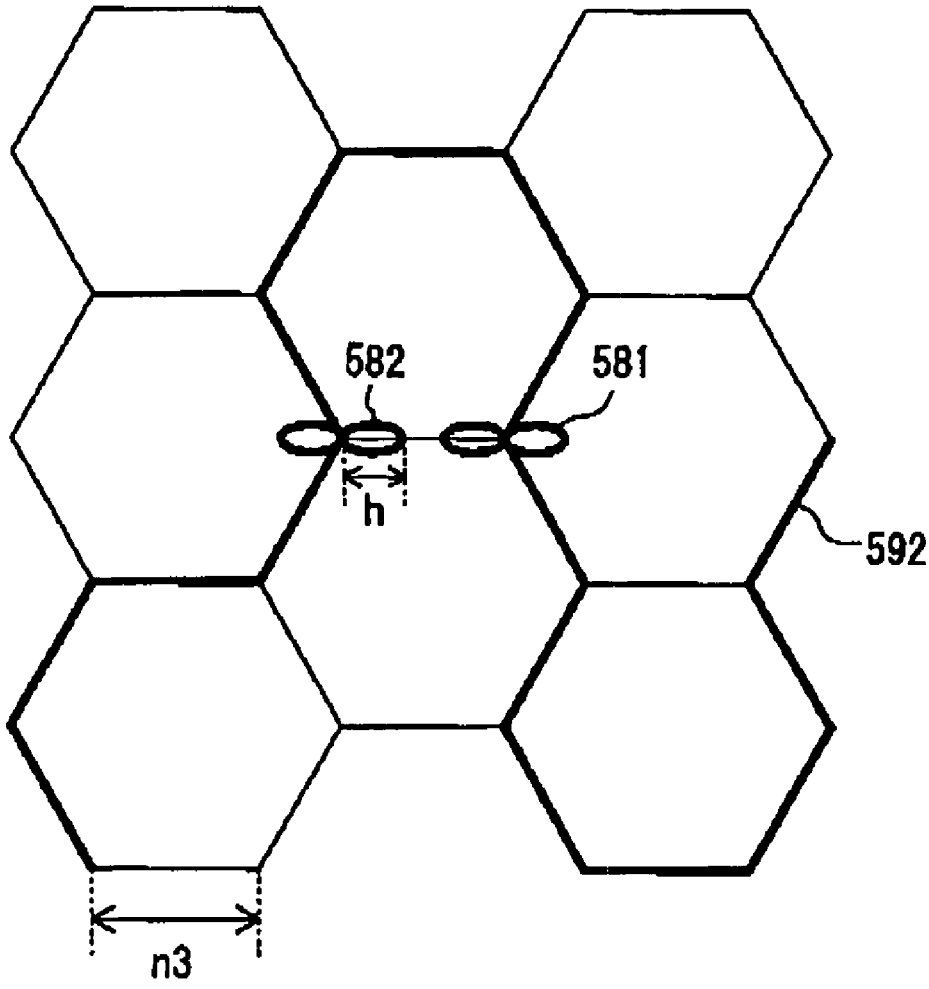
FIG. 22 is a schematic diagram of a state where the unit pattern is disposed on the stitch path generated with an offset to the reference distance.

The following will describe a reason why an offset is given, with reference to FIGS. 20-22. In the present embodiment, a stitch path (see FIG. 15) may be created on the profile lines of regular hexagons arranged in the sewing area, the stitch path may be transformed to obtain a transformed stitch path (see FIG. 16), and a curve path (see FIG. 17) may be created by changing a transformed stitch path into a Bezier curve. Then, unit patterns may be disposed on the curve path (see FIG. 19). In sum, the curve path, on which unit patterns are disposed, may originate from the profile lines of the regular hexagons.

In order to clarify the relationship between a reference distance and a size of the regular hexagon, a description will be given to an example where a unit pattern is disposed on the stitch path, not on the curve path. A unit pattern 580 shown in FIG. 20 is an example. As shown in FIG. 20, the unit pattern 580 may be a pattern having two ellipsoids arranged side by side symmetrically. The point of contact between the ellipsoids may be referred to as a disposition reference point 589. The disposition reference point 589 may be disposed to the position where a unit pattern 580 is disposed. The unit pattern 580 may be arranged in such an orientation that the two ellipsoids may be placed perpendicular to the tangent line of the stitch path to be disposed. If the unit pattern is arranged in such an orientation, a height of the unit pattern may be represented by h in FIG. 20.

An example of a unit pattern includes a height of $h=n1\times\frac{1}{2}$ on a stitch path 591, which may be created based on regular hexagons with a side length of n1 as shown in FIG. 21. The length of each side of a regular hexagon may be given as $n1=\text{reference distance}\times\frac{2}{3}$. In this example, if the two unit patterns 581 and 582 are respectively placed at two points on the stitch path 591 between which the distance is the smallest, the unit patterns 581 and 582 may contact with each other as shown in FIG. 21. Actually, the stitch path 591 may be transformed into a curve, so that the distance between the two points on the path may possibly be smaller. If the distance becomes smaller, the unit patterns 581 and 582 may not only contact with each other but also overlap with each other. To avoid this situation, the sides of the regular hexagon may be lengthened as shown in FIG. 22. For example, the height h of the unit pattern may be added to the reference distance. Accordingly, the length of each of the sides of the regular hexagon may be calculated by $n3=(\text{reference distance specified by the user}+h)\times\frac{2}{3}$, that is, (reference distance specified by the user)×8%. The side length of the regular hexagon may thus be increased to prevent the unit patterns from overlapping with each other even if they are disposed at two points on the stitch path 591 between which the distance is the smallest.

Figure 11:
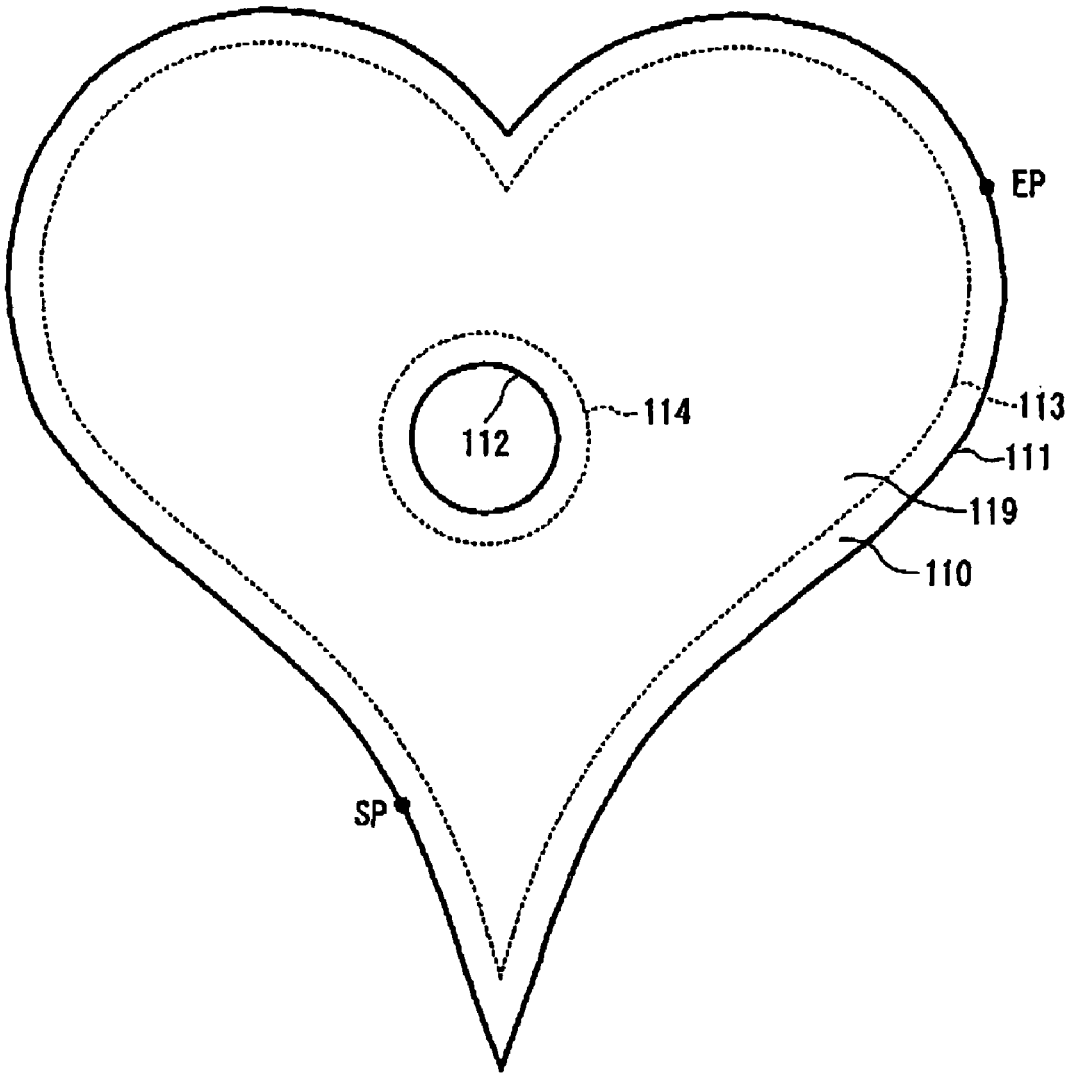
FIG. 11 is a schematic diagram showing an actual sewing area obtained after offset of a unit pattern from an overall sewing area.

As shown in FIG. 5, after the offset processing of the reference distance (S5), offset processing on the overall sewing area 110 (S6) may be performed. The offset processing may be performed to prevent the unit patterns from extending beyond the overall sewing area 110. If a unit pattern is disposed at a position where the curve path comes in contact with the profile lines 111 or 112 (see FIG. 10) of the overall sewing area 110 or at a position where the distance from the profile line 111 or 112 is smaller than the height of the unit pattern, the unit pattern may partially extend beyond the overall sewing area 110. In this example, it may be impossible to obtain sewing data used to form stitches of a quality and beautiful design. To avoid this situation, a sewing area 119, which is slightly smaller than the overall sewing area 110, may be created as shown in FIG. 11. A line that connects points obtained by moving the points on the outer profile line 111 by the height of the unit pattern toward the gravity center point of the overall sewing area 110 with a heart shape having the outer profile line 111 may provide an outer profile line 113 of the sewing area 119. A line that connects points obtained by moving the points on the inner profile line 112 by the height of the unit pattern outward from the gravity center point of the circle may provide an inner profile line 114 of the sewing area 119.

Subsequently, a profile line network 210 may be created (S7). For example, a size of the unit area may be determined based on a reference distance stored in the reference distance storage area 1201. In the present embodiment, the unit area may be a regular hexagon and the length of its side may be calculated as (reference distance)×3/2. As shown in FIG. 12, the unit areas with the determined size may be disposed in a coordinate system, which indicates the sewing area 119.

Figure 13:
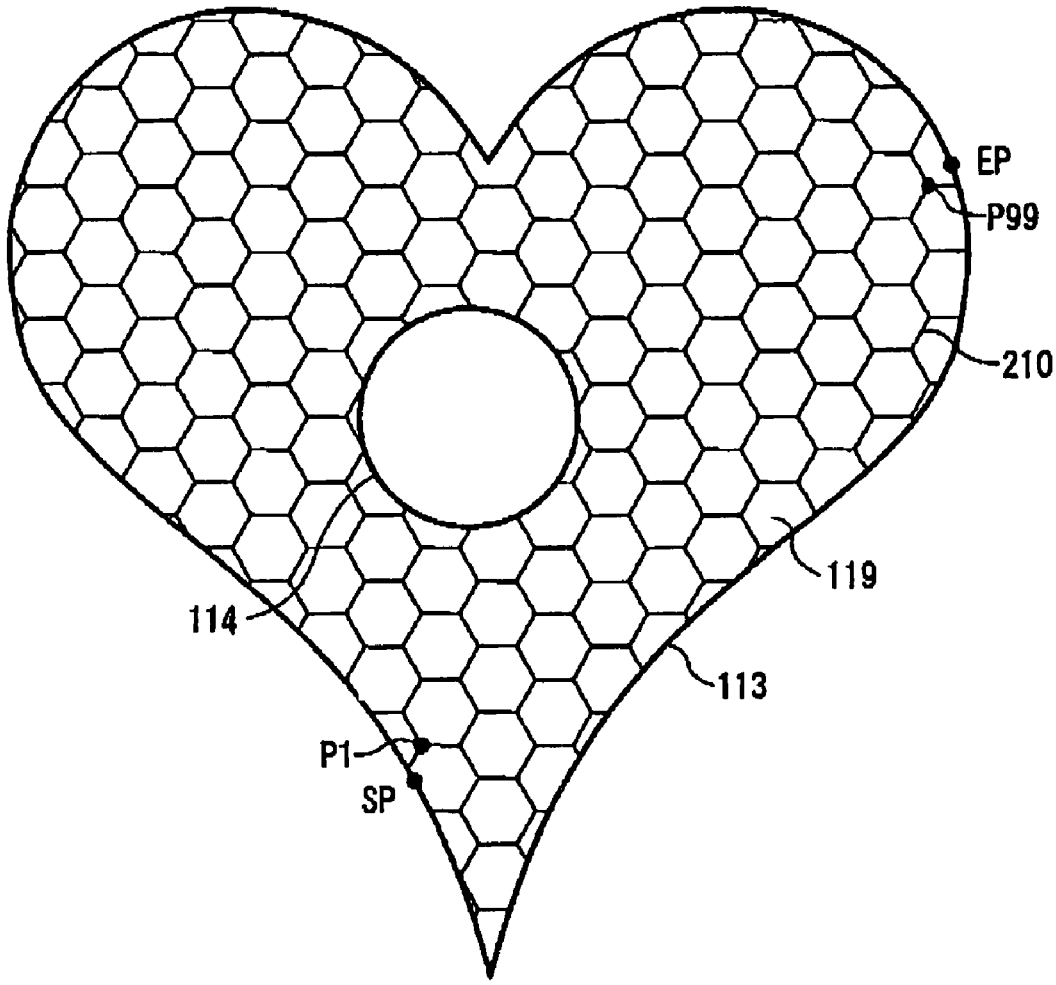
FIG. 13 is a schematic diagram showing profile line network, a stitch path starting point, and a stitch path ending point created in the sewing area.

In the present embodiment, as shown in FIG. 12, the X-coordinate axis may extend horizontally and its value may increase as it moves rightward along the coordinate axis, while the Y-coordinate axis may extend vertically and its value may increase as it moves downward along the coordinate axis. More specifically, a predetermined point of the first unit area may be disposed at predetermined coordinates, for example, origin (0, 0) of the coordinate system. In the example shown in FIG. 12, one vertex of the regular hexagon may be disposed at the origin (0, 0). In the present embodiment, subsequently, following this disposed regular hexagon, other regular hexagons may be continuously arranged without a gap. Two profile lines each representing one side of the two neighboring unit areas (regular hexagons), which may be in contact with each other, may be recognized as one profile line. Then, only the profile lines existing in the sewing area 119 may be extracted as a profile line network 210 as shown in FIG. 13.

Each side of the profile line of the regular hexagon, which is a unit area, is hereinafter referred to as a "side line segment". Also, a point which is a vertex of one regular hexagon, at which vertexes of three hexagons overlap, and at which endpoints of three side line segments overlap is hereinafter referred to as a "branch point". Further, the three side line segments of which one of the endpoints overlap at a branch point are hereinafter referred to as "peripheral side line segments" of the branch point, the three regular hexagons that share this branch point as their vertexes are hereinafter referred to as "peripheral regular hexagons", and the respective three endpoints of the three peripheral side line segments which are at the other end of the side line segment from this branch point are hereinafter referred to as "peripheral branch points". Information that distinguish all the regular hexagons disposed in the sewing area 119 and the coordinates of the vertexes (branch points) of the regular hexagons may be stored as the information of the profile line network 210 in the profile line network storage area 1204 in the RAM 12.

Further, for creation of the profile line network 210, if there is no regular hexagon in the created profile line network 210, it may be difficult to create a stitch path. In such a case, the value stored in the reference distance storage area 1201 may be subtracted by a predetermined numeral (for example, 0.5 mm), to create a new profile line network 210. If, as a result, the value stored in the reference distance storage area 1201 becomes smaller than a predetermined threshold value (for example, 2 mm), even if a well-balanced stitch path is created, actual sewing may become difficult with the embroidery sewing machine 3. Therefore, in such a case, the CPU 11 may determine that it is impossible to form a stippling stitch in this sewing area and so may display an error message and end the processing.

After the profile line network 210 is created (S7), the stitch path starting point P1 and the stitch path ending point P99 may be determined based on the profile line network 210 (S8). For example, a branch point closest to the starting point SP, which may be specified by the user and stored in the starting point storage area 1205, may be set as the stitch path starting point P1 and stored in the stitch path storage area 1207. Similarly, a branch point closest to the ending point EP, which may be specified by the user and stored in the ending point storage area 1206, may be set as the stitch path ending point P99 and stored in the stitch path storage area 1207 as the next point to the stitch path starting point P1.

Subsequently, an initial stitch path 310 may be created on the profile line network 210 (S9). Having the stitch path starting point P1 as a starting point, a side line segment located in a first predetermined direction (clockwise direction along the outer periphery of the sewing area in the present embodiment) may be determined as the initial stitch path 310. Then, focusing on the last branch point on the initial stitch path being created, a side line segment in a second predetermined direction (clockwise direction along the profile line of the regular hexagon to which the last branch point of the initial stitch path being created belongs in the present embodiment) may be traced, to determine the next branch point on the initial stitch path. The line segments obtained by continuously connecting the branch points on the initial stitch path thus determined may produce the initial stitch path 310. The creation of the initial stitch path 310 may be terminated when the last branch point on the initial stitch path comes to the stitch path ending point P99. As a result of such a processing, the initial stitch path 310 may extend on the side line segments, which may be located closer to the outer periphery of the sewing area 119 in the clockwise direction.

Figure 14:
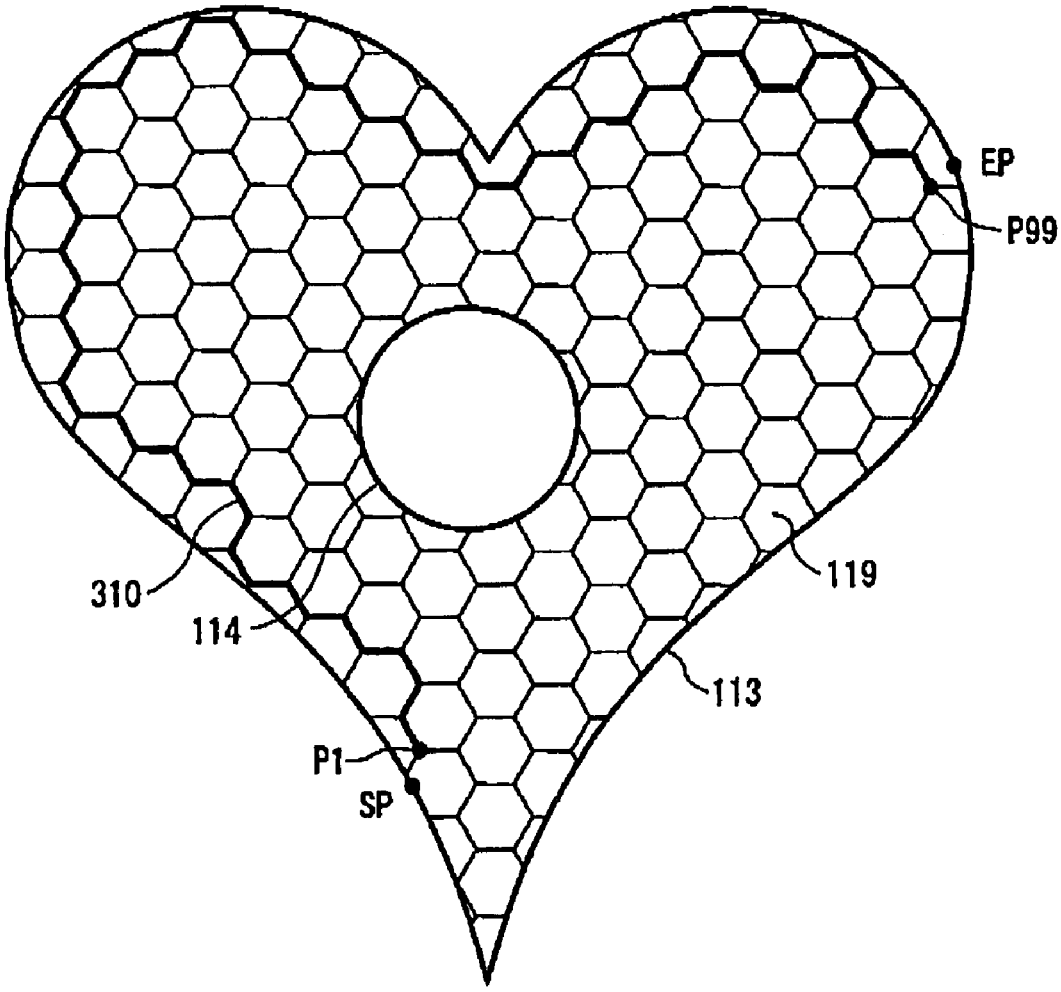
FIG. 14 is a schematic diagram of an initial stitch path created on the profile line network.

For example, if the profile line network 210, the stitch path starting point P1, and the stitch path ending point P99 that are disposed in the sewing area 119 as shown in FIG. 13, the initial stitch path 310 as shown in FIG. 14 may be created. An example of a method of creating the initial stitch path 310 will be described in detail later with reference to FIGS. 23-32. Information that may indicate the initial stitch path 310 may be stored in the stitch path storage area 1207. For example, coordinates of the branch points may be stored in order and may be traced from the stitch path starting point P1 to the stitch path ending point P99.

If the number of the branch points on the initial stitch path 310 is less than six (which is the number of the vertexes of a hexagon), it may be difficult to develop a well-balanced stitch path. To avoid this situation, the value stored in the reference distance storage area 1201 may be subtracted by a predetermined numeral (for example, 0.5 mm). Then, a new profile line network 210 may be created (S7), a new stitch path starting point and a stitch path ending point may be determined (S8), and a new initial stitch path 310 may be created (S9). If the value stored in the reference distance storage area 1201 becomes smaller than a predetermined threshold value (for example, 2 mm), it may become difficult to sew the stitches with the embroidery sewing machine 3, even if a well-balanced sewing path is created. Therefore, in such a case, the CPU 11 may determine that it is impossible to form a stippling stitch in this sewing area and may end the processing after displaying an error message.

Figure 15:
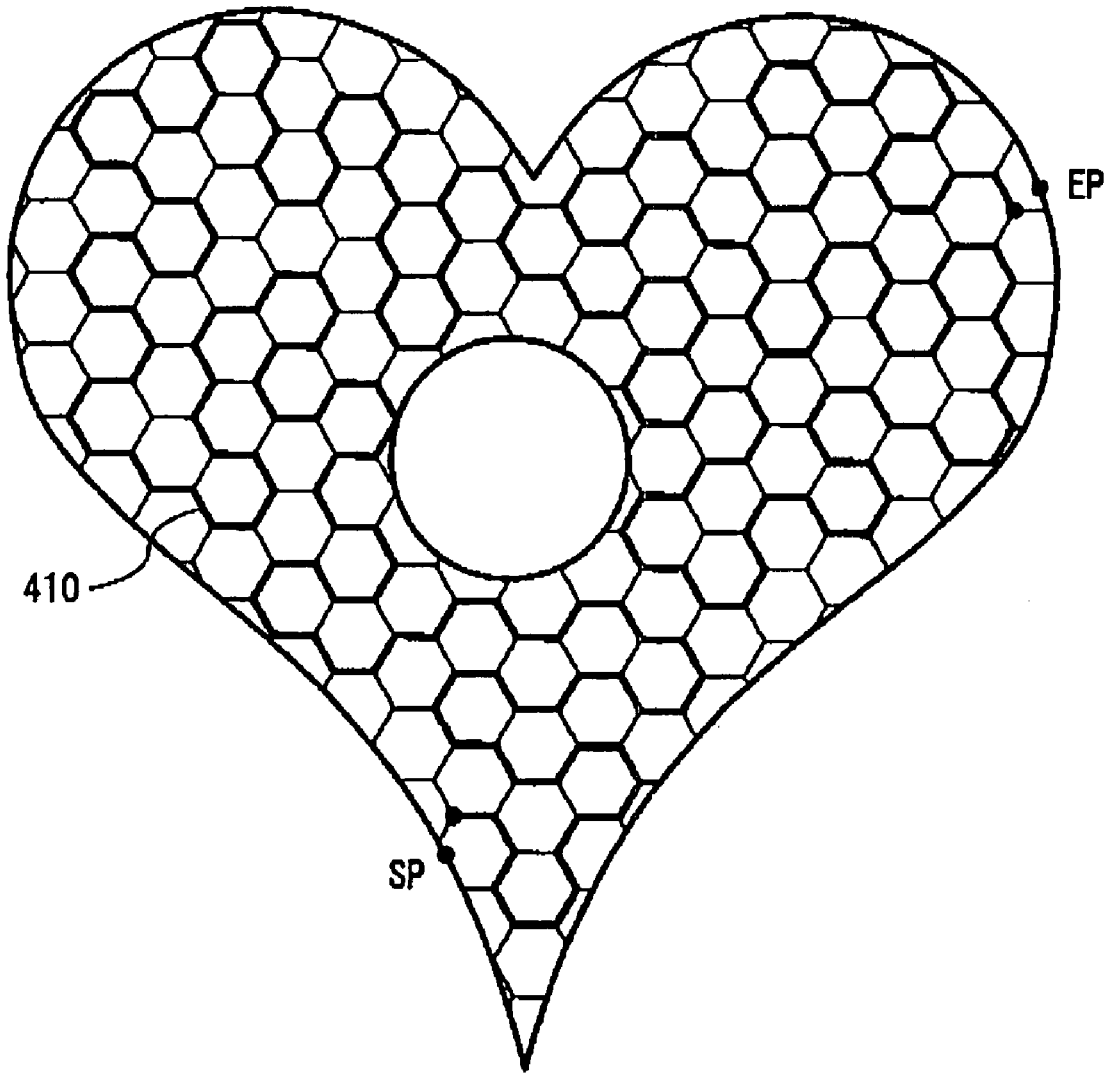
FIG. 15 is a schematic diagram of a stitch path obtained by moving the initial stitch path.

After the initial stitch path 310 is created (S9), movement processing may be performed (see S10 and FIG. 9). In the movement processing, the initial stitch path 310 on the profile line network 210 may be moved in such a manner that the stitch path may be arranged evenly in the sewing area 119. The movement processing will be described in detail later with reference to FIGS. 9 and 33-39. For example, if the movement processing is performed on the initial stitch path 310 as shown in FIG. 14, a stitch path 410, which may be evenly arranged in the sewing area 119 as shown in FIG. 15, may be obtained.

After the stitch path 410 is evenly arranged in the sewing area 119 by the movement processing (S10), special processing may be performed (S11). The special processing may be performed to move the stitch path if there is a pointed portion or a tapered end portion in the sewing area 119. This will be described in detail later with reference to FIGS. 40-42.

Figure 16:
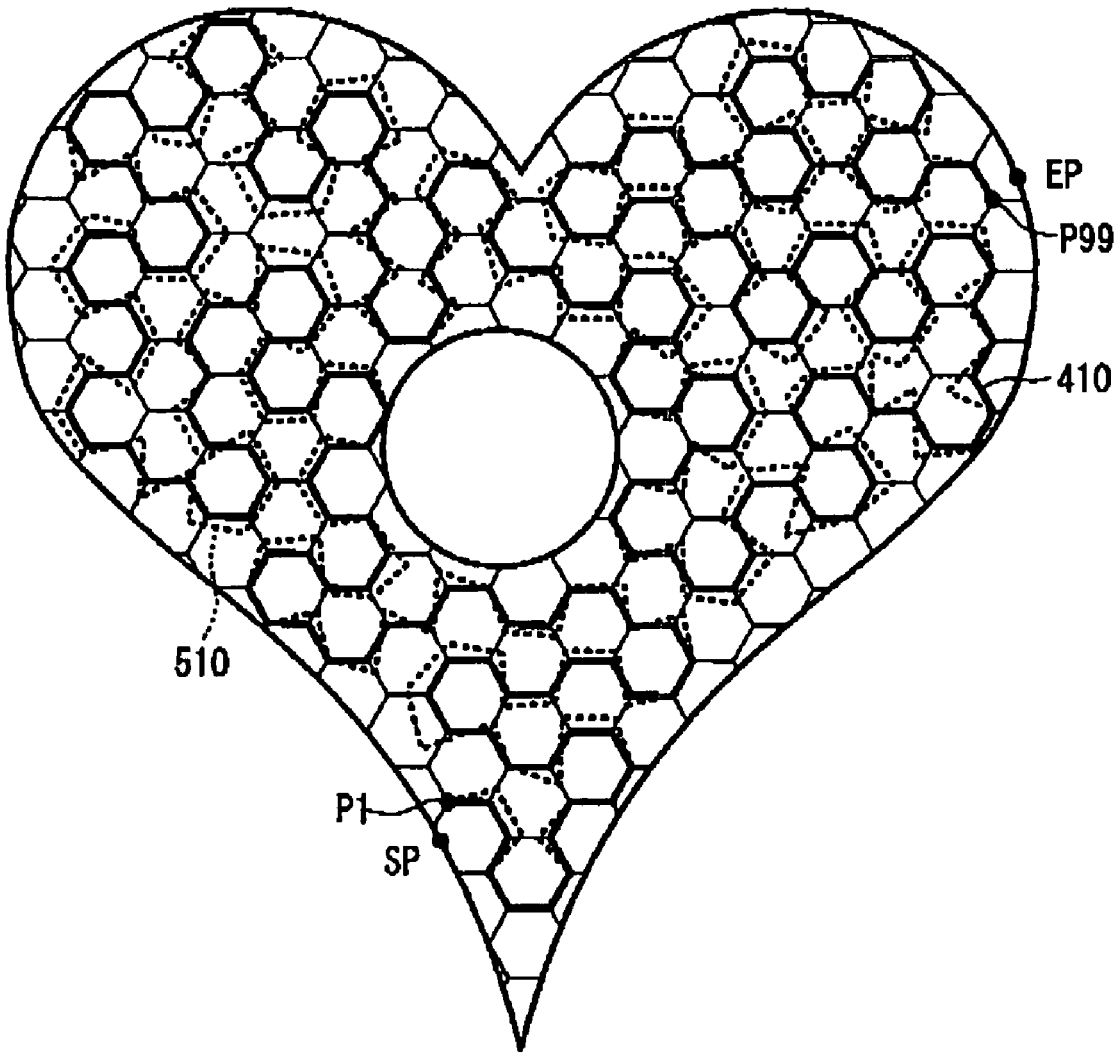
FIG. 16 is a schematic diagram of a transformed stitch path obtained by transforming the stitch path.

After the special processing (S11), transformation processing of the stitch path 410 may be performed (S12). In the transformation processing, the coordinates of the branch points on the stitch path 410 may be moved, and may thereby create a transformed stitch path 510 as shown in FIG. 16. The curvatures of the curved stitch path may become uneven by moving the branch points. As a result, the stitch path may become a non-uniform path, and may create a well-balanced appearance. For example, a path formed by a dotted line shown in FIG. 16 may be the transformed stitch path 510. An example of a method for moving the coordinates of the branch points will be described in detail later with reference to, for example, FIGS. 43-45.

Figure 17:
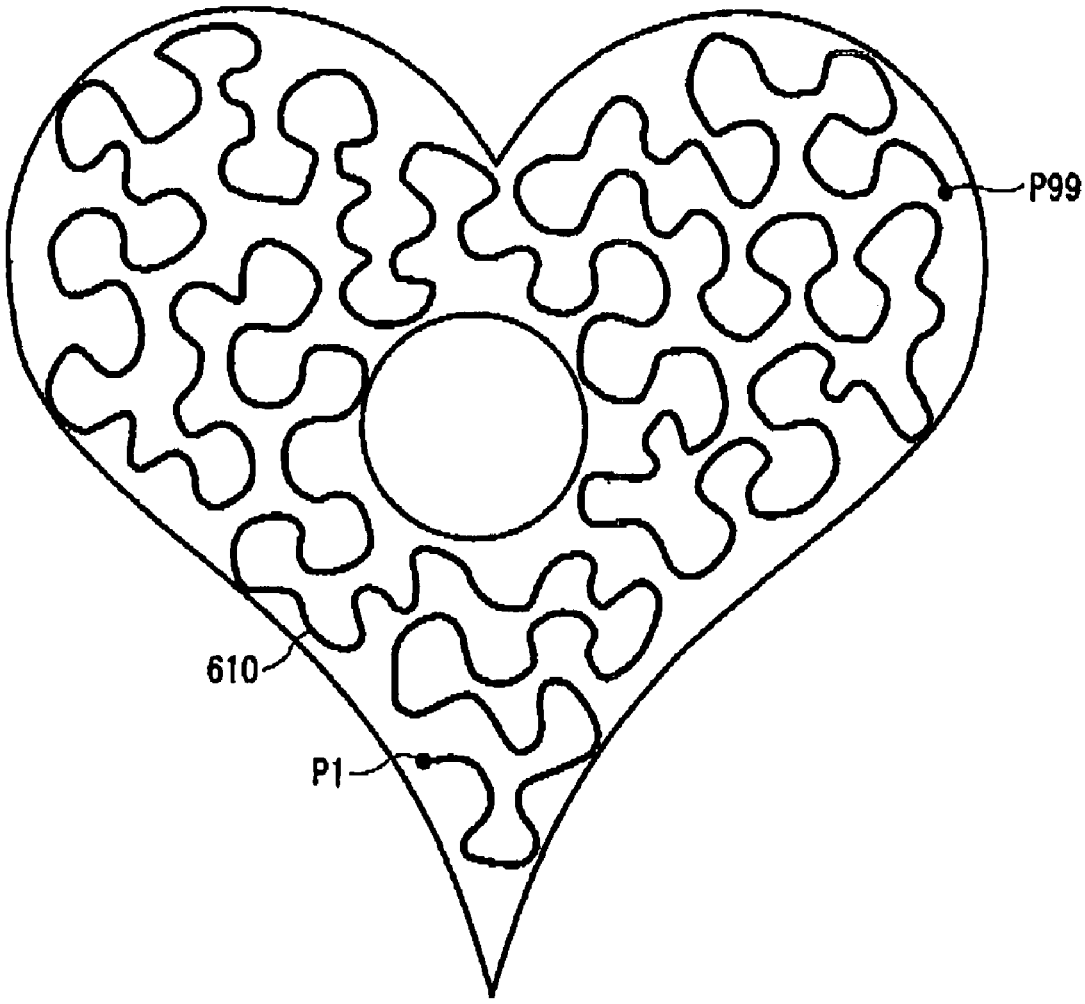
FIG. 17 is a schematic diagram of a curve path obtained by changing the transformed stitch path into a Bezier curve.
Figure 51:
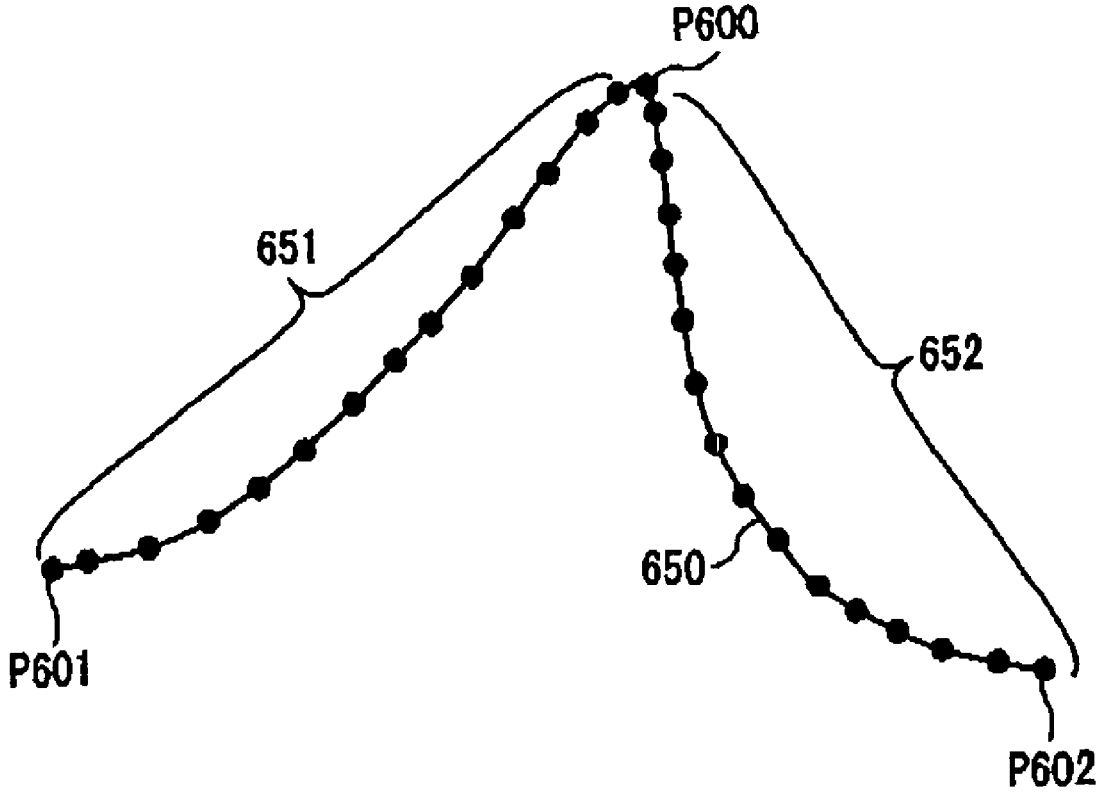
FIG. 51 is an explanatory diagram of a curve path.

Subsequently, a transformed stitch path 510 may be changed into a Bezier curve to create, for example, a curve path 610 shown in FIG. 17. The information of the curve path 610 may be stored in the curve storage area 1208 (S13). As shown in FIG. 51, the curve path 610 may be represented by many points disposed densely on the curve. The coordinates of the points may be stored in the curve storage area 1208 sequentially from the stitch path starting point P1 to the stitch path ending point P99.

Figure 18:
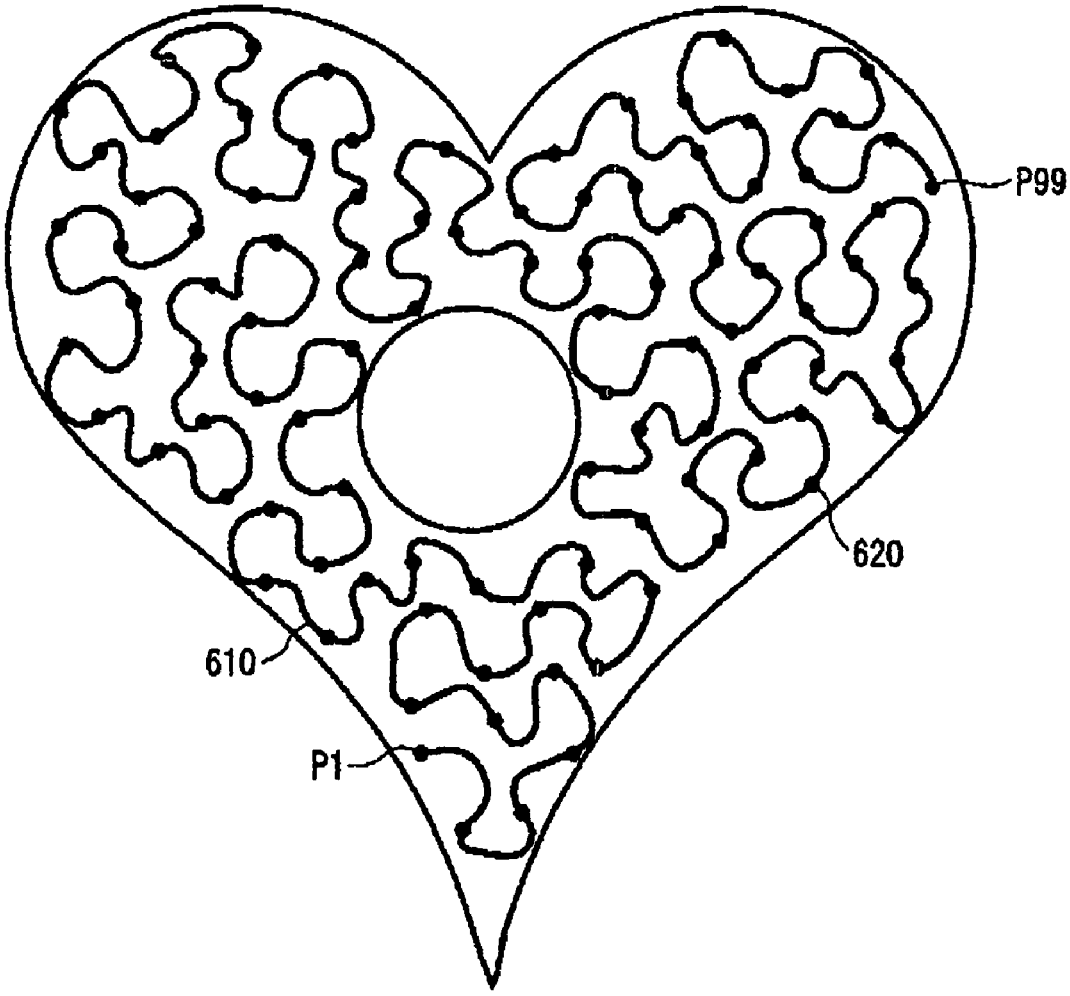
FIG. 18 is a schematic diagram of disposition positions of unit patterns on the curve path.

Subsequently, pattern disposition processing may be performed (S14). In the pattern disposition processing, the unit pattern selected in S2 may be disposed on the curve path at the intervals input in S2. In the example shown in FIG. 17, disposition points 620, which indicate positions at which the unit patterns may be disposed, may be placed as shown in FIG. 18. The details of the pattern disposition processing will be described later with reference to, for example, FIGS. 46-50.

Subsequently, stitch creation processing may be performed (S15). In the stitch creation processing, needle drop points may be determined on the curve path 610 based on the stitch length that may be stored in the stitch length storage area 1202 and the stitch information storage area 1209. In the sewing data creation apparatus 1, the coordinates of the needle drop points may be determined in such a manner as to provide an even stitch length, that is, an even distance between the needle drop points. A method for determining the coordinates of the needle drop points will be described in detail later with reference to, for example, FIGS. 51-52. Further, needle drop points for sewing the unit patterns disposed in the pattern disposition processing may also be stored in the stitch information storage area 1209.

For example, as shown in FIG. 18, decorative patterns (unit patterns) may be disposed to respective disposition points as shown in FIG. 19. The curve path 610 may be arranged in the sewing area 119 enclosed by the outer profile line 113 and the inner profile line 114. The sewing area 119 may be obtained by shrinking the overall sewing area 110 enclosed by the outer profile line 111 and the inner profile line 112 by the height of the unit pattern as an offset. For example, even when a part of the curve path 610 is arranged in the vicinity of the outer profile line 113 and the disposed unit pattern extends beyond the outer profile line 113, the disposed unit pattern may not extend beyond the outer profile line 111 of the overall sewing area 110. In the example shown in FIG. 19, the length of the offset may be shown larger than the height of the unit patterns for easy understanding.

After the stitch creation processing (S15), sewing data, which may be used in the embroidery sewing machine 3, may be created based on the information of the needle drop points stored in the stitch information storage area 1209 (S16), and the main processing may be terminated.

In such a manner, the initial stitch path 310 may be created on the profile line network 210 disposed in the sewing area 119 (S9), the initial stitch path 310 may be moved through the movement processing in such a manner that the stitch path may be evenly arranged in the sewing area 119, and may thereby create the stitch path 410 (S10). Further, the stitch path 410 may be transformed to create the transformed stitch path 510 (S12) and the transformed stitch path 510 may be further changed into a Bezier curve to create the curve path 610 (S13), thereby determining a path for a stippling stitch. Then, the unit patterns may be disposed on the determined curve path 610 (S14) to create stitches including the unit patterns (S15), and may further create the sewing data that enables sewing by the embroidery sewing machine 3 (S16). Based on thus created sewing data, the embroidery sewing machine 3 may be driven to sew the stippling stitch and the unit patterns as decorative patterns onto the work cloth held by the embroidery frame 31.

Figure 23:
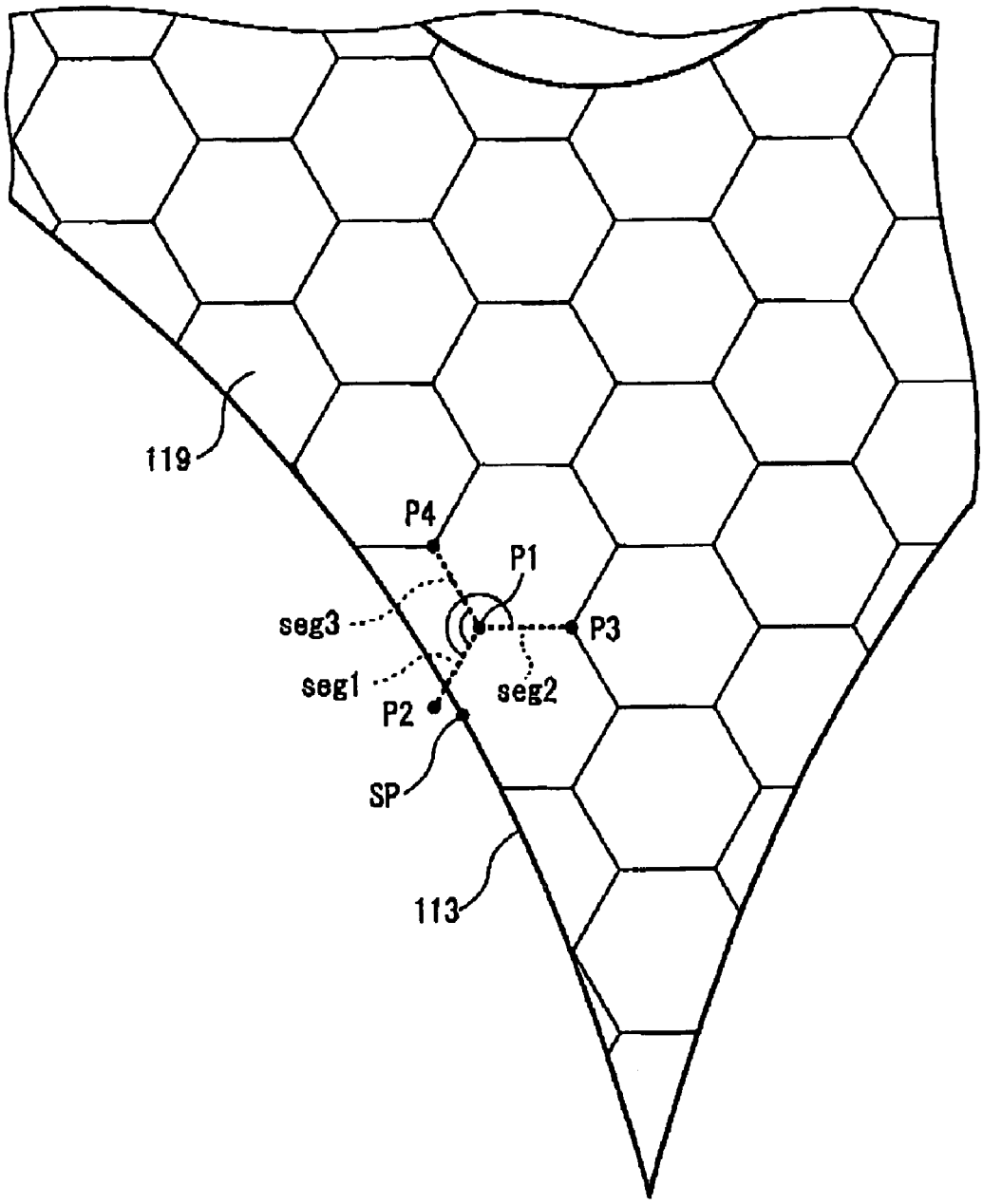
FIG. 23 is an explanatory diagram of a determination of a branch point that follows a stitch path starting point.

Next, an example of a method for creating the initial stitch path 310 will be described in detail below with reference to FIGS. 23-28. As shown in FIG. 23, at the stitch path starting point P1, peripheral side line segments of the branch point P1, that is, seg1, seg2, and seg3, which share the branch point P1 as one of their endpoints, may be specified as candidates for the initial stitch path 310. The side line segments seg1, seg2, and seg3 are shown in dotted lines in FIG. 23. The endpoint of the side line segment seg1 other than the branch point P1 may be a branch point P2, the endpoint of the side line segment seg2 other than the branch point P1 may be a branch point P3, and the endpoint of side line segment seg3 other than the branch point P1 may be a branch point P4. The branch points P2, P3, and P4 may be the peripheral branch points of the branch point P1.

Figure 24:
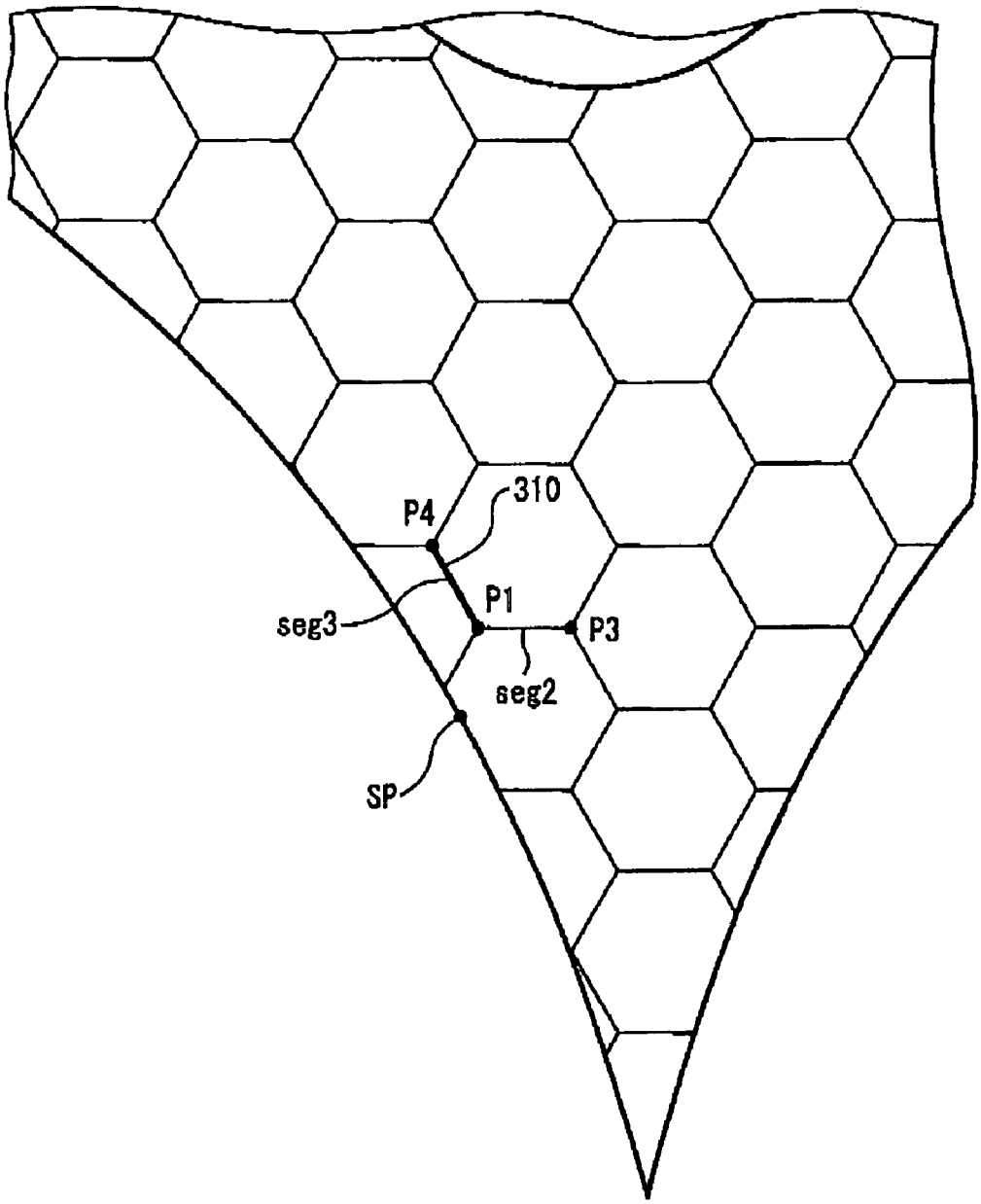
FIG. 24 is an explanatory diagram of a state where one side line segment is determined as a stitch path.

In an exemplary embodiment, the initial stitch path 310 may be formed by tracing the side line segment closer to the outer profile line 113 of the sewing area 119 leftward from the stitch path starting point P1 as a starting point up to the stitch path ending point P99. In other words, the side line segment closer to the outer periphery of the sewing area 119 may be successively traced clockwise along the outer periphery of the sewing area 119. For example, first, a line segment intersected by the outer profile line 113 of the sewing area 119 may be searched for from among the peripheral side line segments of the stitch path starting point P1, that is, seg1, seg2, and seg3. In an example shown in FIG. 23, the side line segment seg1 is obtained. Then, angles between the side line segment seg1 and each of side line segments seg2 and seg3 may be calculated. Those angles may be calculated angles from the side line segment seg1 in the clockwise direction. One of the two side line segments with a smaller angle thus calculated may be determined to be closer to the outer periphery in the clockwise direction. The branch point of the side line segment other than the stitch path staring point P1 may be determined as a new branch point on the initial stitch path. In the example shown in FIG. 23, the side line segment seg3 may be determined as being closer to the outer periphery in the clockwise direction, and the branch point P4 may be selected as a new branch point on the initial stitch path. Therefore, the coordinates of the branch point P4 may be inserted between the stitch path starting point P1 and the stitch path ending point P99 and may be stored in the stitch path storage area 1207. As a result, the initial stitch path 310 may be extended from the branch point P1 to the branch point P4. In FIG. 24, the side line segment seg3 shown in bold line may represent the initial stitch path 310 at this stage.

Next, a direction in which the initial stitch path may be extended from the branch point P4 will be described below with reference to FIG. 25. The peripheral branch points of the branch point P4 may be branch points P1, P5, and P6. In this example out of these three points, the branch point P1 served as an origin based on which the branch point P4 was set on the initial stitch path. Therefore, the branch point P1 may be excluded as a possible new point on the initial stitch path. Instead, a branch point located to the left of the branch point P4 as viewed from the branch point P1 may be first determined as a candidate for a new point on the initial stitch path. That is, the side line segment seg4 diverging to the left from the branch point P4 as viewed from the branch point P1 may be determined as a candidate for an initial stitch path. A branch point positioned to the left of branch P4 as viewed from the branch point P1 may be selected by comparing the coordinates of branch P1 and those of the branch point P4.

FIG. 29 shows various cases of determining the branch point on the left side. In FIG. 29, a bold-line arrow in a schematic diagram field may indicate a side line segment already determined as the initial stitch path and a dotted-line arrow may indicate a side line segment to be newly selected as the initial stitch path. In the schematic diagrams of FIG. 29, the x-axis may extend rightward and the y-axis may extend downward. For example, in the case of the upper left schematic diagram in an explanatory table 800, a side line segment seg801, which may have already been determined as the initial stitch path, may have its x-coordinate increasing and its y-coordinate decreasing in a direction from the starting point to the ending point of the initial stitch path. In such a case, the x-coordinate may be the same as that of the target branch point P801 and the y-coordinate may be smaller than that of the focus branch point P801. Therefore, a branch point P802 may be selected as a candidate for a new point on the initial stitch path.

Figure 25:
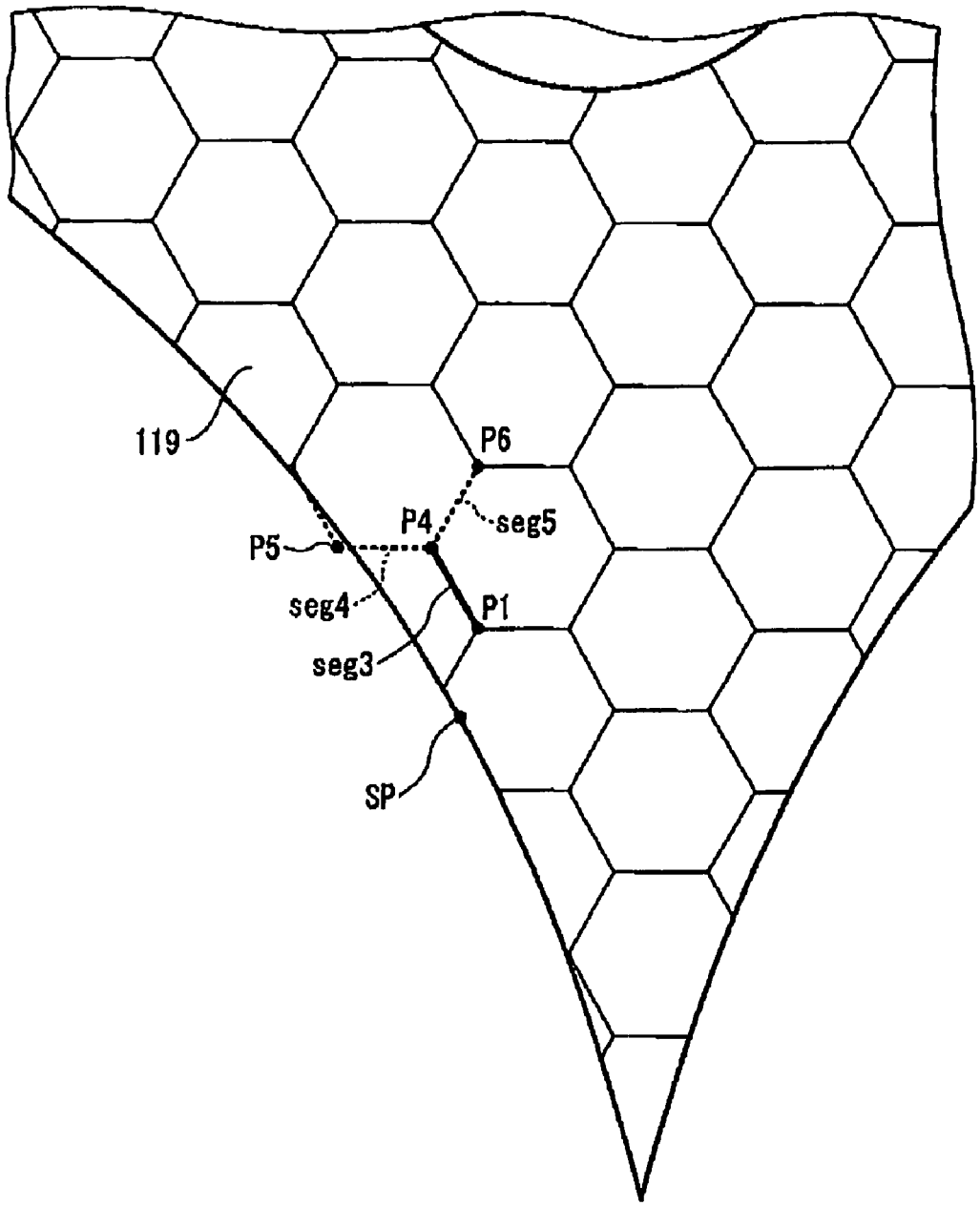
FIG. 25 is an explanatory diagram of a process of determining a next branch point following the state of FIG. 24.

The example shown in FIG. 25 may correspond to the lower right schematic diagram in the explanatory table 800 shown in FIG. 29. Accordingly, a branch point on the left side of the branch point P4 may be determined as the branch point P5. Then, the coordinates of the branch point P5 may be calculated and it may be determined whether the coordinates are stored in the stitch path storage area 1207. That is, it may be determined whether the line segment seg4 connecting the branch points P4 and P5 have already been determined as the stitch path. However, the coordinates of the branch point P5 may need not be stored in the stitch path storage area 1207. Therefore, subsequently, it may be determined whether the coordinates are stored in the profile line network storage area 1204. However, as shown in FIG. 25, the branch point P5 may be positioned outside the sewing area 119, so that its coordinates may not be stored in the profile line network storage area 1204. Accordingly, the branch point P5 may be excluded from the candidates for the next point on the initial stitch path.

Figure 26:
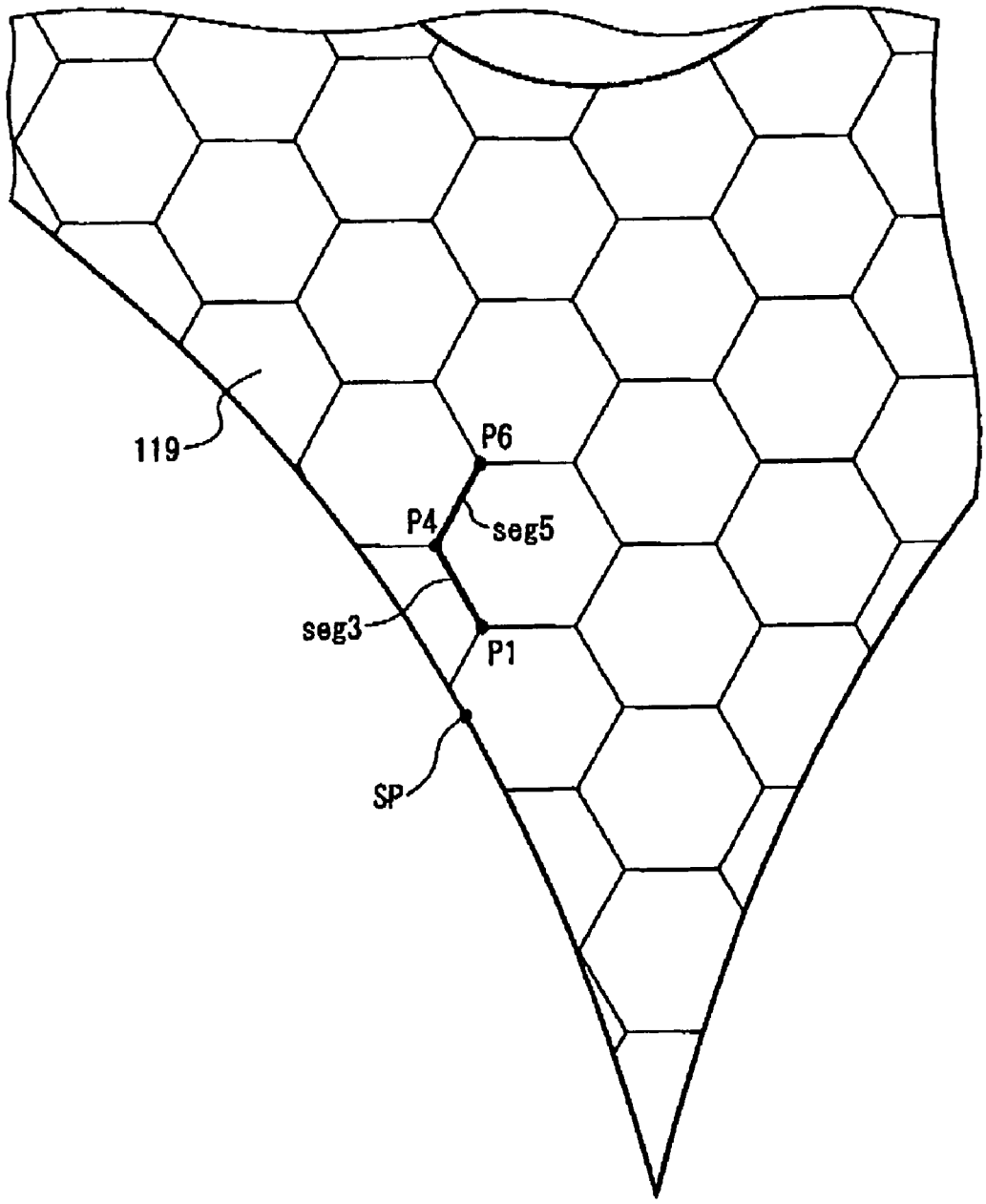
FIG. 26 is an explanatory diagram of a state where the next branch point is determined following the state of FIG. 24.

Subsequently, the coordinates of the branch point P6 on the right side may be calculated and it may be determined whether its coordinates are stored in the stitch path storage area 1207. For example, at the stage of FIG. 25, the coordinates of the branch point P6 are not yet stored in the stitch path storage area 1207. Then, it may be determined whether its coordinates are stored in the profile line network storage area 1204. The coordinates of the branch point P6 may be inside the sewing area 119 and stored in the profile line network storage area 1204. Therefore, the side line segment seg5 connecting the branch points P4 and P6 may be determined as a next point on the initial stitch path. The coordinates of the branch point P6 may also be inserted between the branch point P4 and the stitch path ending point P99 and may be stored in the stitch path storage area 1207. As a result, as shown in FIG. 26, the initial stitch path may be traced from the branch point P1 to the branch point P4 then to the branch point P6.

Figure 27:
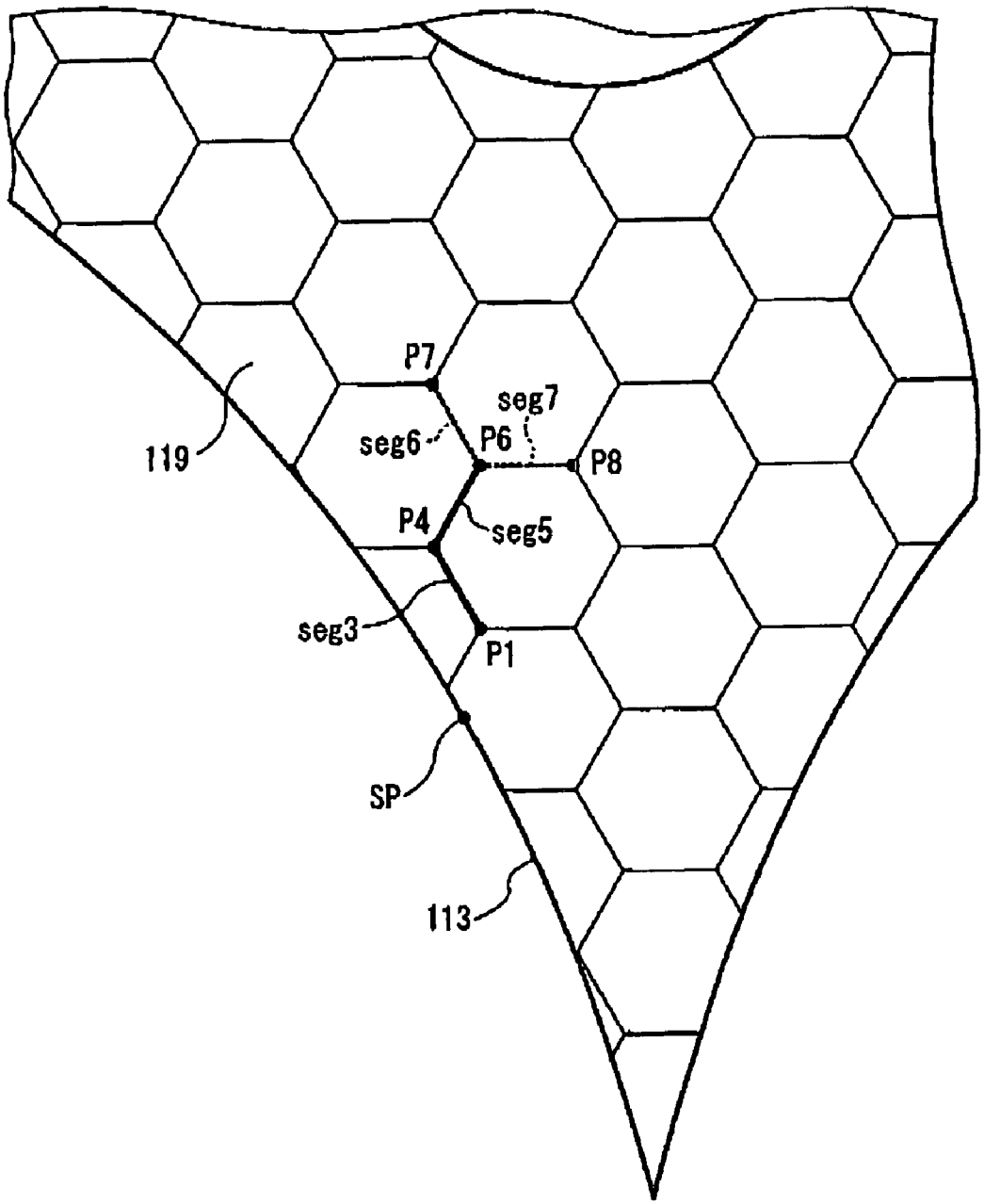
FIG. 27 is an explanatory diagram of a process of determining a next branch point following the state of FIG. 26.
Figure 28:
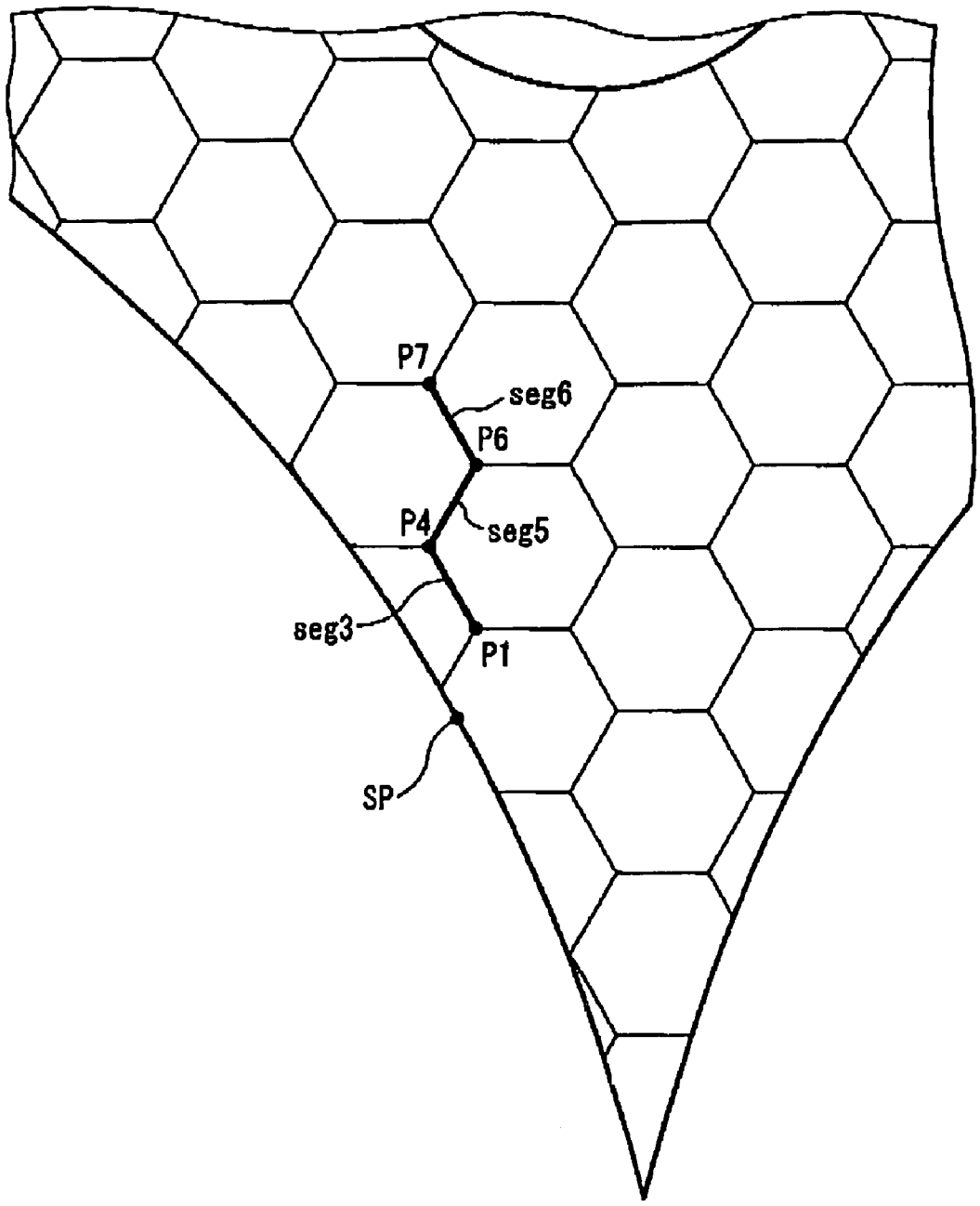
FIG. 28 is an explanatory diagram showing a state where the next branch point is determined following the state of FIG. 26.

Next, as shown in FIG. 27, focusing on the branch point P6, the next branch point on the initial stitch path may be determined based on the three peripheral branch points of the branch point P6, that is, the branch points P7, P8, and P4. In this example, the three branch points, the branch point P4 served as the origin and so the branch point P4 may be excluded from the possible candidates for the next branch point. Also, the side line segment seg5 may slope to the upper right, and when the branch points P4 and P6 are compared, the x-coordinate may be increased, and the y-coordinate may be decreased. Accordingly, as shown in the explanatory table 800 of FIG. 29, a side line segment to be selected may have its x-coordinate and y-coordinate decreasing. From the explanatory table 800, the branch point P7 may be determined to be on the left side of the branch point P6 as viewed from the branch point P4. Accordingly, the branch point P7 may be determined as the first candidate for the next point on the initial stitch path and it may be determined whether it may be selected as the next point on the initial stitch path. The branch point P7 may not yet have been selected as a point on the initial stitch path and therefore it may not be stored in the stitch path storage area 1207. In addition, the branch point P7 may be in the sewing area 119 and thus may be stored in the profile line network storage area 1204. Therefore, the branch point P7 may be determined as the next point on the initial stitch path and the side line segment seg6 connecting the branch points P6 and P7 may be determined as the initial stitch path. The coordinates of the branch point P7 may be inserted between the branch point P6 and the stitch path ending point P99 may be stored in the stitch path storage area 1207. As a result, as shown in FIG. 28, the initial stitch path may be traced from the branch point P1 to the branch points P4 and P6 and then to the branch point P7.

In such a manner, the next branch point of the branch point newly determined on the initial stitch path may be sequentially determined, thereby creating the initial stitch path 310 as shown in FIG. 14.

Figure 30:
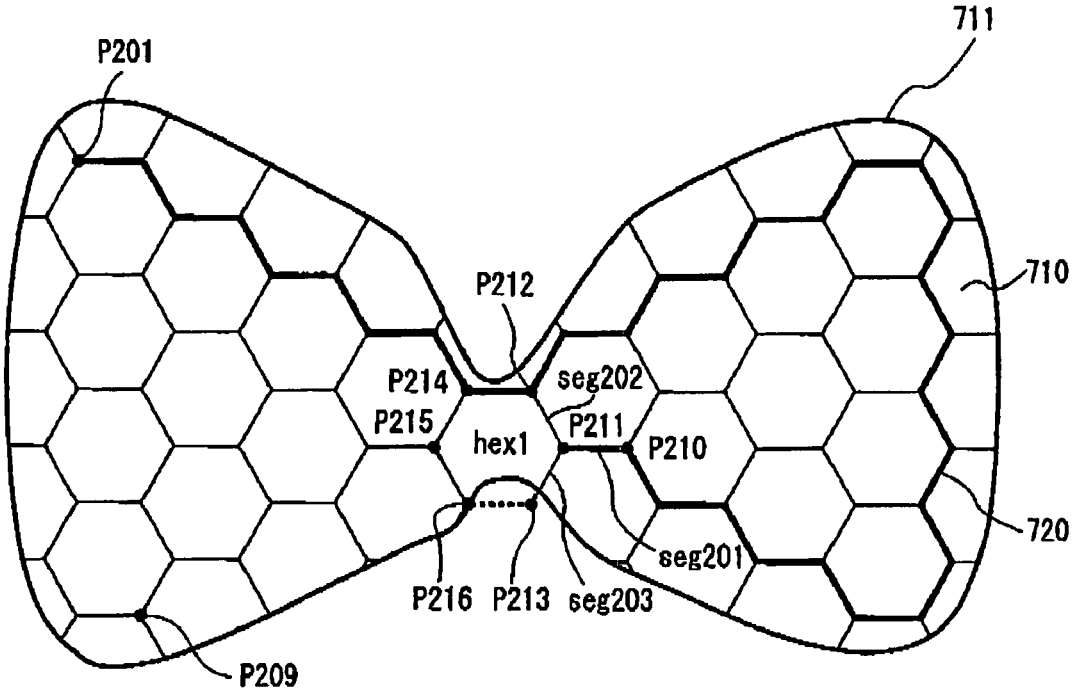
FIG. 30 is an explanatory diagram of a state where an initial stitch path has been created immediately before a narrowed portion.
Figure 31:
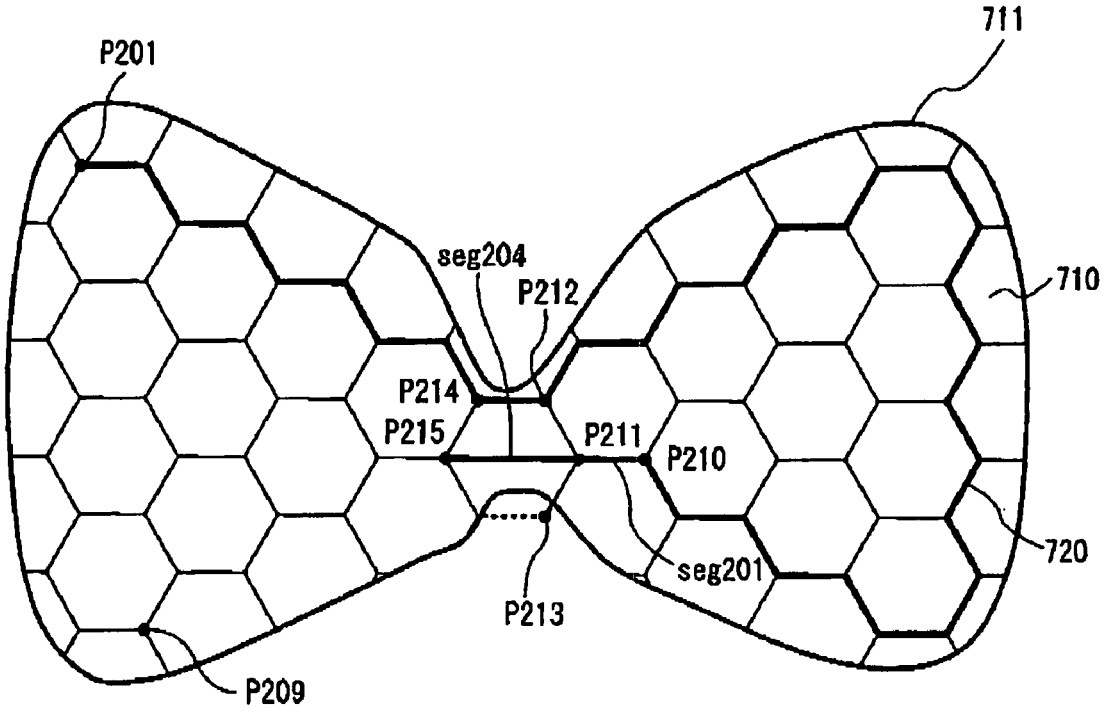
FIG. 31 is an explanatory diagram of a state after the initial stitch path has been created at the narrowed portion.
Figure 32:
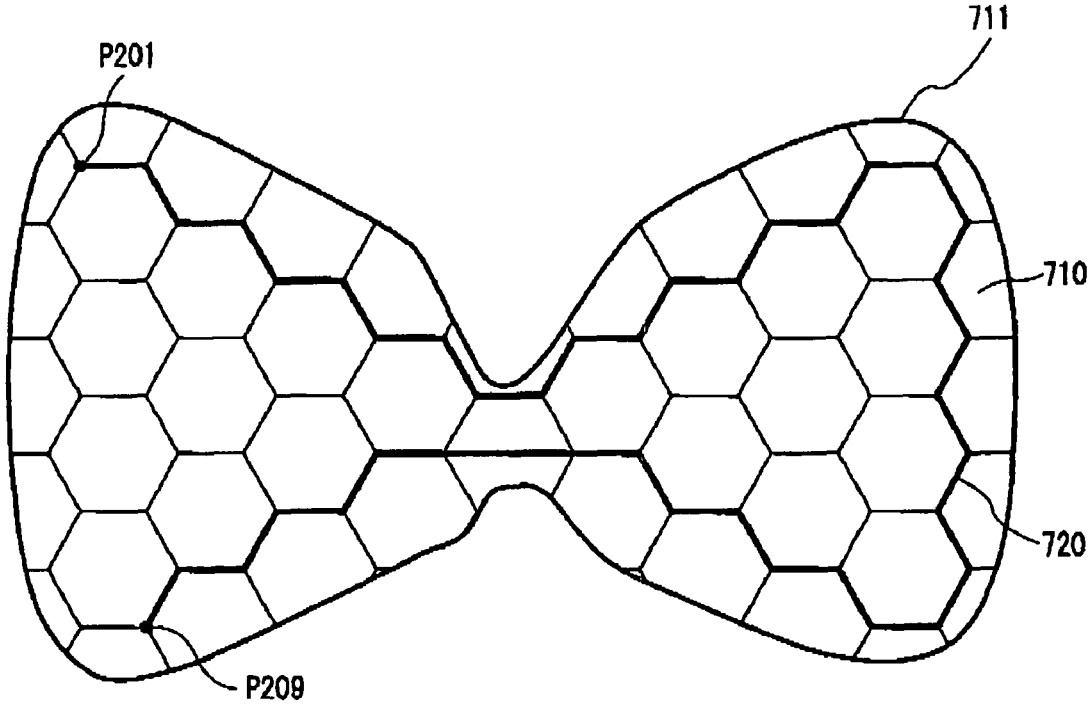
FIG. 32 is a schematic diagram of a state where the entire initial stitch path has been created in a sewing area.

The following will describe an example of special processing for creation of the initial stitch path 310 with reference to FIGS. 30-32. The special processing may be performed in a process of creating the initial stitch path in a sewing area, such as the sewing area 710 which may be defined by a profile line 711 having a narrowed portion as shown in FIG. 30. The narrowed portion herein refers to a portion where the distance between two parts of the profile line facing each other is smaller than the length of the unit area so that, for example, only one or less side line segment of the profile line network exists.

As shown in FIG. 30, an initial stitch path 720 may be created from a stitch path starting point P201 to a branch point P211 along the outer profile line of the sewing area 710 in the clockwise direction. In this example, a problem may occur when a next branch point following the branch point P211 is determined on the initial stitch path 720. The branch point P211 may have its peripheral branch points P210, P212, and P213. The branch point P210 may be excluded from the possible candidates because it may have served as an origin when determining the branch point P211 as a point on the initial stitch path. Accordingly, the branch point P213 may be determined as a first candidate for the next point on the initial stitch path. However, the branch point P213 may be outside the sewing area 710 and thus not stored in the profile line network storage area 1204. Moreover, the next candidate for the branch point P212 may already be positioned on the initial stitch path 720 and stored in the stitch path storage area 1207. In this example, none of the three peripheral points of the branch point P211 may satisfy the conditions for being a new point on the initial stitch path 720.

In such an example, two of the side line segments among seg201, seg202, and seg203 having the branch point P211 as the endpoint may be selected, excluding one of the side line segments already determined as the initial stitch path 720. Then focus may be made on a regular hexagon, which has the selected two side line segments. In the example of FIG. 30, focus may be made on a regular hexagon hex1 having the side line segments seg202 and seg203, excluding the side line segment seg201. The regular hexagon hex1 may have six vertexes from the branch point P211 to branch points P213, P216, P215, P214, and P212 clockwise. Then, for example, as shown in FIG. 31, a line segment seg204 that connects the branch point P211 and its facing vertex P215 may be created. Then, it may be determined whether the line segment seg204 intersects with the profile line 711 of the sewing area 710. For example, as shown in FIG. 31, if the line segment seg204 and the profile line 711 do not intersect, the branch point P215 may be determined as a new point on the initial stitch path. Then, the coordinates of branch point P215 may be inserted between the branch point P211 and the stitch path ending point P209 and may also be stored in the stitch path storage area 1207. Afterward, the initial stitch path 720 may extend to the stitch path ending point P209 along such a path as shown in FIG. 32.

If the line segment seg204 and the profile line 711 intersect, the line segment seg204 connecting the branch points P215 and P211 may pass through outside the sewing area 710. In such a case, the branch points P215 and P211 need not be connected. Therefore, the initial stitch path 720 may not be extended any further and the stitch path ending point P209 may not be reached. In such a manner, there may be a case where none of the three peripheral branch points satisfy the conditions for being a new point on the initial stitch path 720. In a regular hexagon that has two side line segments excluded from the initial stitch path 720 out of three peripheral side line segments of this branch point, a line segment connecting the facing vertexes may intersect with a profile line of a sewing area. In this case, a message may be displayed to notify the user that a stitch path is difficult to create and the processing may be terminated. Therefore, the user may change the sewing area, for example, subdivide the sewing area into right and left regions at the narrowed portion, and may perform the main processing again.

Next, an example of the operations of moving the initial stitch path 310 to thereby create a stitch path 410 evenly arranged in the sewing area 119 will be described in detail below with reference to the flowchart of FIG. 6 and FIGS. 33-36. In the movement processing shown in S10 of the main processing of FIG. 5, if the number of the side line segments that have been determined as the stitch path in a target regular hexagon is smaller than the number of the side line segments, which have not yet been determined as the stitch path, the side line segments, which have been determined as the stitch path, may be excluded from the stitch path and the side line segments, which have not yet been determined as the stitch path, may be determined as the stitch path instead. That is, rather than changing the starting point and the ending point of the stitch path in the target regular hexagon, the stitch path may be moved on the profile line of the hexagon so that it has a longer distance.

For example, the initial stitch path 310 may be an initial state, and the branch points on the stitch path may be sequentially traced from the stitch path starting point P1 to the stitch path ending point P99. It may then be determined whether the state corresponds to a pattern (movement pattern) that the stitch path may be moved. If the state corresponds to a stitch path movement pattern, the stitch path may be moved. In the present example, various modes may be provided to define a probability of moving the stitch path, depending on the state of a branch point, which may correspond to a movement pattern. In tracing the branch points from the stitch path starting point P1 to the stitch path ending point P99, the probability may be determined in accordance with the corresponding mode. Thus, the stitch path may be moved at random, to result in the stitch path arranged in the sewing area 119 in a balanced manner.

In the following, first, examples of the movement patterns will be described and then examples of the modes will be described, with reference to FIGS. 33-36. In an exemplary embodiment, two patterns, movement patterns A and B, may be provided. Movement pattern A may represent a state in which a target regular hexagon has two side line segments, which may have been made as the stitch path, and four side line segments, which may not have been made as the stitch paths. The movement pattern B may represent a state in which a target regular hexagon has one side line segment, which may have been made as a stitch path, and five side line segments, which may not have been made as the stitch paths.

First, the movement pattern A will be described below. Focusing on one branch point, branch points may be traced counterclockwise. The branch points may be, for example, respective vertexes of a regular hexagon having the focused-on branch point (target point) as one of its vertexes. Then, it may be determined whether these branch points have their coordinates stored in the stitch path storage area 1207 and are thus already on the stitch path. If none of the first, second, or third vertexes is on the stitch path, as counted from the target branch point counterclockwise, while the fourth vertex is a point on the stitch path, this state may be determined to correspond to the movement pattern A. In other words, it may be a state where a side line segment connecting the target point and the fifth vertex when counted counterclockwise and another side line segment connecting the fifth and fourth vertexes may have already been determined as the stitch path.

If the movement pattern A applies, two side line segments, a side line segment connecting the target point and the fifth vertex and another side line segment connecting the fifth and fourth vertexes, may have been determined as the stitch path. Because the regular hexagon may be formed by six side line segments, none of the remaining four side line segments may be determined to be the stitch path. Therefore, because the total length of the four side line segments may be longer than that of the two side line segments, the stitch path may be moved to the four side line segments. That is, the stitch path may be changed to the side line segments connecting, counterclockwise, the target point and the first vertex, the first and second vertexes, the second and third vertexes, and the third and fourth vertexes.

Figure 33:
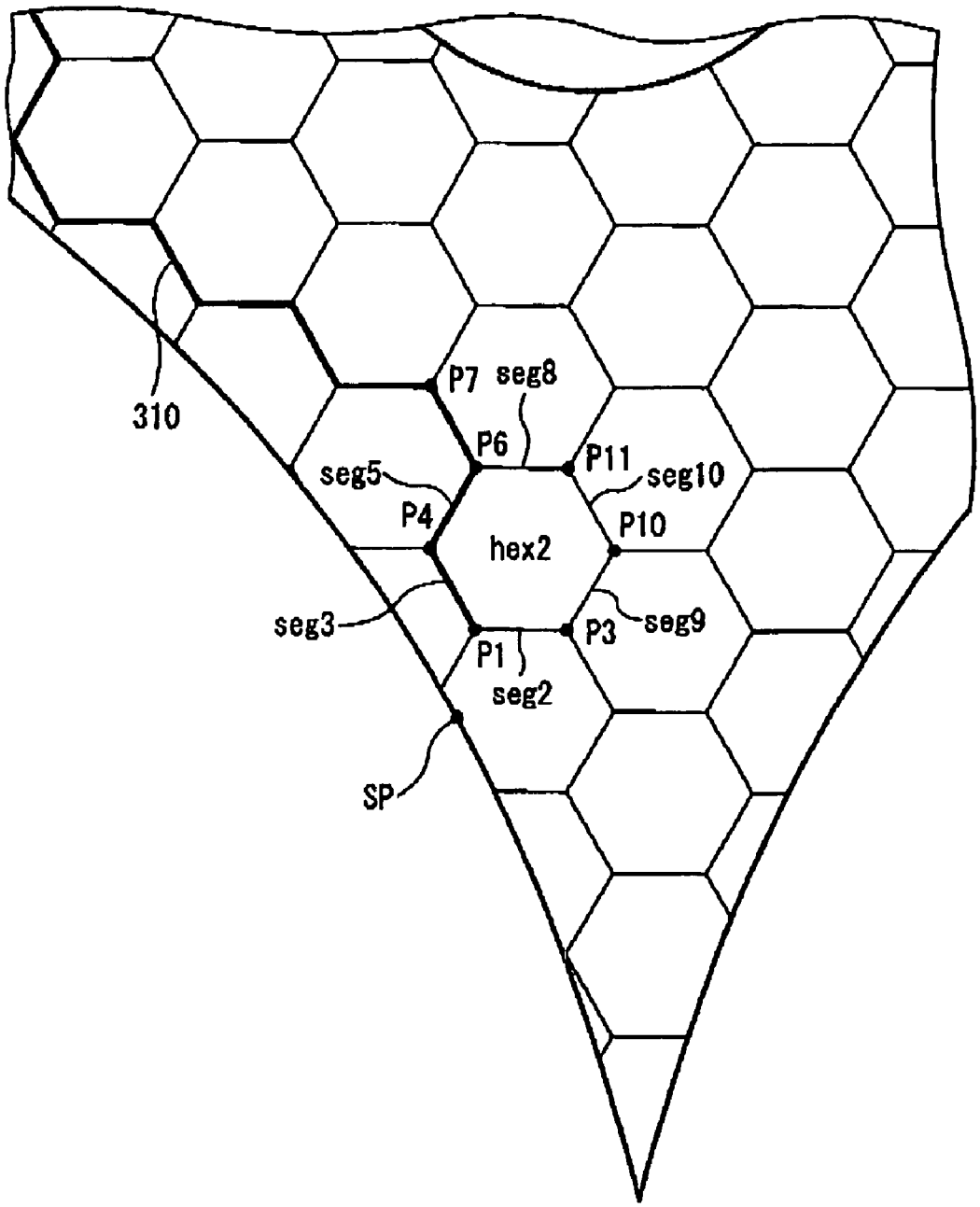
FIG. 33 is an explanatory diagram showing a case to which movement pattern A applies.

In the example shown in FIG. 33, the stitch path starting point P1 is a target point and focus may be made on a regular hexagon hex2 having the vertexes of branch points P3, P10, P11, P6, and P4. The branch points P3, P10, P11, P6, and P4 may be traced in this order in the regular hexagon hex2. In the regular hexagon hex2, two side line segments, that is, the side line segment seg3 connecting vertexes P1 and P4 and the side line segment seg5 connecting vertexes P4 and P6, may be the initial stitch path 310. For example, the stitch path storage area 1207 may store the information of the branch points P1, P4, P6, P7, in this order as the points on the stitch path. That is, none of the first, second, and third vertexes (P3, P10, and P11), as counted from the target point P1 counterclockwise, may be on the stitch path, but the fourth vertex (P6) may be on the initial stitch path 310. Therefore, this state may be determined as corresponding to the movement pattern A.

Accordingly, the information of the branch point P4 (the fifth point as counted from the target point counterclockwise) may be deleted from the stitch path storage area 1207. Instead, the information of the branch point P3 (for example, the first point as counted from the target point counterclockwise), P10 (for example, the second point as counted from the target point counterclockwise), and P11 (for example, the third point as counted from the target point counterclockwise) may be stored in the stitch path storage area 1207 where the information of the branch point P4 may have been previously stored. As a result, the information of the branch points P1, P3, P10, P11, P6, P7, . . . may be stored in the stitch path storage area 1207, for example, in this order.

Figure 34:
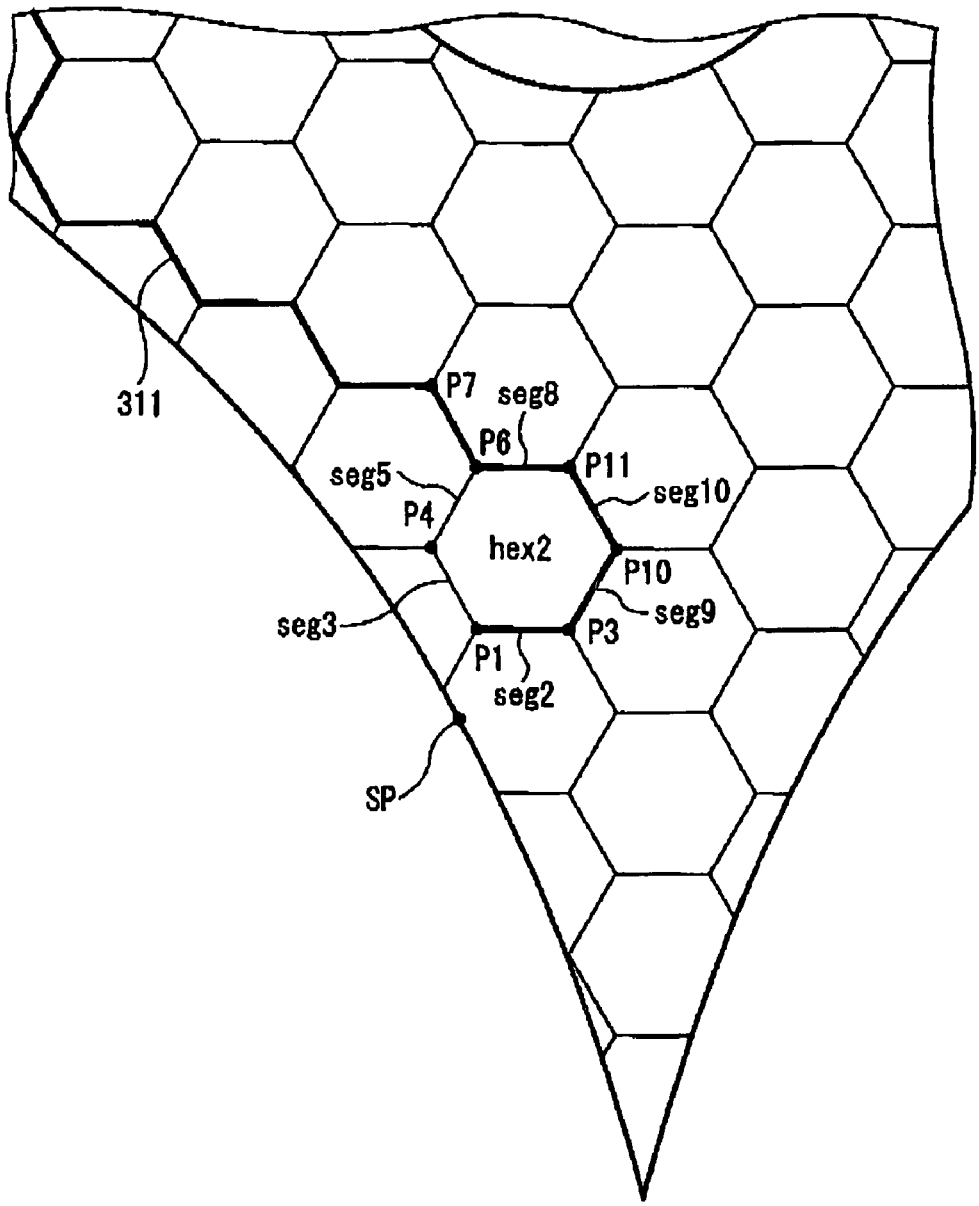
FIG. 34 is an explanatory diagram of a stitch path obtained by moving a part of the initial stitch path of FIG. 33.

Consequently, as shown in FIG. 34, a side line segment seg2 connecting the target point P1 and the first vertex P3, a side line segment seg9 connecting the first vertex P3 and the second vertex P10, a side line segment seg10 connecting the second vertex P10 and the third vertex P11, and a side line segment seg8 connecting the third vertex P11 and the fourth vertex P6 may be included on the stitch path 311 after the movement. In this case, the fourth vertex P6 may be determined as the next target point.

Next, the movement pattern B will be described below. In this example, with one branch point as a target point, branch points may be traced counterclockwise. The branch points may be the respective vertexes of a regular hexagon having the target point. Then, it may be determined whether these branch points have their coordinates stored in the stitch path storage area 1207 and are already on the stitch path. If none of the first, second, third, and fourth vertexes, as counted from the target point counterclockwise, are on the stitch path, but the fifth vertex is on the stitch path, this state may be determined as corresponding to the movement pattern B. In other words, the stitch path in the target regular hexagon may be referred to as a state where only one side line segment connecting the target point and the fifth vertex.

If the movement pattern B applies, only one side line segment connecting the target point and the fifth vertex may be on the stitch path. Because the regular hexagon may be formed by six side line segments, none of the remaining five side line segments need to be determined as the stitch path. Because the total length of five side line segments may be longer than the length of the one side line segment, the CPU 11 may move the stitch path to the five side line segments. That is, the CPU 11 may change the stitch path to the side line segments connecting the target point and the first vertex, the first and the second vertexes, the second and the third vertexes, the third and the fourth vertexes, and the fourth and the fifth vertexes when counted counterclockwise.

Figure 35:
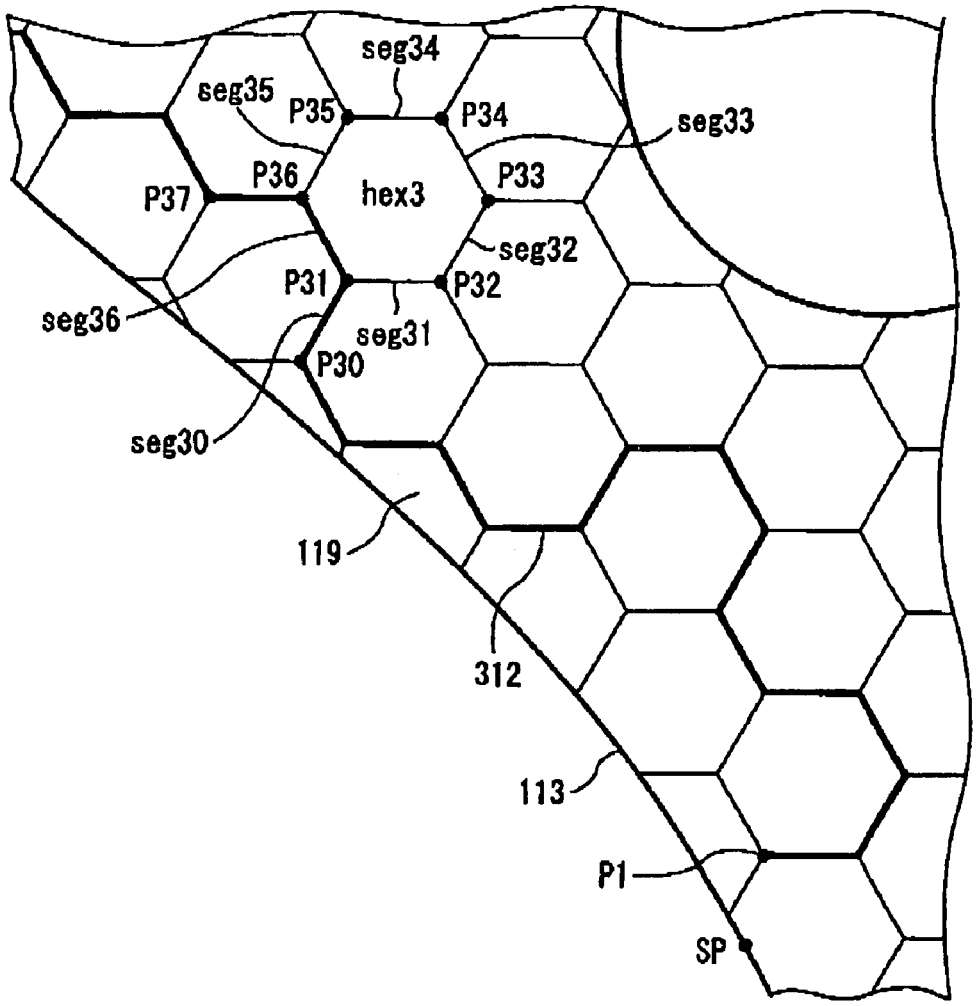
FIG. 35 is an explanatory diagram showing a case to which movement pattern B applies.

In the example shown in FIG. 35, a branch point P31 may be a target point and focus may be made on a regular hexagon hex3 having the respective vertexes of branch points P31, P32, P33, P34, P35, and P36 as a target hexagon. Therefore, branch points P32, P33, P34, P35, and P36 may be traced in this order in the regular hexagon hex3. In the regular hexagon hex3, only the side line segment seg36, which connects vertexes P31 and P36, may be placed along the stitch path 312. For example, the information of the branch points P30, P31, P36, P37 . . . may be stored in this order in the stitch path storage area 1207 as the points on the stitch path 312. That is, none of the first, second, third and fourth vertexes (P32, P33, P34, and P35) as counted from the target point P31 counterclockwise may be located on the stitch path, but the fifth vertex (P36) may be a point on the stitch path 312. Therefore, this state may be determined as corresponding to the movement pattern B.

Accordingly, in the stitch path storage area 1207, the information of the branch points P32, P33, P34, and P35 may be stored between the branch point P31 (target point) and the P36 (the fifth point as counted counterclockwise from the target point), so that the information of the branch points P30, P31, P32, P33, P34, P35, P36, P37, . . . may be stored in this order.

Figure 36:
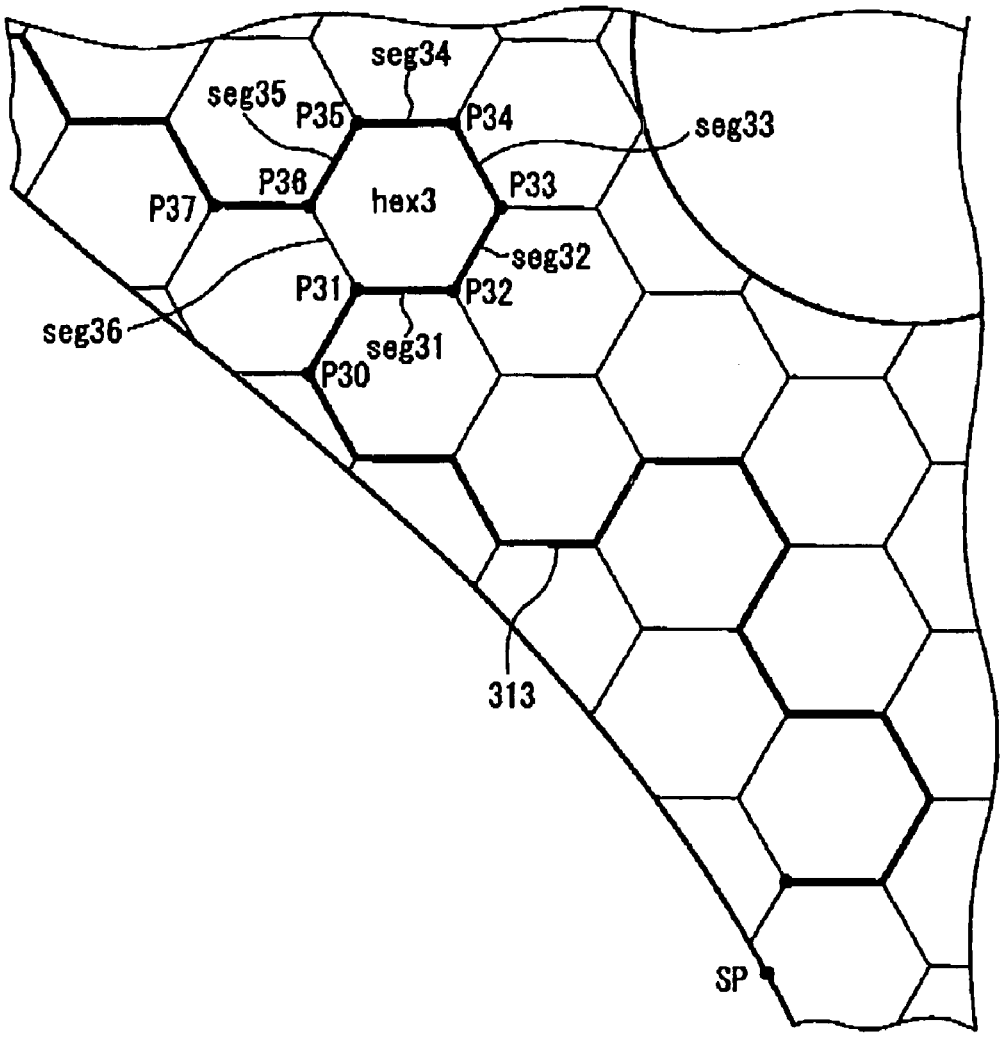
FIG. 36 is an explanatory diagram of a stitch path obtained by moving a part of the initial stitch path of FIG. 34.

As a result, as shown in FIG. 36, a side line segment seg31 connecting the target point P31 and the first vertex P32, a side line segment seg32 connecting the first vertex P32 and the second vertex P33, a side line segment seg33 connecting the second vertex P33 and the third vertex P34, a side line segment seg34 connecting the third vertex P34 and the fourth vertex P35, and a side line segment seg35 connecting the fourth vertex P35 and the fifth vertex P36 may be included on the stitch path 313 after the movement. In this case, the fifth vertex P36 may be determined as the next target point.

The following will describe an example of a method for determining which one of three peripheral regular hexagons of a target point should preferably be focused on as a target regular hexagon. As shown in FIG. 35, if the target point is the stitch path starting point P1, it may be determined whether each of the three peripheral side line segments is intersected by the profile line 113 of the sewing area 119. The starting point SP may be set onto the profile line 113 of the sewing area 119 and a branch point closest to the starting point SP may be determined as the stitch path starting point P1. Preferably, at least one of the side line segments is intersected by the profile line 113. In a case where only one of the peripheral side line segments is intersected, the regular hexagon that has the remaining two peripheral side line segments, which are not intersected by the profile line 113, may be determined as the target regular hexagon. If two of the peripheral side line segments are intersected, none of the peripheral regular hexagons may be a target regular hexagon. Therefore, it may be difficult to determine whether the state corresponds to the movement pattern A or B. Then, the next point on the stitch path of the stitch path starting point P1 may be determined as the new target point.

If the target point is not the stitch path starting point P1, but another point on the stitch path, two peripheral side line segments may be focused on, excluding one side line segment that may be the stitch path on the side where the movement determination has already been made. A regular hexagon that has these two side line segments on the profile lines may be referred to as the target regular hexagon. In the example shown in FIG. 35, the side line segment serving as the stitch path on the side where movement determination has already been made may be the side line segment seg30 and the two side line segments other than side line segment seg30 may be the side line segments seg31 and seg36. Therefore, the regular hexagon hex3 may be determined as the target regular hexagon.

Figure 38:
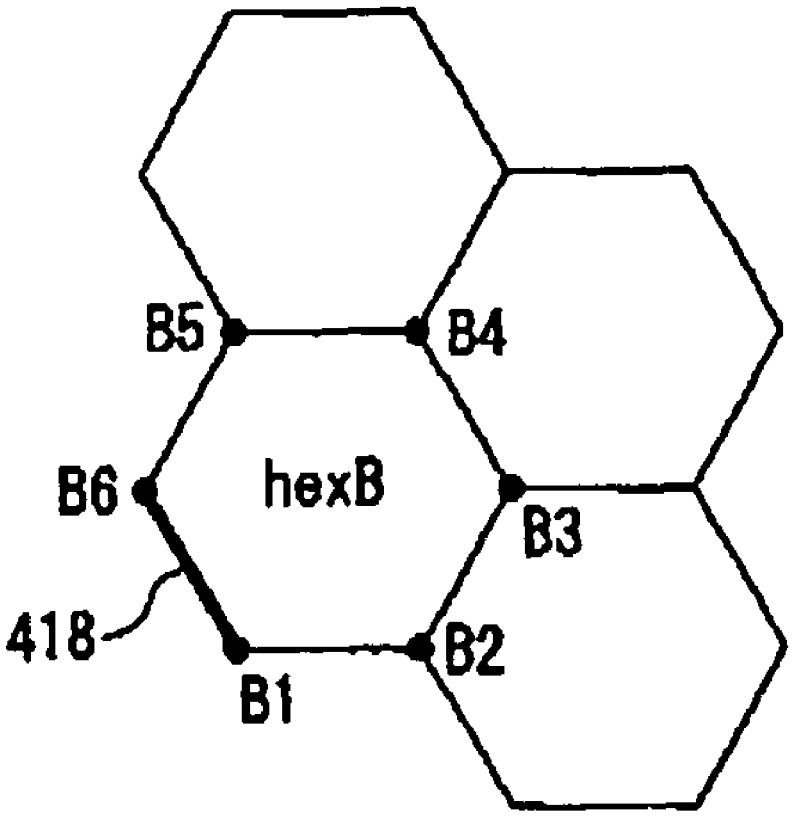
FIG. 38 is an explanatory diagram of a case to which a second case of movement pattern B in mode 1 applies.
Figure 39:
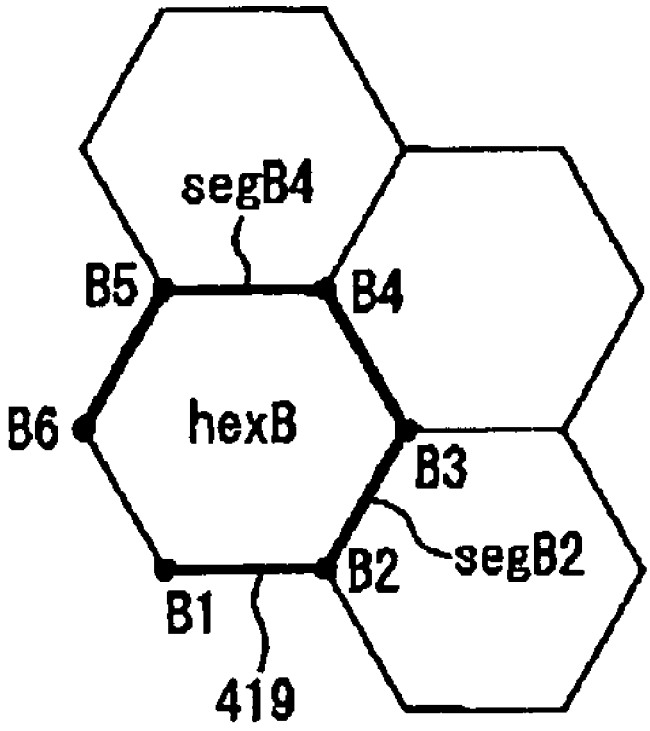
FIG. 39 is an explanatory diagram of a further case to which the second case of movement pattern B in mode 1 applies.

Next, an example of a mode, which defines a probability of actually moving the stitch path when the movement pattern A or B applies, will be described below with reference to FIGS. 37-39. In an exemplary embodiment, three modes of "mode 1", "mode 2", and "mode 3" may be available and may be employed in this order. In the "mode 1", if the movement pattern A applies, one of two cases may be applied based on whether the target point is on the initial stitch path 310. If the target point is on the initial stitch path 310, the probability of actually moving the stitch path may be ¼. On the other hand, if the target point was not on the initial stitch path 310, but is now on the stitch path as a result of movement of this stitch path, the probability of actually moving the stitch path may be 1/12.

Further, if the movement pattern B applies, there may be two cases depending on the type of the target point. The first case may be when the branch point next to the current target point in the clockwise direction is a branch point which satisfies the following conditions. The conditions may be that the branch point has been newly determined as a point on the stitch path when the stitch path was moved as its state corresponded to the movement pattern B, and is a vertex facing a vertex, which may have been the target point in the regular hexagon when the stitch path was moved. For example, as shown in FIG. 37, the current target point may be a branch point B1. Further, the branch point B1 may have been determined as a new point on the stitch path, because in a regular hexagon hexb, the stitch path may have been moved from the stitch path connecting the branch point b1 and a branch point b6 to the stitch path connecting from the branch point b1 to the branch point b2, b3, b4, b5, and b6, for example, in this order when the branch point b1 was the target point. In this example, in a regular hexagon hexB, a branch point B6 next to the current target point B1 in the clockwise direction may be located to face the branch point b1, which may have been the target point when the stitch path was moved in the regular hexagon hexb. This state may correspond to the first case when the movement pattern B applies. When this first case applies, the probability of actually moving the stitch path may be 0.

Consider moving the stitch path when the first case applies. In the example shown in FIG. 37, the stitch path constituted by a side line segment connecting the branch points B1 and B6 may be first moved to the stitch path constituted by five side line segments connecting the branch points B1, B2, B3, B4, B5, and B6, for example, in this order. In this state, if the branch point B3 is taken as the target point and the stitch path is further moved, the stitch path may extend to the upper right direction in FIG. 37. This may decrease the quality of the stitch path. To avoid this situation, at the stage of mode 1, the probability may be set to 0 for the first case so that the stitch path may not be moved.

Figure 37:
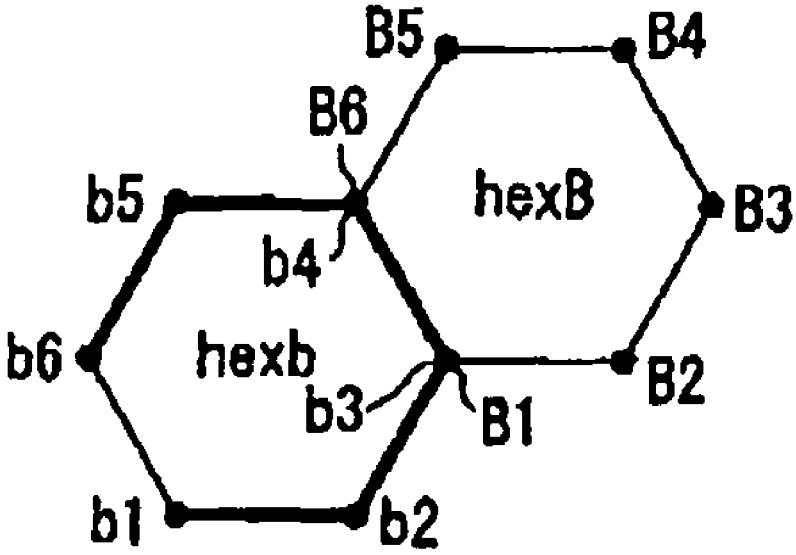
FIG. 37 is an explanatory diagram showing a case to which a first case of a movement pattern B applies.

In the second case, the first case as shown in FIG. 37 may not apply. The second case may be further classified into three cases according to the shape of the stitch path after being moved. For example, the target point B1 as shown in FIG. 38. If only the side line segment connecting the branch points B1 and B6 is a stitch path 418 as shown, when the stitch path 418 is moved as shown in FIG. 39, five side line segments connecting the branch points B1, B2, B3, B4, B5, and B6 may be determined as a stitch path 419. Considering the stitch path 419 thus moved, three cases may be provided based on whether the side line segment segB2 connecting the branch points B2 and B3 may be moved according to the movement pattern B and whether side line segment segB4 connecting the branch points B4 and B5 may be moved according to the movement pattern B.

If the movement pattern B may be applied to both of the side line segments segB2 and segB4, the probability of actually moving the stitch path may be ⅓. Further, if the movement pattern B may be applied to only one of the side line segments segB2 and segB4, the probability of actually moving the stitch path may be 1/15. Even further, if the movement pattern B may be applied to neither of the side line segments segB2 and segB4, the probability of actually moving the stitch path may be 0. The fact that the movement pattern B may be applied to neither of the side line segments segB2 and segB4 means that there may be no possibility of further moving the stitch path after the movement, which may result in a stitch path with a complicated shape. On the other hand, if the movement pattern B may be applied to one of the side line segments segB2 and segB4, this may mean that there may be a possibility of further moving the stitch path after the movement, which may result in a stitch path with a complicated shape. Further, the fact that the movement pattern B may be applied to both of the side line segments segB2 and segB4 means that there may be a higher possibility of further moving the stitch path after the movement, which results in a stitch path with a complicated shape. Therefore, the higher the possibility of further moving the stitch path after the movement and developing into a complicated shape, the higher the probability may become.

Next, the "mode 2" will be described below. In the mode 2, if the movement pattern A applies, the probability of actually moving the stitch path may be set to ¼. On the other hand, if the movement pattern B applies, similar to the mode 1, there may be two cases, which may be classified based on the type of the target point. In the first case, if a branch point next to the current target point in the clockwise direction is a branch point that has been newly determined as the point on the stitch path when the stitch path was moved as its state corresponded to the movement pattern B and that was a vertex facing the target point in the regular hexagon when the stitch path was moved, the probability of actually moving the stitch path may be set to 0. If the target point does not correspond to the first case, and the second case applies, the probability may be set to 1.

Next, the "mode 3" will be described below. In the mode 3, for example, in both cases where the movement pattern A and the movement pattern B apply, the probability of actually moving the stitch path may be set to 1. That is, if the state corresponds to one of the two movement patterns, the stitch path should be moved.

In such a manner, the probability of actually moving the stitch path may increase in the order of modes 1, 2, and 3. In mode 3, if any one of the movement patterns applies, the stitch path may be moved. Therefore, if the processing is performed repeatedly on the branch points on the stitch path in mode 3, there may be no branch point whose state corresponds to the movement pattern A or B in the end.

Figure 6:
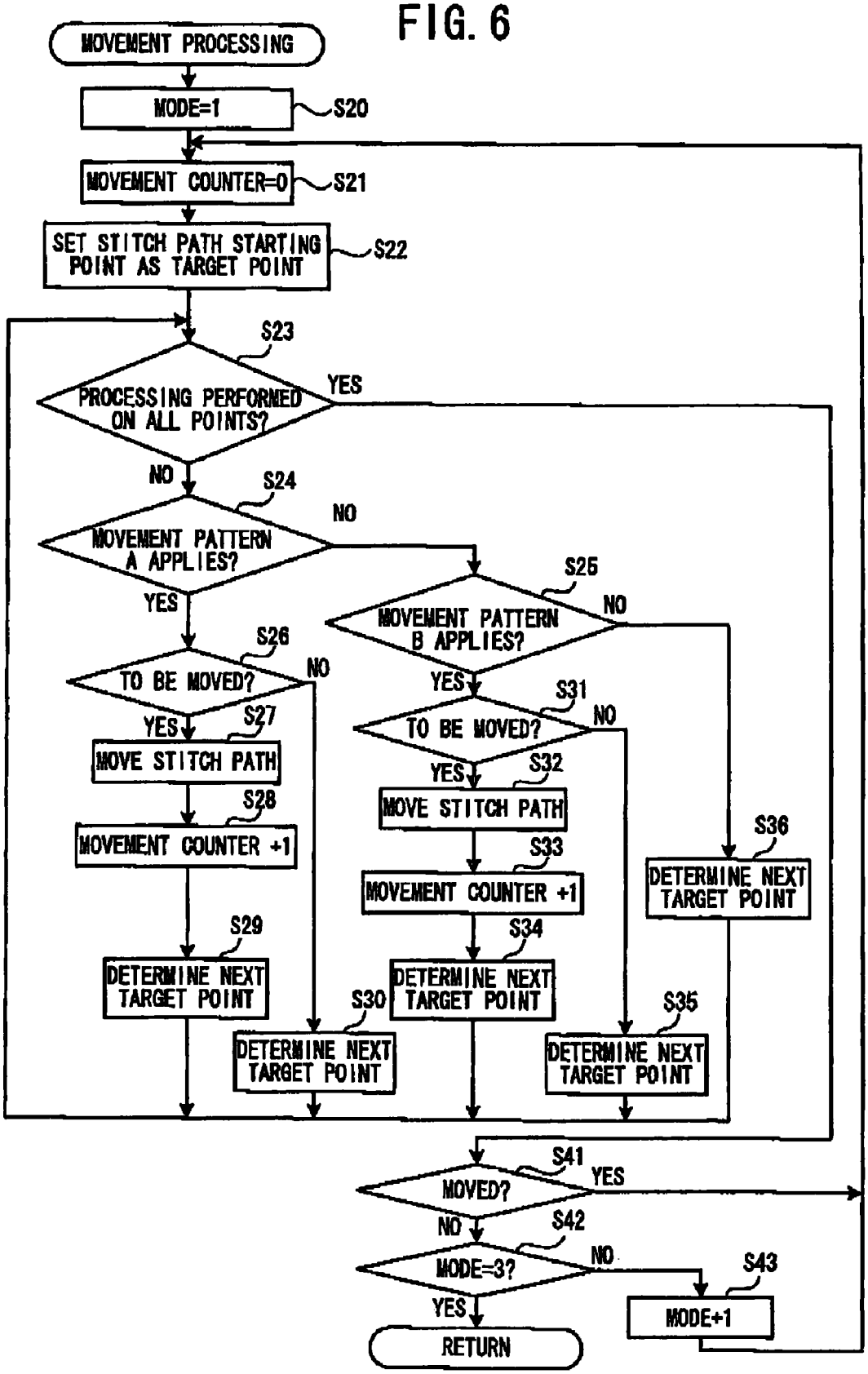
FIG. 6 is a flowchart of movement processing which is performed in the main processing.

The following will describe in detail the movement processing with reference to the flowchart of FIG. 6. First, a value that indicates the "mode 1" (for example, 1) may be stored in the mode storage area 1211 (S20). Next, an initial value of 0 may be stored in a movement counter for counting the number of times the stitch path is actually moved (S21). Next, a value indicating the stitch path starting point P1 may be stored as a target point in the target point storage area 1212 (S22). For example, the coordinates of the branch points that form the stitch path may be stored in the stitch path storage area 1207 in the order of forming the stitch path. Accordingly, the sequence number of the stitch path staring point P1 may be stored in the stitch path storage area 1207. For example, P1 may be stored in the target point storage area 1212.

Then, it may be determined whether the processing has been performed on all of the branch points (S23). For example, it may be determined whether the target point is the stitch path ending point P99. For example, if the value stored in the target point storage area 1212 is equal to the number of the coordinates of the branch points stored in the stitch path storage area 1207, it may be determined that the target point is the stitch path ending point P99.

If the processing has not yet been performed on all of the branch points (NO in S23), it may be first determined whether the movement pattern A applies (S24). The determination may be made based on whether the above-described movement pattern A applies. For example, the determination may be based on whether the first, second, and third vertexes of a target regular hexagon as counted from the target point counterclockwise are not on the stitch path, but the fourth vertex is on the stitch path.

If it is determined that the movement pattern A applies (YES in S24), a determination may be made based on the probability of actually moving the stitch path (S26). For example, the probability defined for the mode may be used, as described above. Because the current mode is the "mode 1", the probability may be ¼, if the target point is on the initial stitch path. On the other hand, if the target point is not on the initial stitch path, that is, if the target point is on the stitch path after the movement, the probability may be 1/12.

The determination of the probability may be based on random numbers. To obtain the random numbers, a known random number generation program may be used. If a predetermined value is given to the random number generation program as an argument, the predetermined number may be passed as the random number. In an exemplary embodiment, the random number may be obtained by giving the sequence number of the target point as the argument to the random number generation program. In determination of whether to actually move the stitch path, values for determining to "move" based on a defined probability may be set beforehand. Then, it may be determined whether to move the stitch path according to whether the obtained random number is one of the defined values or not. The number of random numbers generated by the random number generation program may be defined by the random number generation program. For example, if the probability is ¼, ¼ of the random numbers generated by the random number generation program may be defined as values based on which determination is made to "move". Those values may be stored in the miscellaneous information storage area 123 in the hard disk drive 120.

If the starting point SP and ending point EP are at the same position in the same sewing area 119, the initial stitch path 310 may also be the same. Therefore, the branch points to be the target points in the movement processing and arguments given to the random number generation program may also be the same. Accordingly, if the starting point SP and ending point EP are at the same position for the same sewing area 119, the initial stitch path 310 may be moved based on the same target points, resulting in the same stitch path 410. If the starting point SP and the ending point EP are not at the same position, the stitch path 410 may extend from the stitch path starting point P1 to the stitch path ending point P99.

If it is determined to "move" the stitch path (YES in S26), the stitch path may be moved according to the movement pattern A (S27) as described above with reference to FIGS. 33 and 34, and the movement counter may be incremented by 1 (S28). Then, the fourth vertex as counted from the current target point counterclockwise may be set as the next target point and may be stored in the target point storage area 1212 (S29). In the example shown in FIG. 34, the fourth branch point P6 on the stitch path may be set as the next target point. Then, the process may return to S23.

On the other hand, if it is not determined to "move" the stitch path (NO in S26), a branch point following the current target point on the stitch path may be set as the next target point (S30) and the process returns to S23. More specifically, the value in the target point storage area 1212 may be incremented by 1.

If the movement pattern A does not apply (NO in S24), it may be determined whether the movement pattern B applies (S25). This determination may be made on whether the current state corresponds to the above-described movement pattern B, that is, whether the first, second, third, and fourth vertexes of a target regular hexagon, when traced counterclockwise, are not on the stitch path, but the fifth vertex is on the stitch path.

If it is determined that the state corresponds to the movement pattern B (YES in S25), it may then be determined whether the stitch path is to be actually moved based on a probability of moving the stitch path (S31). For example, the predetermined probability for the current mode as described above may be used. Because the current mode is the "mode 1" in the above-described first case (when the branch point next to the current target point in the clockwise direction has been newly determined as a point on the stitch path when the stitch path was moved as the movement pattern B was applied, and is a vertex facing another vertex, which was the target point in the regular hexagon when the stitch path was moved) the probability of actually moving the stitch path may be 0. Therefore, if the current state corresponds to the first case, it may not be determined to move the stitch path (NO in S31).

On the other hand, if the current state does not correspond to the first case, but corresponds to the second case, as described above with reference to FIGS. 38 and 39, the probability may be determined according to the shape of the stitch path after being moved. If, as shown in FIG. 39, the movement pattern B may be applied to both of the side line segments segB2 and segB4 on the stitch path after the movement, the probability of actually moving the stitch path may be ⅓. Further, if the movement pattern B may be applied to only one of the side line segments segB2 and segB4, the probability of actually moving the stitch path may be 1/15. Even further, if the movement pattern B may be applied to neither of side line segments segB2 and segB4, the probability of actually moving the stitch path may be 0.

Similar to the case of the movement pattern A, the random numbers generated by the random number generation program may be employed to determine whether the stitch path is to be moved.

If it is determined to "move" the stitch path (YES in S31), the stitch path may be moved according to the movement pattern B (S32), and the movement counter may be incremented by 1 (S33) as described above with reference to FIGS. 35 and 36. Then, the fifth vertex as counted from the current target point counterclockwise may be set as the next target point and may be stored in the target point storage area 1212 (S34). In the example shown in FIG. 36, the fifth branch point P36 on the stitch path may be set as the next target point. Then, the process may return to S23.

On the other hand, if it is determined to "move" the stitch path (NO in S31), the next branch point of the branch point currently being the target point on the stitch path may be set as the next target point (S35), and the process returns to S23. For example, the value in the target point storage area 1212 may be incremented by 1.

Further, if the current state does not correspond to the movement pattern B either (NO in S25), the next branch point of the branch point currently being the target point on the stitch path may be set as the next target point (S36), and the process returns to S23. For example, the value in the target point storage area 1212 may be incremented by 1.

Then, the processing of S23-S36 may be repeated and, if it is determined that the movement pattern A or B may be applied and that the stitch path is actually to be moved, the processing of moving the stitch path may be performed. If the target point becomes the stitch path ending point P99 and all of the branch points have been through the processing, the process may advance to S41.

In S41, it may be determined whether the stitch path has been moved. The determination may be made by checking whether the value of the movement counter is at least 1. If the stitch path has been moved (YES in S41), there still exists a possibility that the stitch path may be further moved in the "mode 1", so that the process may return to S21 to initialize the movement counter to 0 (S21) and the stitch path starting point P1 may be set as the target point (S22). Then, the processing of S23-S36 may be repeated and, if it is determined that the movement pattern A or B may be applied and the stitch path is to be moved, the processing of moving the stitch path may be performed. If the target point becomes the stitch path ending point P99 and all of the branch points have been through the processing, the process may advance to S41.

Then, the processing of S21-S41 is repeated. If the stitch path may not be moved any more in the "mode 1" (NO in S41), it may be determined whether the process is in the "mode 3" (S42). Because it may still be in the "mode 1", not in the "mode 3" (NO in S42), 1 may be added to the value stored in the mode storage area 1211 to proceed to the "mode 2" (S43). Then, the process may return to S21.

Then, the processing of S21-S36 may be repeated in the "mode 2". This time, in S26 and S31, the predetermined probability for the "mode 2" may be employed to determine whether to move the stitch path. For example, if the movement pattern A applies (YES in S24), it may be determined to move the stitch path at a probability of ¼. If the movement pattern B applies (NO in S25) and the state corresponds to the first case, the probability of moving the stitch path may be 0 and so it may not be necessary to move the stitch path (NO in S31). On the other hand, if the state does not correspond to the first case, the probability may be 1 and it may be determined that the stitch path should be moved (YES in S31).

In the "mode 2", the processing of S21-S36 may be repeated. If it is also determined that the movement pattern A or B may be applied and the stitch path may be moved, the processing of moving the stitch path may be performed. If the target point becomes the stitch path ending point P99 and all of the branch points have been through the processing, the process may advance to S41.

In S41, it may be determined whether the stitch path has been moved (S41). The determination may be made by checking whether the value of the movement counter is at least 1. If the stitch path has been moved (YES in S41), there still exists a possibility that the stitch path may be further moved in the "mode 2", so that the process returns to S21 to initialize the movement counter to 0 (S21), and the stitch path starting point P1 may be set as the target point (S22). Then, the processing of S23-S36 may be repeated. If it is also determined that the movement pattern A or B may be applied and the stitch path is to be moved, the processing of moving the stitch path may be performed. If the target point becomes the stitch path ending point P99 and the branch points have been through the processing, the process may advance to S41.

Thus, the processing of S21-S41 may be repeated. If the stitch path may also not be moved any more in the "mode 2" (NO in S41), it may be determined whether the process is in the "mode 3" (S42). At this time, because it is in the "mode 2", not in the "mode 3" (NO in S42), 1 may be added to the value stored in the mode storage area 1211 and may proceed to the "mode 3" (S43). Then, the process may return to S21.

Then, the processing of S21-S36 may be performed in the "mode 3". Here, in S26 and S31, the predetermined probability for the "mode 3" may be employed to determine whether to actually move the stitch path. For example, in both cases where the movement patterns A or B apply, the probability may be 1. In other words, when the movement pattern A applies (YES in S24) or when the movement pattern B applies (YES in S25), it may be determined that the stitch path is to be moved (YES in S26, YES in S31).

In the "mode 3", the processing of S21-S36 may be repeated. If it is also determined that the movement pattern A or B may be applied and the stitch path is to be moved, the processing of moving the stitch path may be performed. If the target point becomes the stitch path ending point P99 and the branch points have been through the processing, the process may advance to S41.

In S41, it may be determined whether the stitch path has been moved (S41). The determination may be made by checking whether the value of the movement counter is at least 1. If the stitch path has been moved (YES in S41), there still exists a possibility that the stitch path may be further moved in the "mode 3", so that the process may return to S21 to initialize the movement counter to 0 (S21), and the stitch path starting point P1 may be set as the target point (S22). Then, the processing of S23-S36 may be repeated. If it is also determined that the movement pattern A or B may be applied and the stitch path is to be moved, the processing of moving the stitch path may be performed. If the target point becomes the stitch path ending point P99 to indicate that all of the branch points have been through the processing, the process may advance to S41.

Then, the processing of S21-S41 may be repeated. If the stitch path also may not be moved any more in the "mode 3" (NO in S41), it may be determined whether the process is in the "mode 3" (S42). For example, if the process is in the "mode 3" (YES in S42), the movement processing may be terminated, and the process may return to the main processing.

By thus performing the movement processing, the stitch path of the initial stitch path 310 (see FIG. 14) may be moved to create the stitch path 410 (see FIG. 15). For example, if the target regular hexagon has a smaller number of the side line segments determined as the stitch path than the number of the other side line segments which have not yet been determined as the stitch path, the stitch path may be moved. However, if the stitch path is always moved when the movement pattern A or B may be applied, the stitch path may always be moved first at the branch point on the side closer to the stitch path starting point P1. As a result, the stitch path may spread out (is moved) more on the side closer to the stitch path starting point P1 than on the side closer to the stitch path ending point P99. It possibly results in such embroidery data as to form stitches of an unbalanced and unattractive shape. To avoid this situation, rather than always moving the stitch path, the stitch path may be moved in some cases and not moved in other cases, according to the determination result on whether to move the stitch path based on a probability defined for each of the modes. This may prevent the stitch path from spreading out more on the side closer to the stitch path starting point P1, and may thereby enable the obtainment of sewing data that will form stitches of a well-balanced and beautiful shape.

Figure 40:
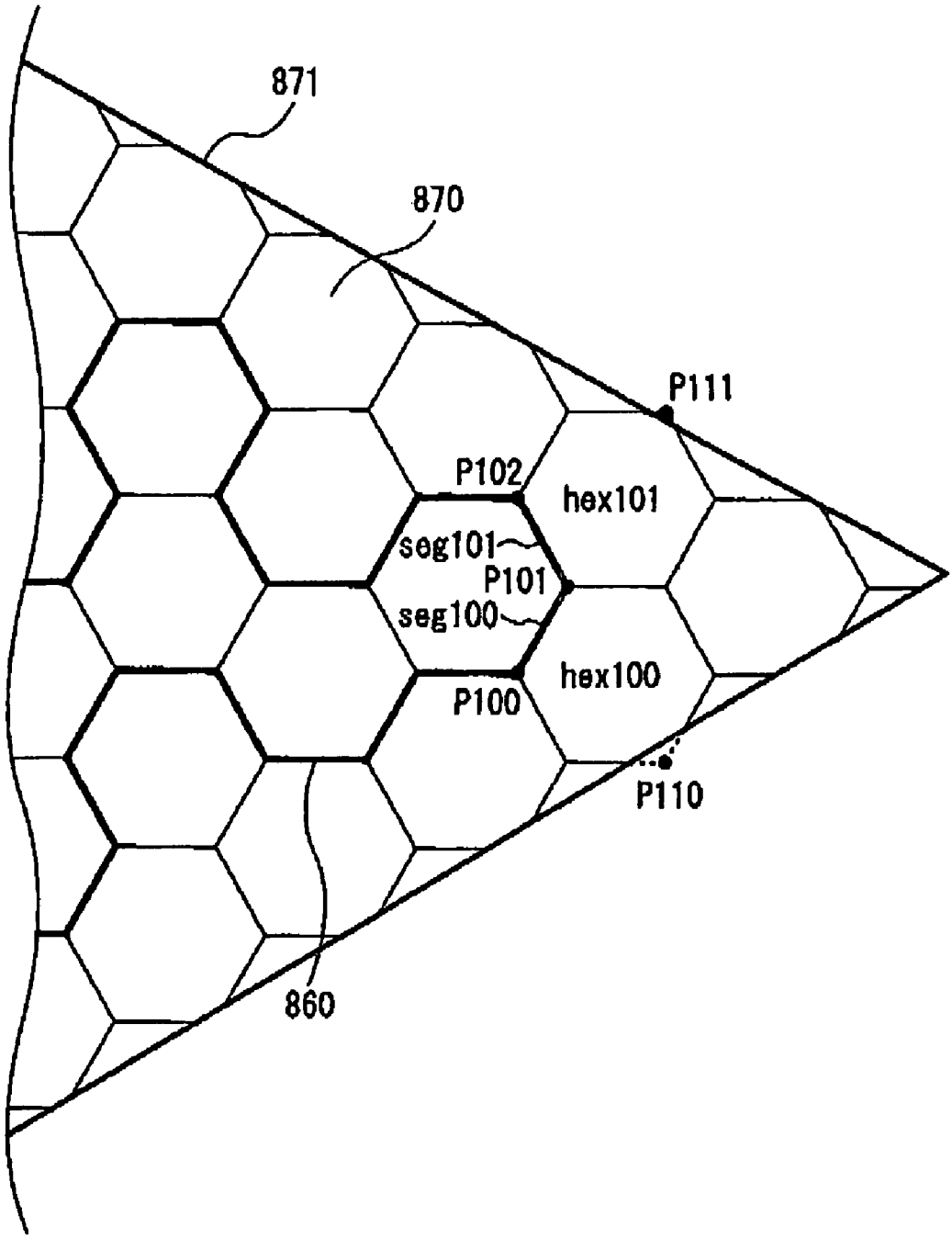
FIG. 40 is an explanatory diagram of a stitch path which undergoes special processing after the stitch path is created.

Next, an example of the special processing (S11 of FIG. 5) will be described below with reference to FIGS. 40-42. The special processing may be performed after the stitch path 410 is created. Here, for example, focus is on branch points P100 and P101 shown in FIG. 40. In the above-described movement processing (see S10 of FIG. 5 and FIG. 6), in a case where the branch point P100 is a target point, a second vertex P110 counted as counterclockwise from the target point in a target regular hexagon hex100 may exist outside a sewing area 870. Therefore, the movement pattern A or B need not be applied, so that a side line segment seg100 connecting the branch points P100 and P101 that constitutes a part of a stitch path 860 may not be moved. Similarly, in a case where focus is on this branch point P101 also as a target point, a counterclockwise third vertex P111 of a target regular hexagon hex101 may exist outside the sewing area 870. Therefore, side line segment seg101 connecting the branch points P101 and P102 that constitutes a part of the stitch path 860 may not be moved.

Figure 41:
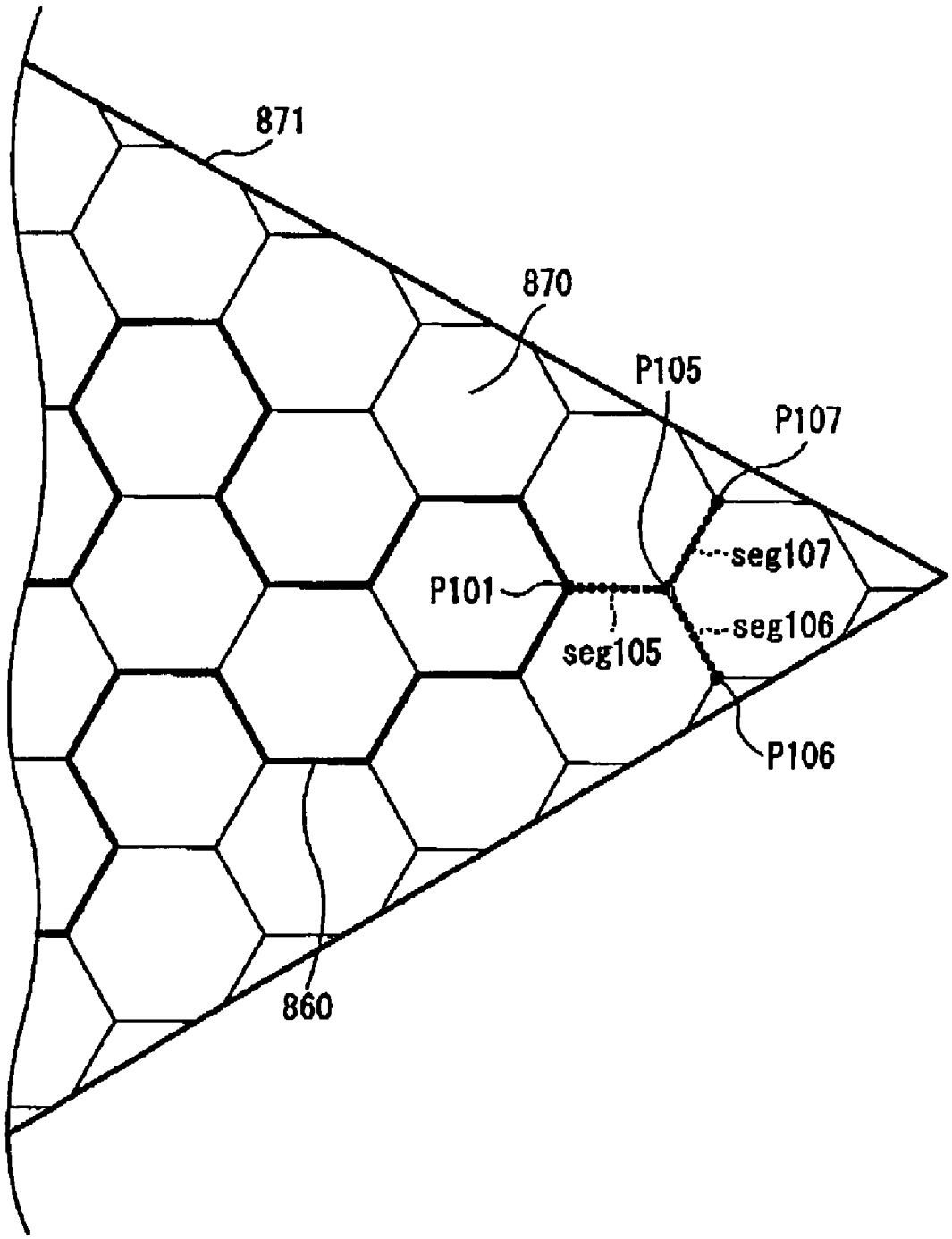
FIG. 41 is an explanatory diagram of the stitch path which undergoes special processing.

As shown in FIG. 41, among three peripheral side line segments of the branch point P101, the side line segment seg105 may not constitute a part of the stitch path 860. When focusing on the side line segment seg105, it may not be intersected by a profile line 871 of the sewing area 870. Moreover, neither of side line segments seg106 and seg107 that branch from the branch point P105, which is one endpoint of the side line segment seg105 having the branch point P101 as the other endpoint, should be intersected by the profile line 871. That is, the regular hexagon itself may not expand any more but the side line segments may expand further alone.

Figure 42:
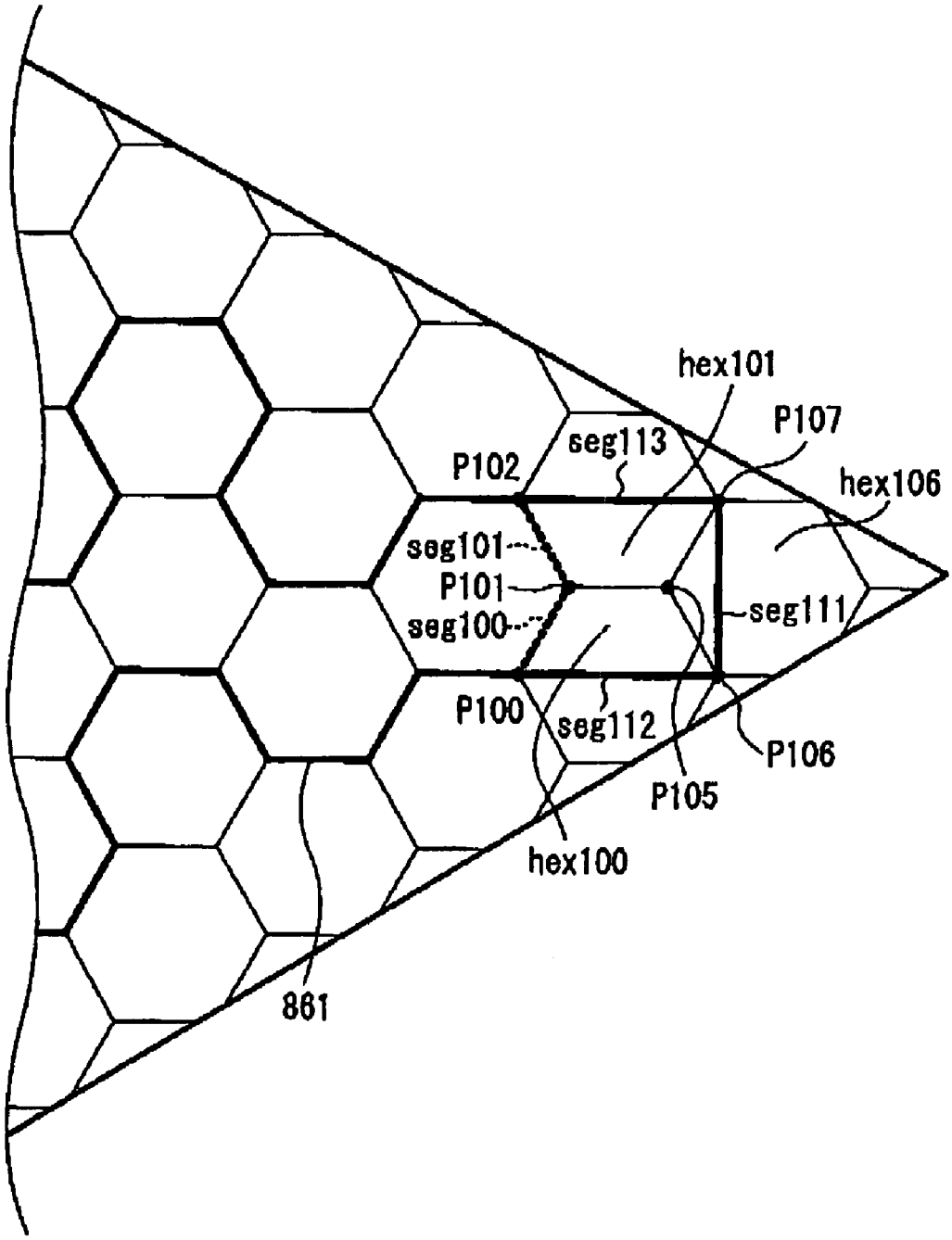
FIG. 42 is an explanatory diagram of a stitch path obtained after the special processing on the stitch path.

Considering this, as shown in FIG. 42, the branch point P100 and a branch point P106 may be connected to each other, thereby forming a new line segment seg112. The branch point P100 may be one endpoint of the side line segment seg100 having the branch point P101 as the other endpoint. The branch point P106 may be a vertex facing the branch point P100 in the regular hexagon hex100 having the side line segment seg100 as its profile line. Then, a branch point P102 and a branch point P107 may be connected to each other, thereby forming a new line segment seg113. The branch point P102 may be one endpoint of the side line segment seg101 having the branch point P101 as the other endpoint. The branch point P107 may be a vertex facing the branch point P102 in the regular hexagon hex101 having the side line segment seg101 as its profile line. Then, by connecting the branch points P106 and P107 to each other, new line segment seg111 may be created. Next, the side line segments seg100 and seg101 may be excluded from the stitch path and the newly created line segments seg112, seg111, and seg113 are determined as the stitch path. Therefore, a new stitch path 861 may be obtained.

For example, from the information of the branch points P100, P101, and P102 previously stored in this order in the stitch path storage area 1207, the information of the branch point P101 may be deleted. Instead, the information of the branch points P106 and P107 may be inserted. Consequently, the information of the branch points P100, P106, P107, and P102 may be stored in this order in the stitch path storage area 1207.

Figure 43:
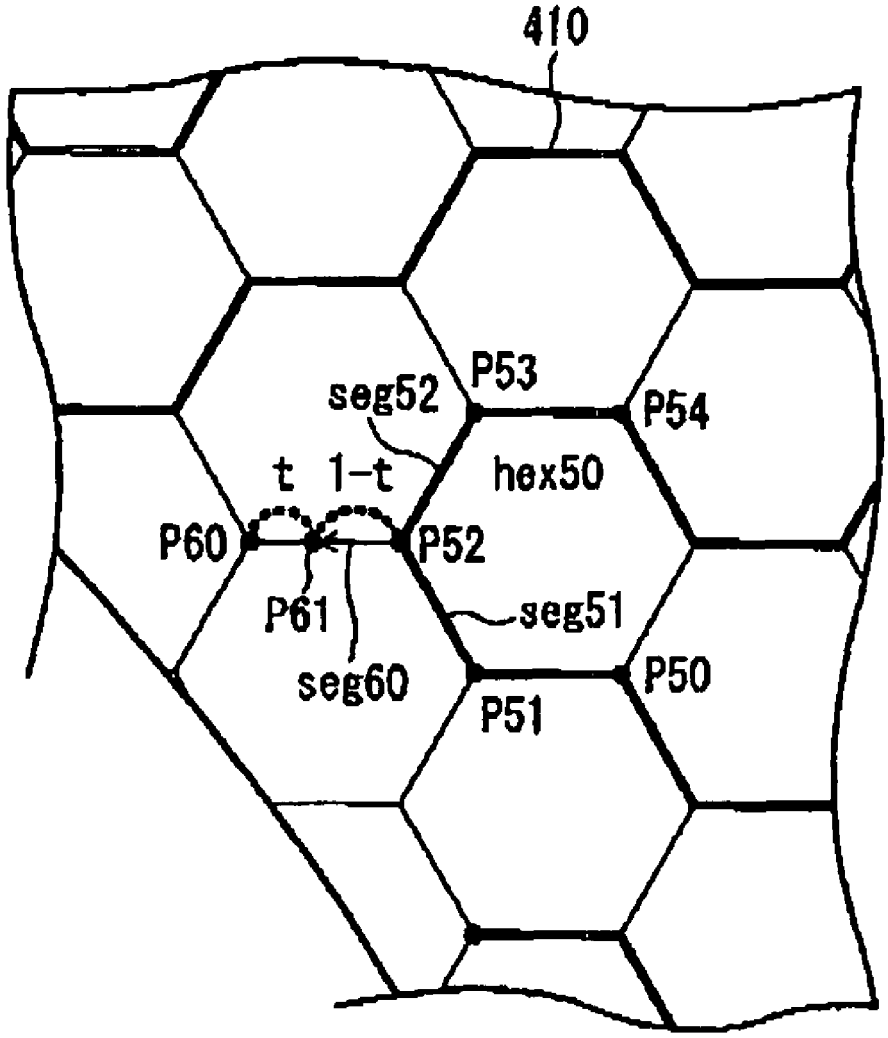
FIG. 43 is an explanatory diagram showing a point to which a branch point on a stitch path is moved at the first stage.
Figure 44:
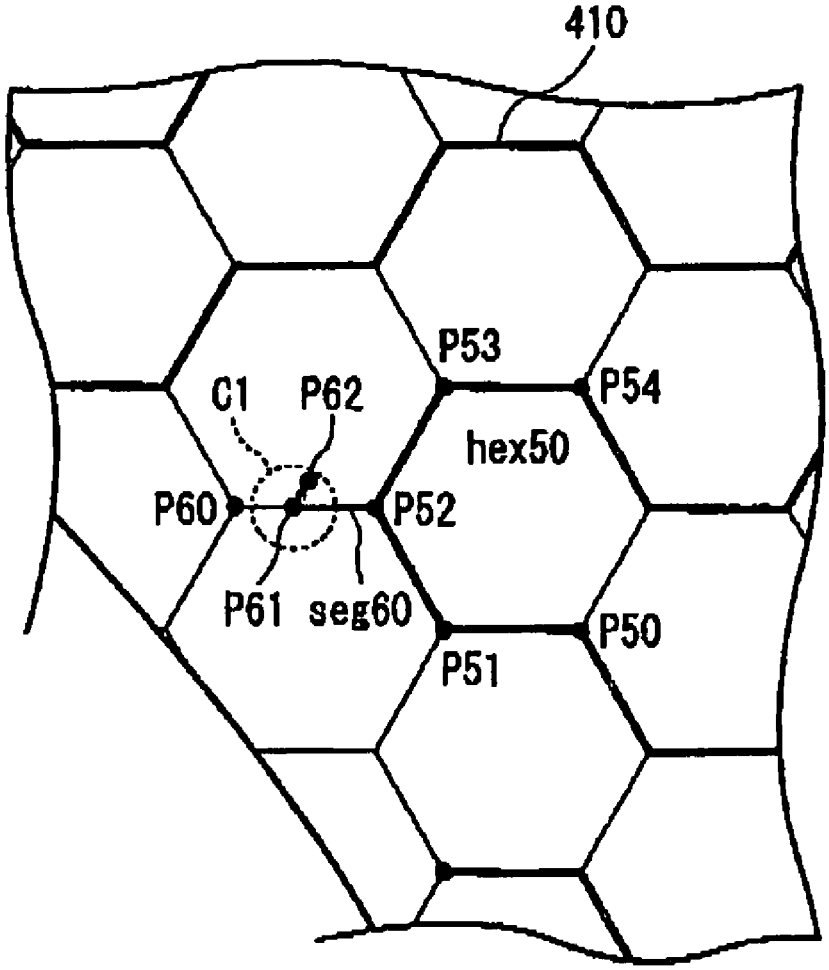
FIG. 44 is an explanatory diagram showing a point to which the branch point on the stitch path is moved at the second stage.
Figure 45:
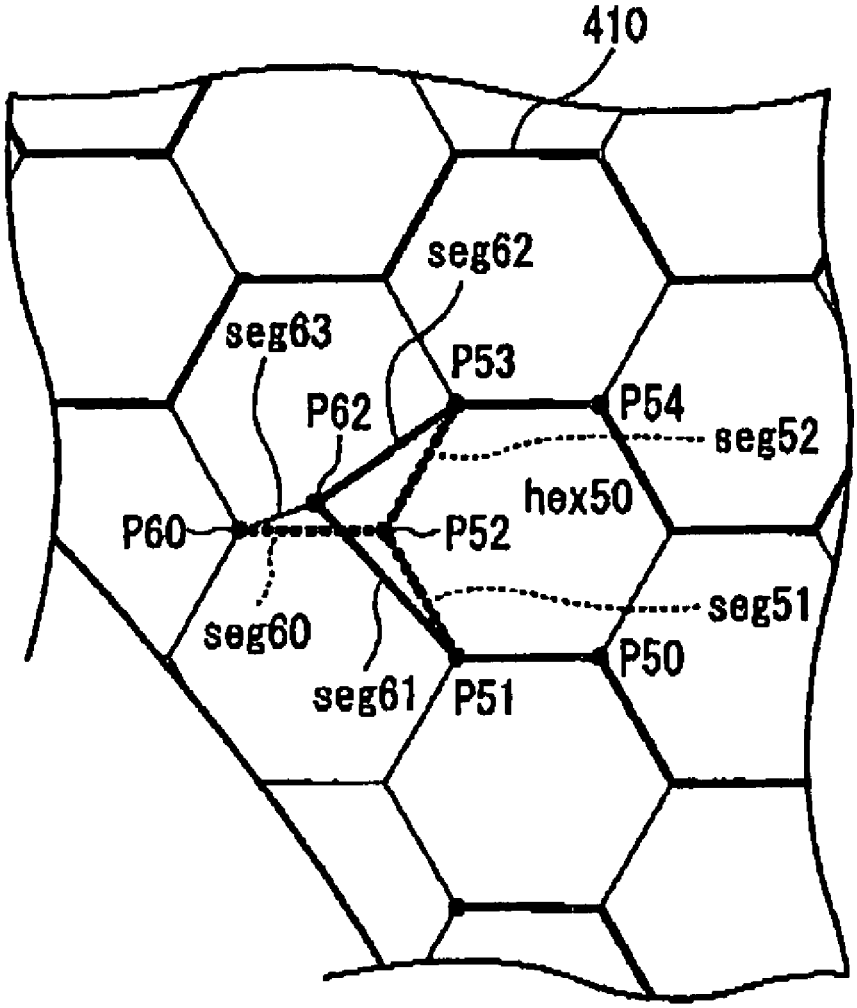
FIG. 45 is an explanatory diagram of a stitch path obtained after moving coordinates of a branch point to coordinates of another point.

Next, by way of example, the processing of creating the transformed stitch path 510 (S12 of FIG. 5) will be described in detail below with reference to FIGS. 43-45. The transformed stitch path 510 may be created by transforming the stitch path 410, evenly arranged in the sewing area 119, by moving its branch points. In the present exemplary embodiment, a first movement and a second movement may be performed on all of the branch points on the stitch path 410. First, an example of the first movement will be described below using a branch point P52 shown in FIG. 43. Out of three peripheral side line segments of a branch point P52, focus will be paid on a side line segment seg60 which may not be a stitch path. A point P61 that internally divides the side line segment seg60 at a ratio of t:(1−t) may be a movement destination of the branch point P52 by the first movement. In other words, for example, (connecting the branch points P60 and P61): (line segment connecting the branch points P61 and P52)=t:(1−t). The value of t may be, for example, a value that indicates a sequence of the branch point P52 along the stitch path given to a known random number generation program as an argument, or a numeral generated by the program. The random number generation program may be the same with or different from the program used in the movement processing. In this step, coordinates of the branch point P52 in the stitch path storage area 1207 may be changed into those of the point P61.

Subsequently, the second movement may be performed. As shown in FIG. 44, in the second movement, P61 which may be obtained by the first movement, is moved to an arbitrary point P62 in a circle C1 having the point P61 as its center and r as its radius. The radius r may be set based on a reference distance stored in the reference distance storage area 1201. In the present exemplary embodiment, radius may be determined by radius r=(referenced distance)/5.0. The arbitrary point P62 in circle C1 may be determined by, for example, the following method. First, two values of numerals A and B may be generated by the random number generation program. These values may have their respective possible ranges of 0≦(numeral A)≦(radius r of circle C1) and 0≦(numeral B)≦360. With these values, the x-coordinate of the arbitrary point P62 may be set as (x-coordinate of center point P61)+(numeral A)×cos(numeral B) and the y-coordinate may be set as (x-coordinate of center point P61)+(numeral A)×sin(numeral B). Then, the coordinates of the branch point P61 in the stitch path storage area 1207 may be changed into those of P62.

The first movement and the second movement may be performed in such a manner as to change the coordinates of the branch point P52 into those of P62. Consequently, as shown in FIG. 45, a side line segment seg51 connecting the branch points P51 and P52 may be changed into a side line segment seg61, and a side line segment seg52 connecting the branch points P52 and P53 may be changed into a side line segment seg62. As a result, a regular hexagon hex50 may be changed into a hexagon with a smaller angle than 120 degrees formed by the side line segments seg61 and seg62.

The above-described first movement and second movement may be performed on all of the branch points on the stitch path 410 evenly arranged in the sewing area 119 by the movement processing (S10 of FIG. 5) and the special processing (S11 of FIG. 5), thereby creating the transformed stitch path 510 (see FIG. 16).

Figure 7:
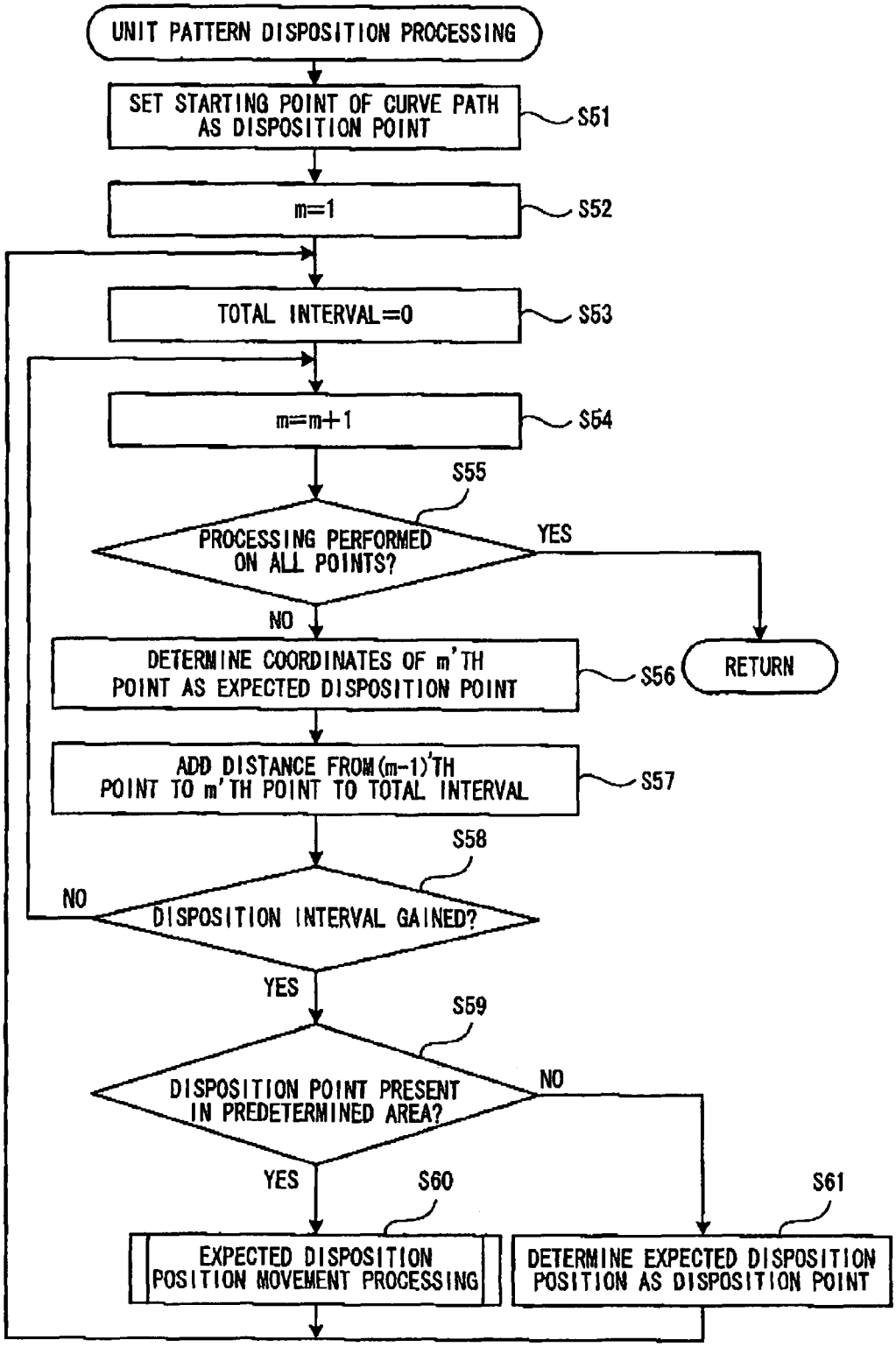
FIG. 7 is a flowchart of pattern disposition processing which is performed in the main processing.

Next, by way of example, unit pattern disposition processing will be described below with reference to the flowcharts of FIGS. 7 and 8 and FIGS. 46-50. Hereinafter, a point, which has been set as a disposition position to which a unit pattern is disposed, is referred to as a "disposition point". In addition, a point, which is a possible disposition position to be examined, is referred to as an "expected disposition point". As shown in the flowchart of FIG. 7, first, from a sequence of points that constitute a curve path and are stored in the curve storage area 1208, the first point may be set as a disposition point of a unit pattern (S51). That is, starting point P1 of the curve path may be set as the disposition point and its coordinates may be stored in the pattern information storage area 1215. Then, an initial value of "1" may be set as a variable m and stored for counting the sequence of points which form the curve path (S52). An area for storing the variable m may be provided in the RAM 12.

Subsequently, an initial value of "0" may be stored in the total interval storage area 1217 in the RAM 12 (S53). Then, "1" may be added to the variable m to provide "2" (S54). It may then be determined whether the processing has been completed on all of the points, based at least on whether the value of the variable m exceeds the number of points whose information may be stored in the curve storage area 1208 (S55). At this time, because the variable is still m=2 and the processing may not have been completed on all of the points (NO in S55), coordinates of the m'th point, that is, the second point in this example, may be determined as those of an expected disposition point and may be stored in the expected disposition position storage area 1216 (S56). Then, a distance from the (m−1)'th point to the m'th point on the curve path may be added to the total interval storage area 1217 (S57). In this example, the distance from the first point, that is, the distance from the starting point to the second point on the curve path may be added.

Then, a value stored in the total interval storage area 1217 may be compared to a value (disposition interval) stored in the disposition interval storage area 1214 and it may be determined whether a predetermined disposition interval has been gained from the last disposition point (S58). When a disposition point is determined and has its coordinates stored in the pattern information storage area 1215 (S51, S60, and S61), the total interval storage area 1217 may be cleared to the initial value of "0" (S53). Accordingly, the value stored in the total interval storage area 1217 may indicate the distance from the last disposition point to the current expected disposition point.

If a sufficient distance of the disposition interval has not yet been gained from the last disposition point (NO in S58), the process may advance to S54 and add "1" to the variable m (S54). That is, the next point may be selected from the sequence of points stored in the curve storage area 1208. If the processing has not yet been completed on all of the points (NO in S55), the coordinates of the m'th point, that is, the coordinates of the third point in this example, may be determined as those of the expected disposition point and may be stored in the expected disposition position storage area 1216 (S56). The distance from the (m−1)'th point to the m'th point may be added to the total interval storage area 1217 (S57). In this example, the distance from the second point to the third point may be added. If the predetermined interval has not yet been gained from the last disposition point (NO in S58), the process may return to S54 again and the processing of S54-S58 may be repeated until the predetermined interval has been gained from the last disposition point.

Figure 46:
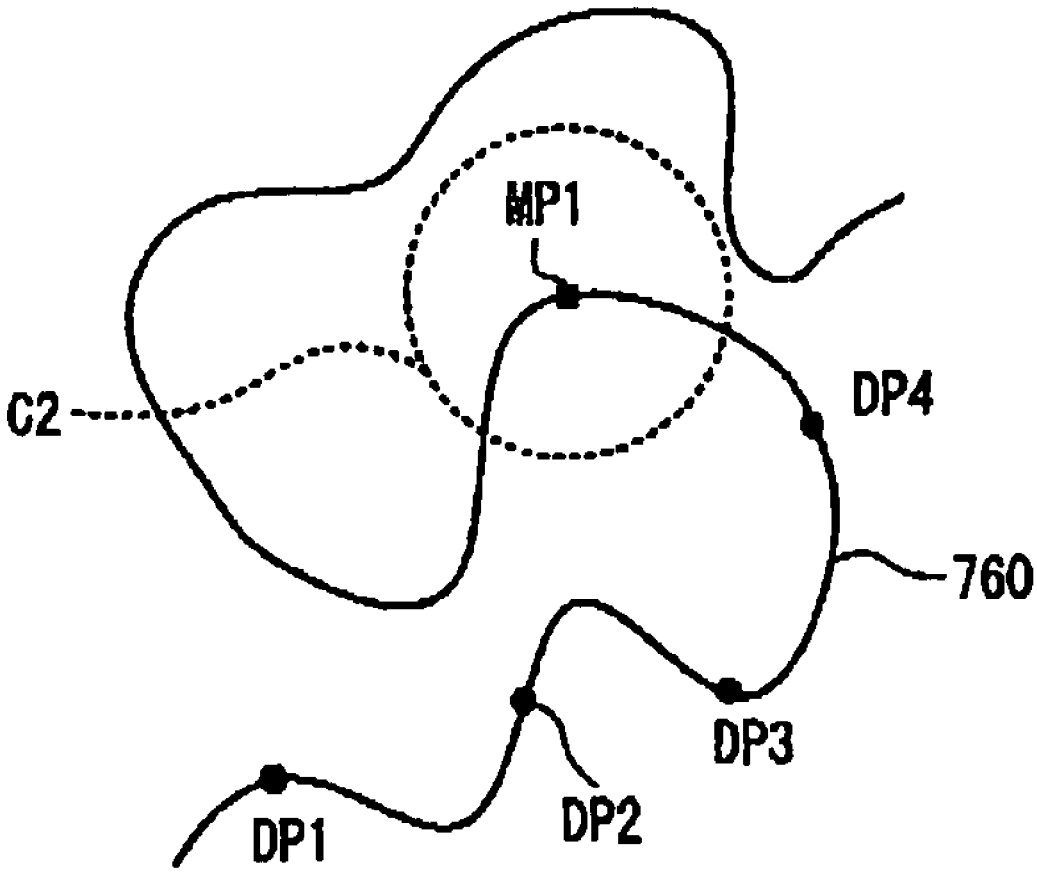
FIG. 46 is an explanatory diagram showing a state where there is no disposition point in the vicinity of an expected disposition point of a unit pattern.
Figure 47:
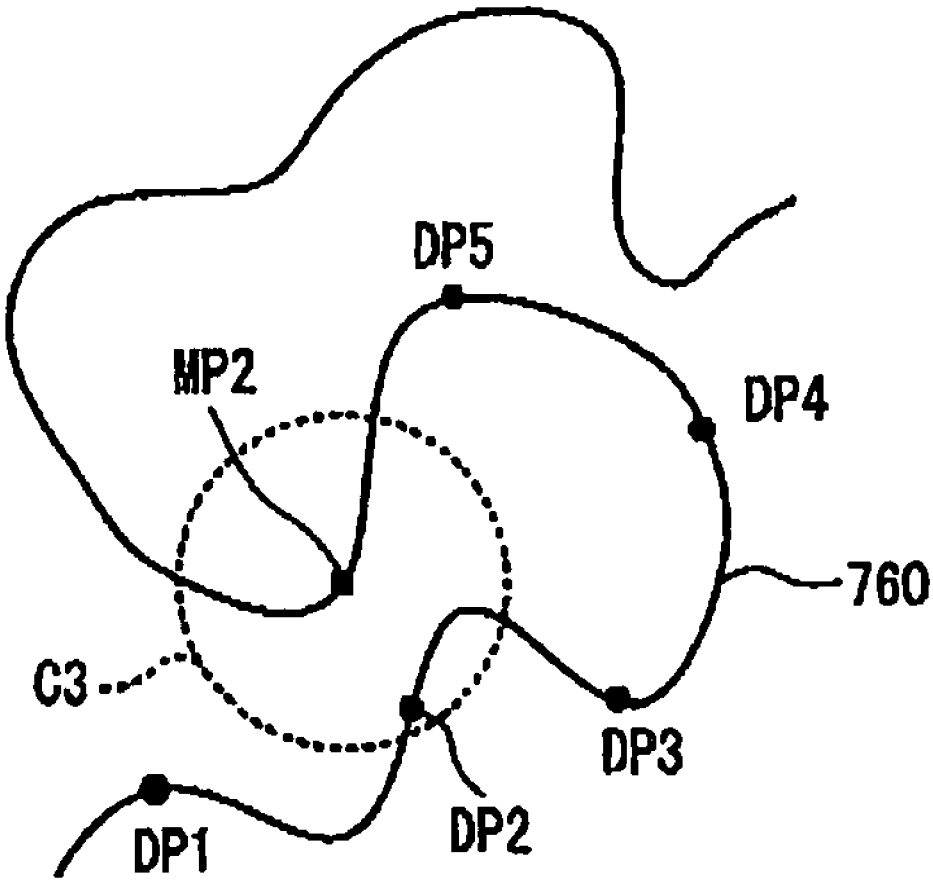
FIG. 47 is an explanatory diagram showing a state where there is a disposition point in the vicinity of the expected disposition point of the unit pattern.
Figure 48:
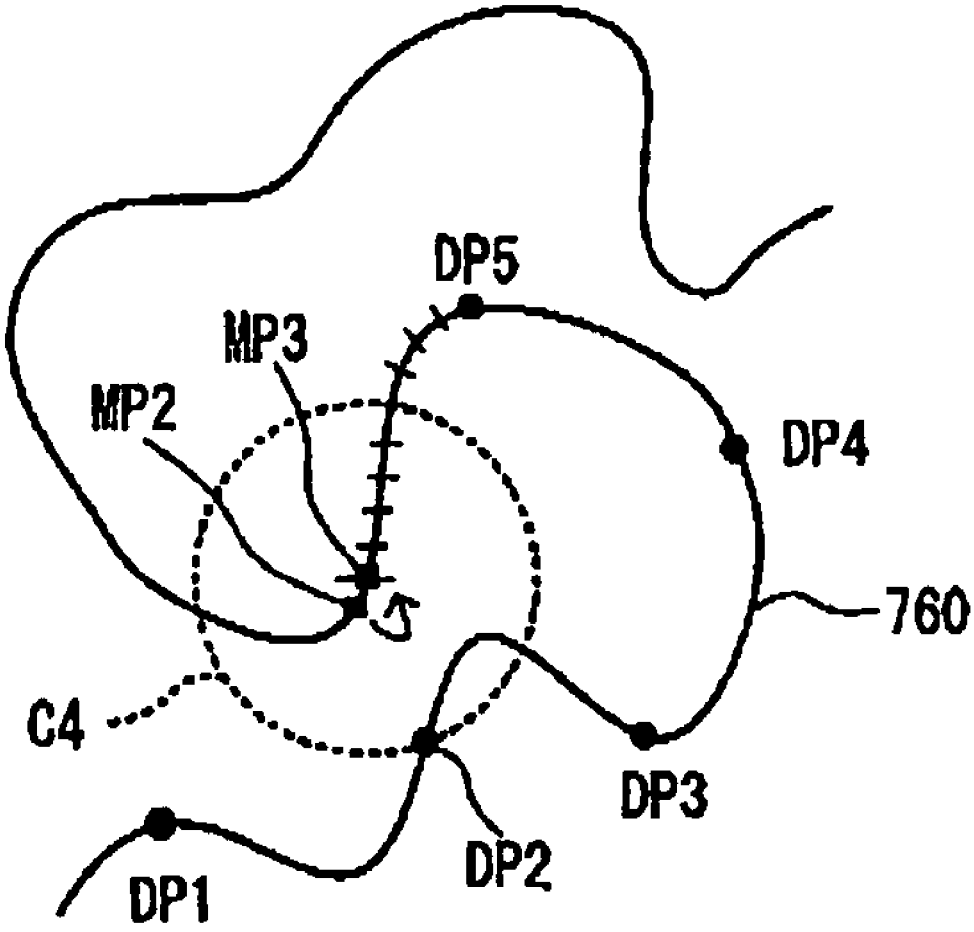
FIG. 48 is an explanatory diagram showing an expected disposition point to which an initial expected disposition point is moved first.

If the predetermined interval has been gained from the last disposition point (YES in S58), it may then be determined whether there is a disposition point in a predetermined area (S59). In the present exemplary embodiment, the predetermined area may be a circle which has the expected disposition point as its center and has a radius half of the disposition interval between the unit patterns, which may be stored in the disposition interval storage area 1214. In an example shown in FIG. 46, points DP1, DP2, DP3, and DP4 on a curve path 760 may be the disposition points, and point MP1 may be an expected disposition point. Accordingly, a circle C2, which has the point MP1 as its center and a (disposition interval)×½ as its radius, may be disposed as a predetermined area. As shown in FIG. 46, the circle C2 may have none of the disposition points DP1, DP2, DP3, and DP4 within it. Therefore, if MP1 is set as an expected disposition point, it may be determined that there is no disposition point in the predetermined area (NO in S59). Consequently, the expected disposition point is determined as a disposition point (S61). For example, coordinates of the expected disposition point, which may be stored in the expected disposition position storage area 1216, may be stored as coordinates of a disposition point of a unit pattern in the pattern information storage area 1215.

Then, the process may return to S53, "0" may be stored as the total interval in order to determine the next disposition point (S53), and the processing of S54-S58 may be repeated. If the disposition interval has been gained (YES in S58), it may be determined at the current expected disposition point whether there is a disposition point in the predetermined area (circle having the expected disposition point as its center and half the disposition interval as its radius) (S59). If there is no disposition point (NO in S59), the expected disposition point may be determined as a disposition point (S61) and the process may return to S53.

Figure 8:
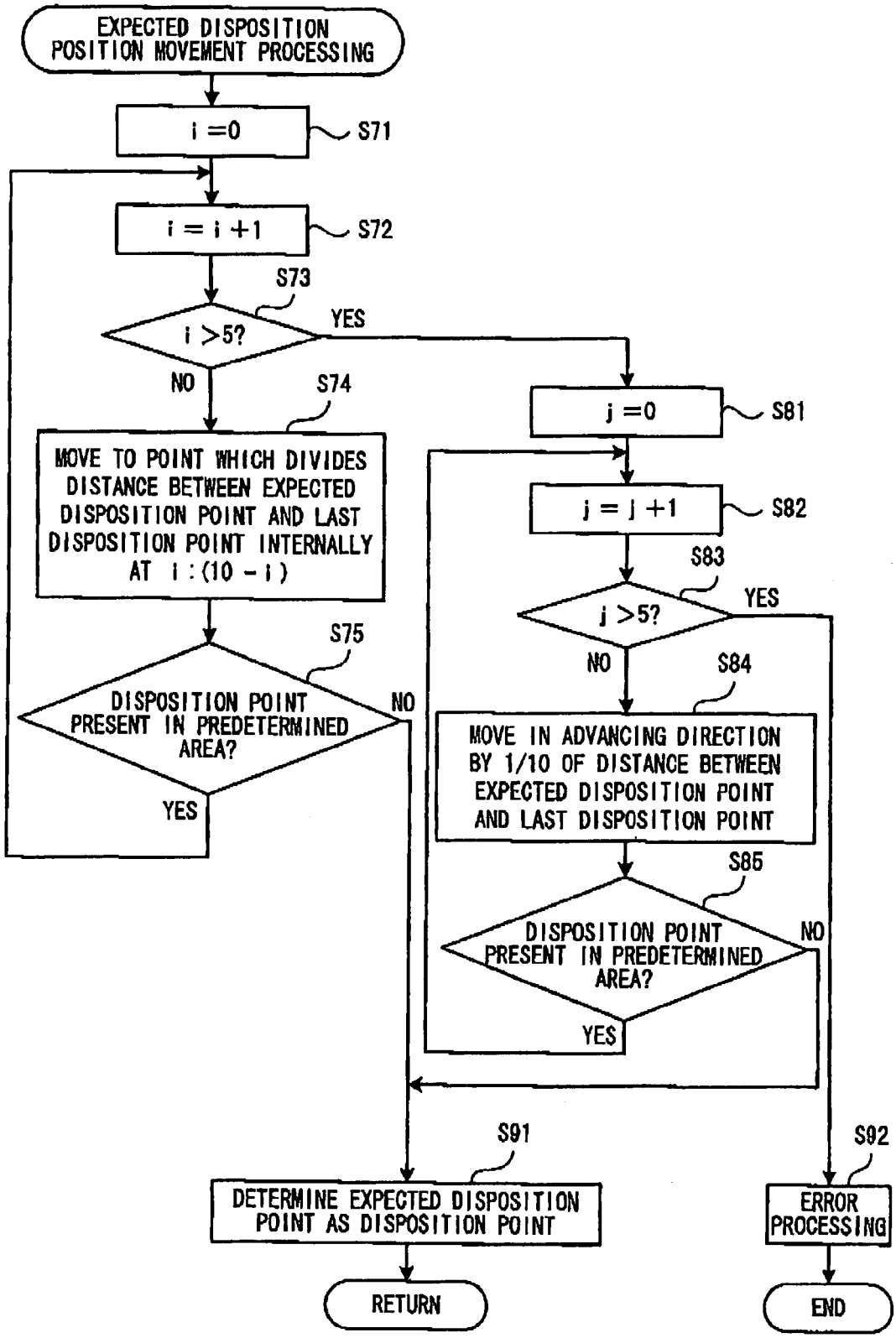
FIG. 8 is a flowchart of expected disposition position movement processing which is performed in the pattern disposition processing.
Figure 9:
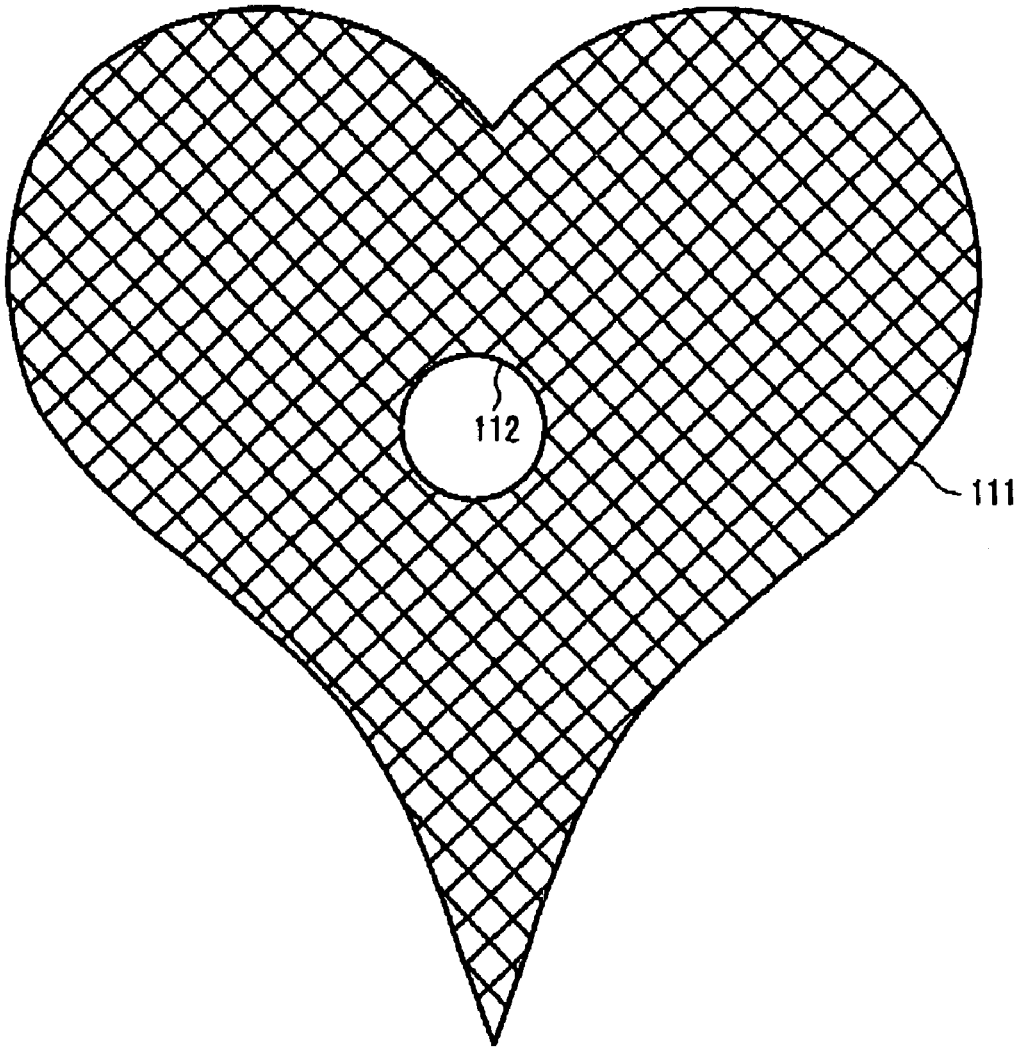
FIG. 9 is a schematic diagram of a sewing area.
Figure 10:
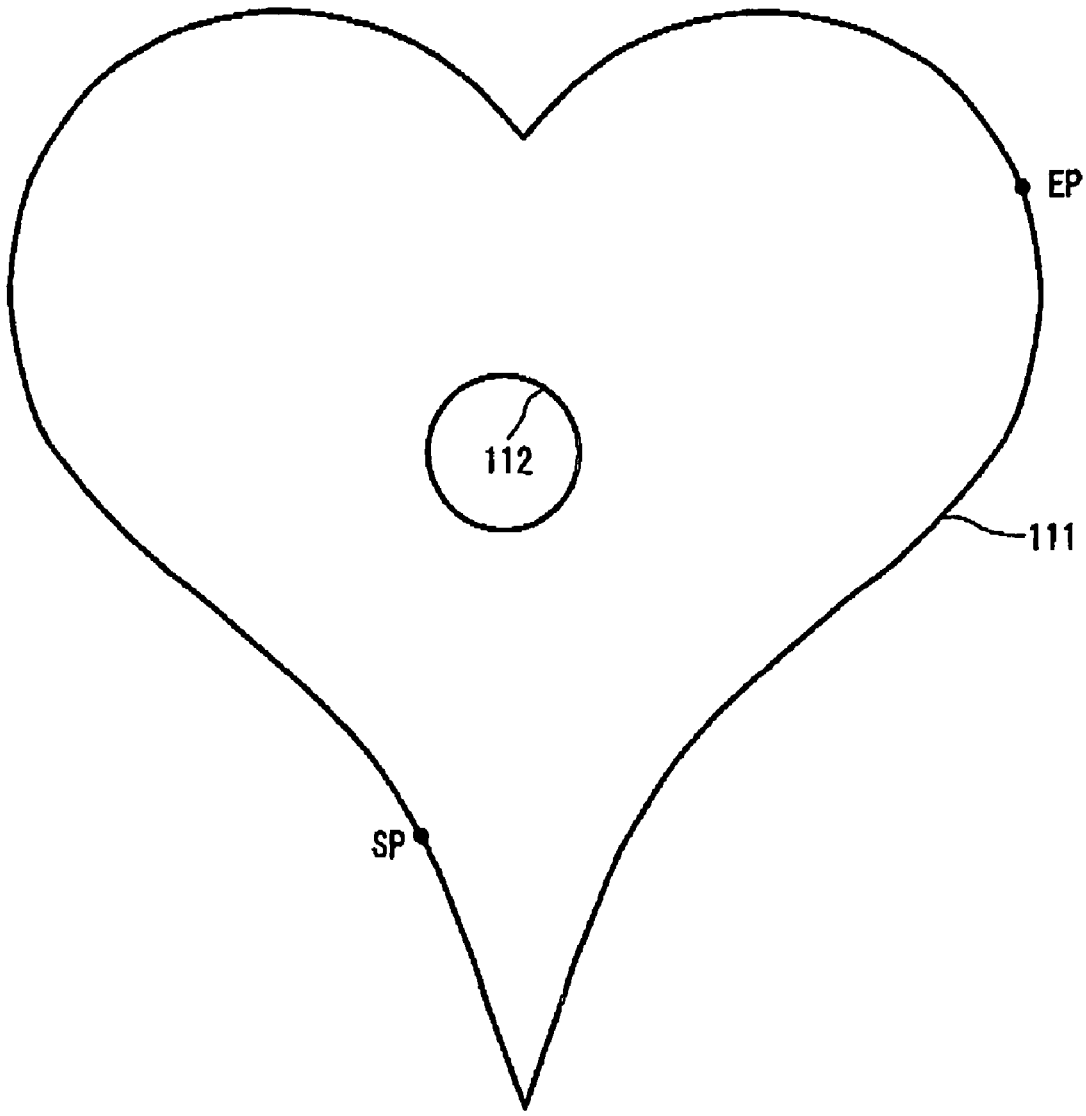
FIG. 10 is a schematic diagram of a starting point and an ending point in the sewing area.

On the other hand, if there is a disposition point in the predetermined area (YES in S59), expected disposition position movement processing may be performed (see S60 and FIG. 8). In an example shown in FIG. 47, points DP1, DP2, DP3, DP4, and DP5 are the disposition points and point MP2 is the expected disposition point on the curve path 760. As seen from FIG. 47, the disposition point DP2 may exist in a circle C3 having the expected disposition point MP2 as its center and the (disposition interval)×½ as its radius. In such a case, it may be determined that there is a disposition point in the predetermined area (YES in S59).

Consequently, in the expected disposition position movement processing, the expected disposition point is moved on the curve path by a predetermined distance in a direction in which the disposition point has been already positioned. Also, it may be determined whether a destination of this movement may be set as a disposition point. Hereinafter, a direction in which a disposition point has been already positioned on the curve path is referred to as a "retreating direction". In the expected disposition position movement processing, as shown by the flowchart of FIG. 8, the initial value "0" may first be stored as a variable i (S71). The variable i, whose storage area is provided in the RAM 12, may be used to count the number of times of moving the expected disposition point in the retreating direction from its original point.

Then, for example, "1" is added to the variable i so that it may be "1" (S72). Subsequently it may be determined whether the value of the variable i is larger than "5" (S73). Here, the variable is compared to "5", because movement of the expected disposition position in the retreating direction should be tried up to five times. In this example, the value of variable i is 1 and not larger than 5 (NO in S73), so that the expected disposition point is moved (S74). For example, a portion of the curve path between the expected disposition point and the last disposition point may be divided into ten and a point which divides the portion internally at a ratio of i:(10−i) may be determined as the expected disposition point after movement. In this example, the variable i is 1, so that the point which divides the portion internally at 1:9 may be determined as the expected disposition point. That is, the expected disposition point may be moved on the curve path in the retreating direction by 1/10 of the distance along the curve path between the expected disposition point and the last disposition point. Coordinates of this point may be stored in the expected disposition position storage area 1216. In an example shown in FIG. 48, the expected disposition point MP2 shown in FIG. 47 may be moved to a point MP3, which may be moved toward the disposition point DP5 by the distance of 1/10 of the distance between the expected disposition point MP2 and the last disposition point DP5, that is, 1/10 of the disposition interval.

Figure 49:
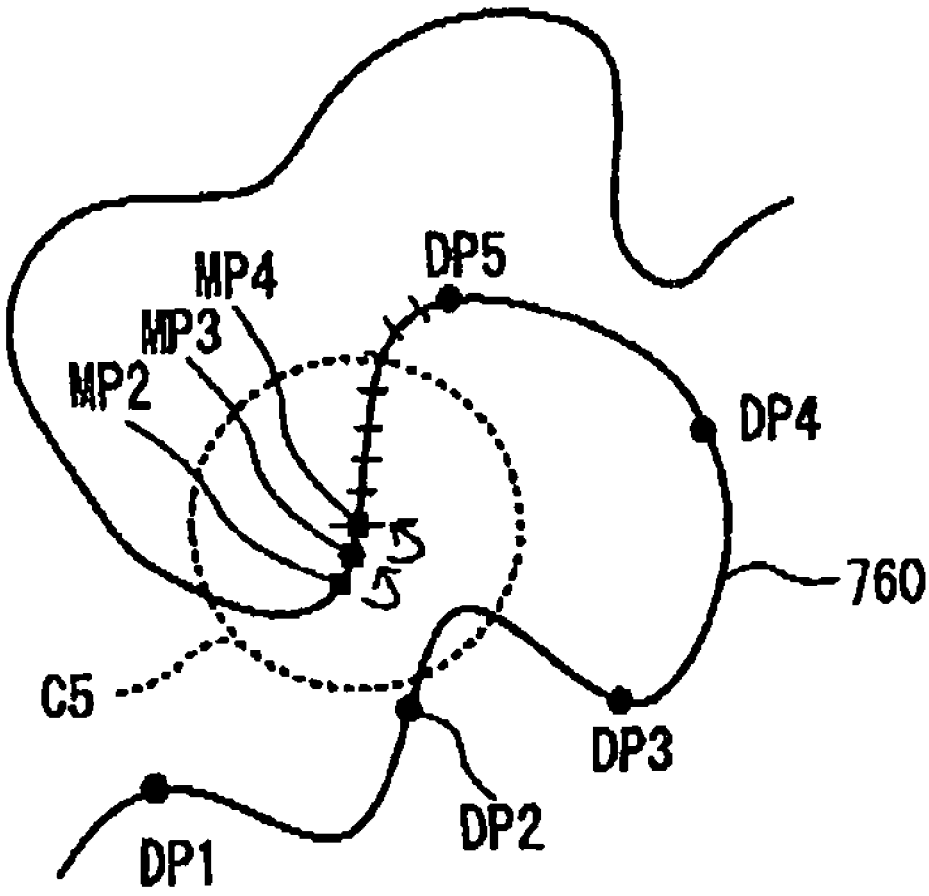
FIG. 49 is an explanatory diagram showing an expected disposition point to which the initial disposition point is moved second.
Figure 50:
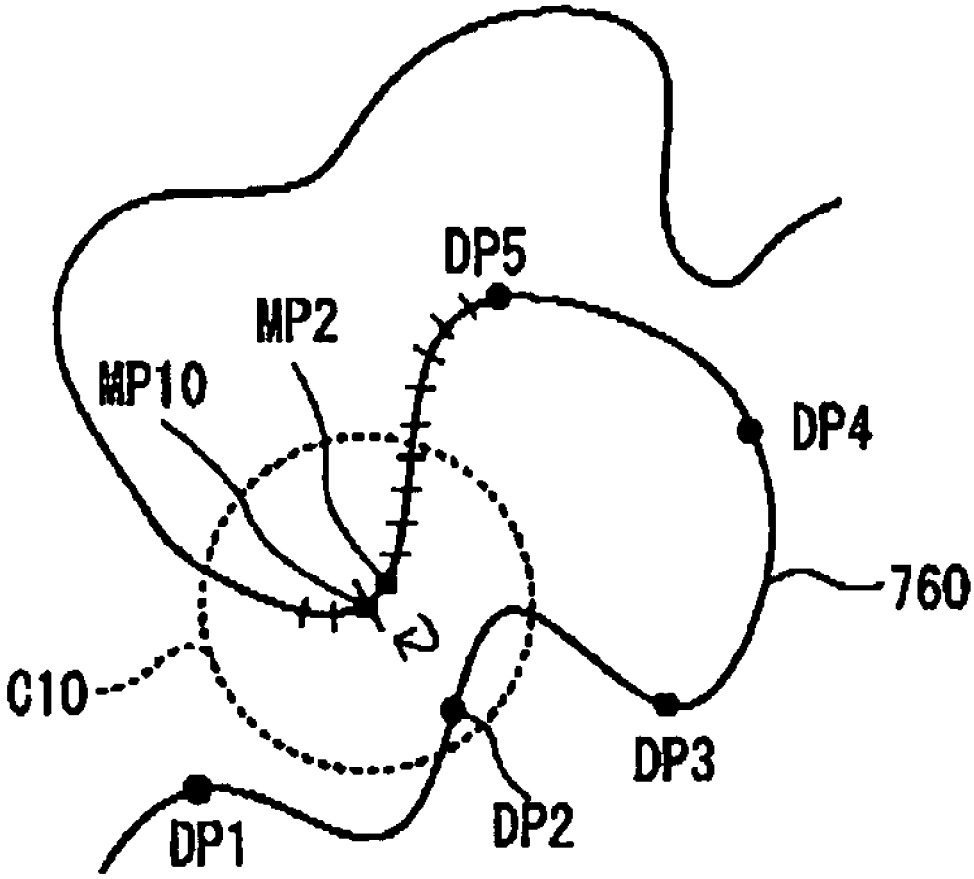
FIG. 50 is an explanatory diagram showing a state where the expected disposition point is moved in a direction opposite to the last position where the unit pattern was disposed.

Then, it may be determined whether there is a disposition point in a circle C4, which has the point MP3 as its center and (disposition interval)×½ as its radius (S75). In the example shown in FIG. 48, the disposition point DP2 may exist in the circle C4 (NO in S75), so that this point MP3 should not be determined as a disposition point. Accordingly, the process may return to S72 to add 1 to the variable i so that the variable i may become 2 (S72). In this example, the variable i is not yet larger than 5 (NO in S73), so that the expected disposition point is moved (S74). For example, as the expected disposition point after the movement, a point which divides a distance between the expected disposition point MP3 and the last disposition point DP5 internally at 2:8. That is, as shown in FIG. 49, in the expected disposition position storage area 1216, coordinates of the point MP4 to which the expected disposition point MP3 may be moved in the retreating direction on the curve path by another distance of 1/10 of the disposition interval may be stored.

Then, it may be determined whether there is a disposition point in a circle C5 which may have the point MP4 as its center and (disposition interval)×½ as its radius (S75). In the example shown in FIG. 49, there is no disposition point in the circle C5 (NO in S75) and so the expected disposition point may be moved to the point MP4 and may be determined as a disposition point. Consequently, the point MP4 may be determined as a disposition point and may be its coordinates stored in the pattern information storage area 1215 (S91). Then, the process may return to the pattern disposition processing (see FIG. 7).

On the other hand, if there is a disposition point in the predetermined area even when the variable i=2, the processing of S72-S75 may be further performed. The processing of S72-S75 may be repeated and, if the value of variable i becomes larger than 5 (YES in S73), the movement in the retreating direction may be stopped because further movement in the retreating direction disposes the point too close to the last disposition position. Therefore, the expected disposition point may be moved in a direction opposite to the retreating direction, that is, in a direction in which a disposition point has not yet been positioned on the curve path (hereinafter referred to as "advancing direction"). For example, the initial value 0 may be first stored as a variable j (S81). This variable j, whose storage area may be provided in the RAM 12, may be used to count the number of times of moving the expected disposition point from its first expected disposition point in the advancing direction.

Then, for example, 1 may be added to the variable j so that it may become 1 (S82). Subsequently, it may be determined whether the value of the variable j is larger than 5 (S83). In this example, the variable is compared to 5, because movement of the expected disposition position in the advancing direction should be tried up to five times. The value of the variable j at this example is still 1 and not larger than 5 (NO in S83), so that the expected disposition point may be moved (S84). For example, the expected disposition point on the curve path may be moved in the advancing direction by 1/10 of a distance between the expected disposition point and the last disposition point along the curve path. Coordinates of this point may be stored in the expected disposition position storage area 1216. In an example shown in FIG. 50, the expected disposition point MP2 shown in FIG. 47, may be moved to a point MP10 in the advancing direction. Note that in the example of the expected disposition point MP2 shown in FIG. 47, the point MP4 shown in FIG. 49 is supposed to be a disposition position, and movement in the advancing direction should not be considered. The example of the expected disposition point MP2 is therefore cited here to simply explain an example of the movement in the advancing direction.

Then, it may be determined whether there is a disposition point in a circle C10, which has a point MP10 as its center and (disposition interval)×½ as its radius (S85). In the example shown in FIG. 50, the disposition point DP2 may exist in the circle C10 (NO in S85), so that this point should not be determined as a disposition point. Accordingly, the process returns to S82 to add 1 to the variable j so that the variable may become 2 (S82). The variable j is not yet larger than 5 (NO in S83), so that the expected disposition point may be moved (S84). For example, in the expected disposition position storage area 1216, coordinates of a point may be stored, to which point the expected disposition point MP10 may be further moved in the advancing direction by another 1/10 of the distance between the expected disposition point and the last disposition point.

If there is no disposition point in the predetermined area (NO in S85), it means that the expected disposition point may be determined as a disposition point, so that coordinates of this point may be stored as those of the disposition point in the pattern information storage area 1215 (S91). Then, the process may return to the pattern disposition processing (see FIG. 7). On the other hand, if there is a disposition point in the predetermined area (YES in S85), the process may return to S82 to repeat the processing of S82-S85. If there is no disposition point in the predetermined area anymore (NO in S86), coordinates of the point may be stored as those of the disposition point in the pattern information storage area 1215 (S91). If the value of the variable j is larger than 5 (YES in S83), even if the expected disposition point is moved in the retreating direction or the advancing direction, a disposition point may exist in the vicinity of this point. As a result, the unit patterns may overlap or come too close to each other, thereby losing the ability to obtain sewing data to form stitches of a high quality and beautiful design. Therefore, in such a case, error processing may be performed (S92) to end the processing. In this case, the user may set a longer reference distance or select a unit pattern with a lower height and perform the processing of creating sewing data again, thereby creating the sewing data used to form stitches of a design with a high quality and beautiful shape.

In such a manner, unit patterns specified by a user may be disposed on a curve path at a disposition interval specified by the user. Further, if there is a disposition point already in the vicinity of an expected disposition point (in a predetermined area), the disposition point of the unit pattern may be determined by moving the expected disposition point little by little in order to prevent the unit patterns from overlapping with or coming too close to each other. Therefore, this determination may prevent the patterns from overlapping or coming too close to each other to disturb the balance of a design as a whole, thereby obtaining the sewing data used to form stitches of a high quality design.

Next, by way of example, determination of coordinates of needle drop points from the curve path 610 will be described below with reference to FIGS. 51 and 52. The determination of coordinates of needle drop points may be carried out in the stitch creation processing (S15 of FIG. 5). The transformed stitch path created by the first movement and the second movement in the transformation processing (S12) described above may be changed by Bezier curve processing (S13) into a Bezier curve, thus creating a curve path. The following example will be described using a curve path 650 having a stitch path starting point P601 and a stitch path ending point P602 shown in FIG. 51. As shown in FIG. 51, the curve path 650 may be represented by a plurality of points disposed densely on the curve. The coordinates of these points may be sequentially stored, from the stitch path starting point P601 to the stitch path ending point P602, in the curve storage area 1208.

First, it may be sequentially determined whether an angle is less than 120 degrees formed at each of the points that constitute the curve path 650 as a vertex, starting from the next point to the stitch path starting point P601. In the case of the n'th point, the angle between a line segment connecting the (n−1)'th point and the n'th point and a line segment connecting the n'th point and the (n+1)'th point may be compared with 120 degrees. If the angle is less than 120 degrees, the point may be determined as a feature point. In the example shown in FIG. 51, a point P600 may be determined as a feature point. At the feature point, the curve path 650 may be divided. In the example shown in FIG. 51, the curve path 650 may be divided into two divided curves 651, 652: a divided curve 651 connecting the stitch path starting point P601 and the feature point P600, and a divided curve 652 connecting the feature point P600 and the stitch path ending point P602. If there is m number of feature points, the curve may be divided into (m+1) number of divided curves. If there is no feature point, the curve path may not be divided and the following processing may be performed on it as one curve.

First, the number of needle drop points to be disposed on each of the divided curves may be calculated. For this purpose, the length of the divided curves may first be calculated. To calculate the length, the distance between each pair of the neighboring points may be added up. Then, the length may be divided by the stitch length which may be stored in the stitch length storage area 1202 to obtain a quotient. Then, the quotient may be rounded to the whole number and 1 may be added to it, which may provide the number of needle drop points which are to be disposed on the divided curve.

Next, a distance between the needle drop points on this divided curve may be calculated. For example, (distance between the needle drop points)=(length of the divided curve)/(number of needle drop points). Then, as shown in FIG. 52, a first needle drop point may be disposed at one end of the divided curve. The next needle drop point may be disposed at a point on the divided curve moved forward from the first needle drop point for the calculated distance between the needle drop points. Similarly, the next needle drop point may be sequentially disposed at a point on the divided curve moved forward from that preceding needle drop point by the distance between the needle drop points. Finally, the other end of the divided curve may be determined as the last needle drop point. In this case, the coordinates of the previously determined needle drop points may be stored in the stitch information storage area 1209.

Figure 52:
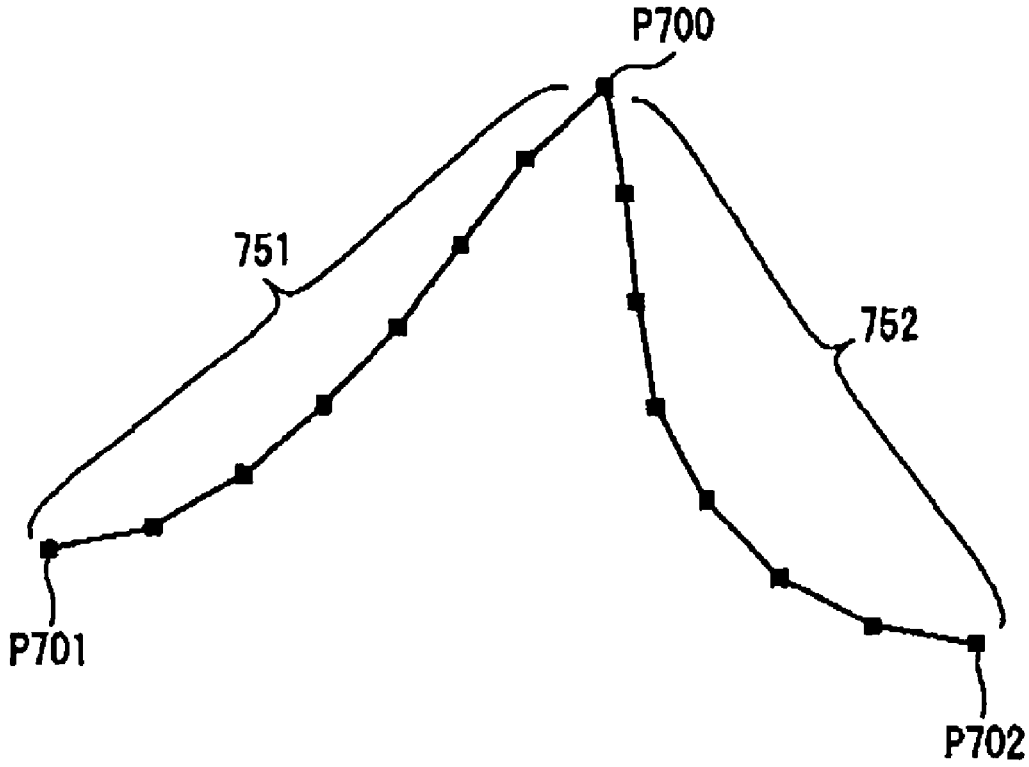
FIG. 52 is an explanatory diagram of a needle drop points created from the curve path shown in FIG. 51.

In the example shown in FIG. 52, on the divided curve 751, a needle drop point P701 may be disposed at the stitch path starting point P601, a needle drop point P700 may be disposed at the feature point P600, and six needle drop points may be evenly disposed between the needle drop point P701 and the needle drop point P700. Further, on the divided curve 752, the needle drop point P702 may be disposed at the stitch path ending point P602 and six needle drop points may be evenly disposed between the needle drop points P700 and the needle drop point P702.

In such a manner, a curve path may be divided at a feature point into divided curves and the distance between the needle drop points along the divided curve may be calculated based on a value, for example, stored in the stitch length storage area 1202. As a result, the needle drop points may be evenly disposed between the feature points, and between the feature point and the stitch path starting point or ending point, thereby obtaining sewing data used to form stitches of a design having a beautiful shape.

Further, the unit patterns may be disposed on the curve path 650. The information of the needle drop points relating to the unit patterns may be stored in the unit pattern storage area 122. The information may refer to the disposition reference point 589 (see FIG. 20) as a starting point and an ending point. Accordingly, for each disposition point of the unit patterns, out of the needle drop points that may be stored in the stitch information storage area 1209, a needle drop point closest to the disposition point may be searched for, so that a needle drop point next to the closest needle drop point may be determined as the disposition point. Using this point as the disposition reference point, coordinates of the other needle drop points used to form the unit pattern may be determined.

For example, next to the coordinates of the needle drop point determined as the closest, the coordinates of the disposition point may be inserted in the stitch information storage area 1209. Then, an inclination of a tangent line of the curve path at the disposition point may be calculated. Next, the coordinates of the other needle drop points used to form the unit pattern may be rotated in such a manner as to match the inclination of the tangent line by using the disposition reference point as an axis point. Using the disposition reference point as a disposition point, the coordinates of the other needle drop points after the rotation may be calculated. Then, a group of the coordinates of the other needle drop points may be inserted following the coordinates of the disposition reference point (disposition point) in the stitch information storage area 1209. Finally, the coordinates of the needle drop point determined as being the closest may be stored in the stitch information storage area 1209. In such a manner, the information of the needle drop points which may create stitches to form a unit pattern may be added to the information of the needle drop points which may create stitches to form the curve path.

The present disclosure is not limited to the above-described embodiment, but, of course, may be modified variously. Although the above embodiment has employed a regular hexagon as a unit area, instead, a line-symmetrical hexagon may be employed. Preferably, the hexagon has a vertex with an angle smaller than 180 degrees. Other than a hexagon, the unit area may be a polygon such as a regular triangle, a rectangle, a rhomboid, a parallelogram, or a pentagon. When disposing the polygons as the unit areas, orientation of the polygons need not be constant. Further, although the above embodiment has disposed the regular hexagons in such a manner as to fill the sewing area, there may be a gap between the unit areas as far as they are in contact with each other.

In the above-described embodiment, the stitch path 410 that is evenly disposed in the sewing area 119 may be transformed through the transformation processing (S12), changed into a curve through the Bezier curve processing (S13), and then the needle drop points may be disposed on the curve, thereby creating stitch information. However, the stitch information may be created by disposing the needle drop points on a stitch path after the movement processing of S10 is completed. Alternatively, the stitch information may be created by disposing needle drop points on a stitch path after the special processing of S11 is completed or it may be created after disposing unit patterns on a transformed stitch path after the transformation processing of S12 is completed.

In the above embodiment, a stitch path may be created in the sewing area 119 which may be given an offset from the overall sewing area 110 in S6 in the main processing shown in FIG. 5. The stitch path, however, may be created in the overall sewing area 110 without giving the offset. In this case, the processing of S7 may be performed to create a profile line network to the overall sewing area 110 omitting the processing of S6 in the main processing shown in FIG. 5.

In the above-described embodiment, the information of a curve path may be created in the main processing of sewing data creation. However, it is not always necessary to create a curve path when disposing a unit pattern. Rather than creating a curve path, a curve path already created and stored in the hard disk drive 120, or a curve path created in any other apparatus and read from the memory card 115 or the CD-ROM 114, may be used. Also, if the sewing data creation apparatus 1 is connected to a network, a curve path stored in any other apparatus connected to the network may be used. The curve path which is used here is not limited to that created particularly for stippling stitches but may be information that indicates one curve. For example, a curve drawn by drawing software or a curve which is transformed from an equation may be used. Any information that represents a curve by an aggregate of a plurality of points may also be used as a curve path.

Figure 53:
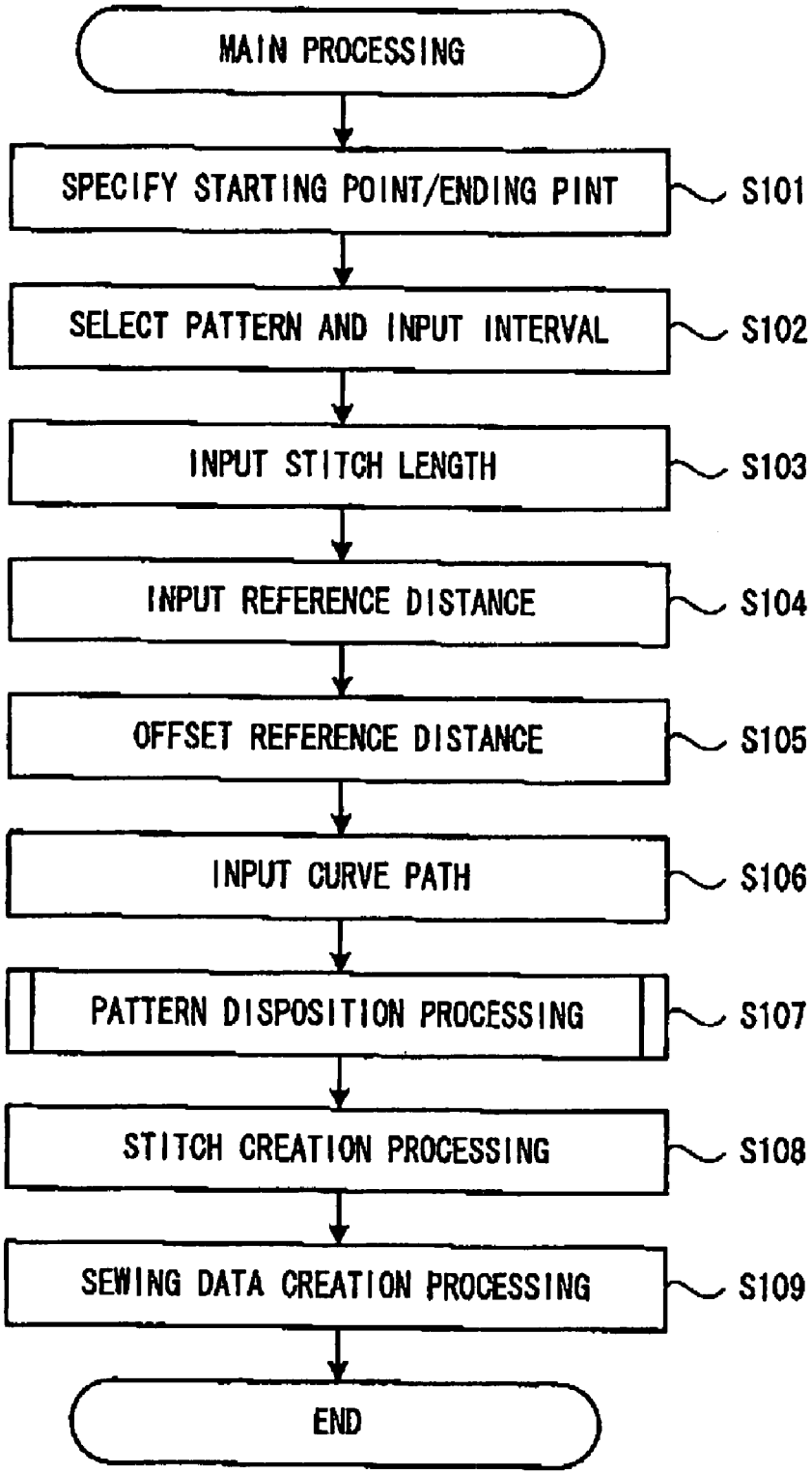
FIG. 53 is a flowchart for a case of creating sewing data by disposing unit patterns on an already created curve path.

FIG. 53 is a flowchart of an example when sewing data is created by disposing unit patterns on a curve path separately created beforehand. As shown in FIG. 53, like the flowchart shown in FIG. 5, first, a starting point and an ending point may be specified (S101), a unit pattern to be attached as a decorative pattern may be selected, and a disposing interval of the unit patterns may be input (S102) Subsequently, a stitch length may be input (S103) and a reference distance may be input (S104). Then, the offset processing on the reference distance may be performed (S105) and a curve path may be input (S106). Here, first the user may select a data file describing the curve path from a storage medium from which the sewing data creation apparatus 1 may reference data files. Then, data in the selected data file may be read and stored into the RAM 12, thereby the curve path may be input. The storage medium from which the sewing data creation apparatus 1 may reference data files that may include, for example, the hard disk drive 120 in the sewing data creation apparatus 1, the mounted CD-ROM 114 or memory card 115, or a storage medium in a terminal open to a network to which the terminal is connected.

Then, the pattern disposition processing may be performed in a manner similar to that of the above-described embodiment (S107), and the stitch creation processing may be performed (S108). Subsequently, sewing data that may be used for sewing may be created based on the information of the needle drop points that may be in the stitch information storage area 1209 (S109), and the processing may be terminated. The embroidery sewing machine 3 may be driven on the basis of the previously created sewing data, to sew a stippling stitch and the unit patterns serving as decorative patterns on the work cloth held by the embroidery frame 31.

In the above-described embodiment, when the unit patterns are disposed on the curve path, they may be oriented in an advancing direction of the curve path. The direction, however, may be specified by the user. For example, besides the "advancing direction of the curve path", the direction may be a "retreating direction of the curve path", a "rightward direction with respect to the advancing direction of the curve path", a "leftward direction with respect to the advancing direction of the curve path", a "downward direction (for example, increasing direction along the y-axis) of the sewing area 119", an "upward direction (for example, decreasing direction along the y-axis) of the sewing area 119", a "rightward direction (for example, increasing direction along the x-axis) of the sewing area 119", and a "leftward direction (for example, decreasing direction along the x-axis) of the sewing area 119". A screen may be displayed on the display 24 to show these various directions in such a manner that they may be selected. Thus, the user may selectively enter the direction of the unit pattern by manipulating the mouse 21 or the keyboard 22.

Figure 54:
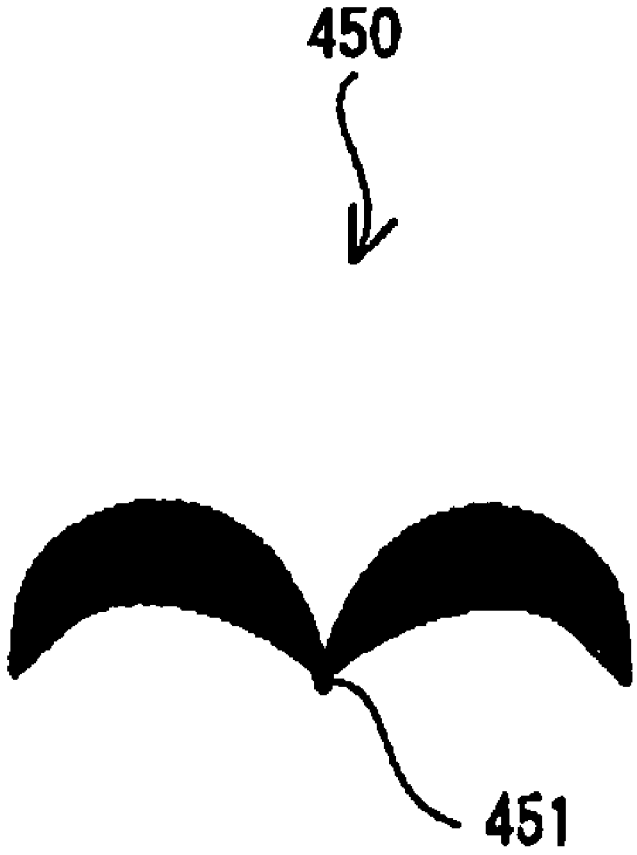
FIG. 54 is a schematic diagram showing the unit pattern.
Figure 55:
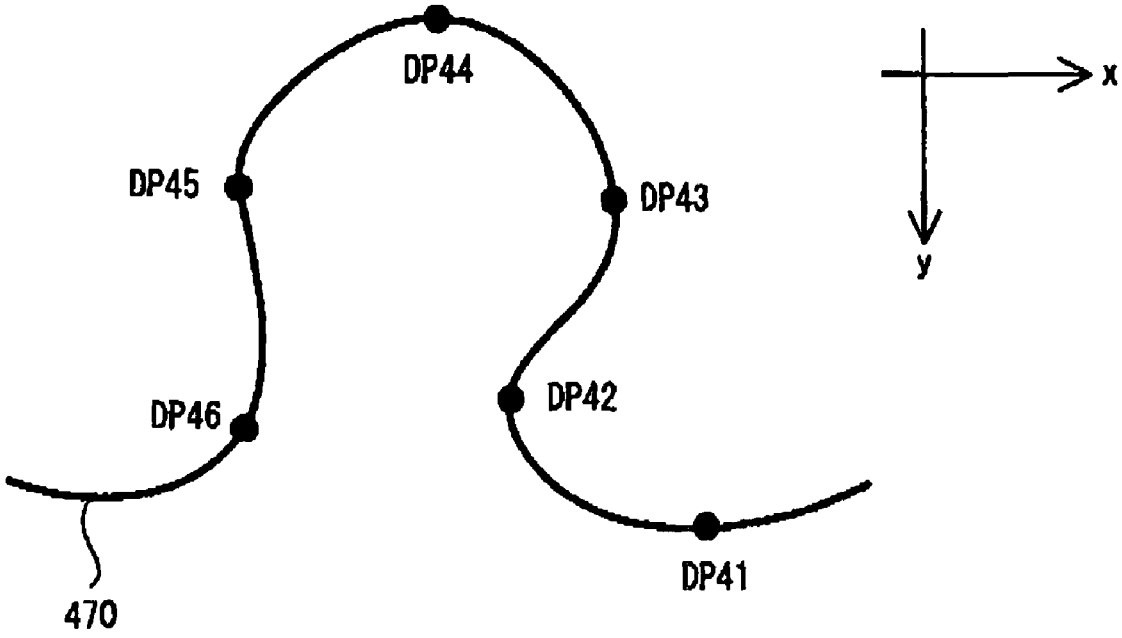
FIG. 55 is an explanatory diagram showing a curve path having a plurality of disposition points.

Examples will be described below with reference to FIGS. 54-58, in the direction of a unit pattern 450 shown in FIG. 54 is specified variously. In FIGS. 55-58, the curve path 470 should advance from the right to the left of the paper. That is, it may extend from the starting point side to the ending point side through disposition points DP41, DP42, DP43, DP44, DP45, and DP46 in this order. Further, in FIGS. 55-58, the horizontal and vertical directions of the paper may be an x-axis and a y-axis respectively and the x-axis value and the y-axis value may increase rightward and downward respectively in their coordinate system. Also in FIG. 54, the horizontal and vertical directions of the paper may be an x-axis and a y-axis respectively, the x-axis value and the y-axis value may increase rightward and downward respectively in their coordinate system. Also, the coordinates of needle drop points with respect to a unit reference point 451 serving as the starting point and ending point may be stored in the unit pattern storage area 122.

Figure 56:
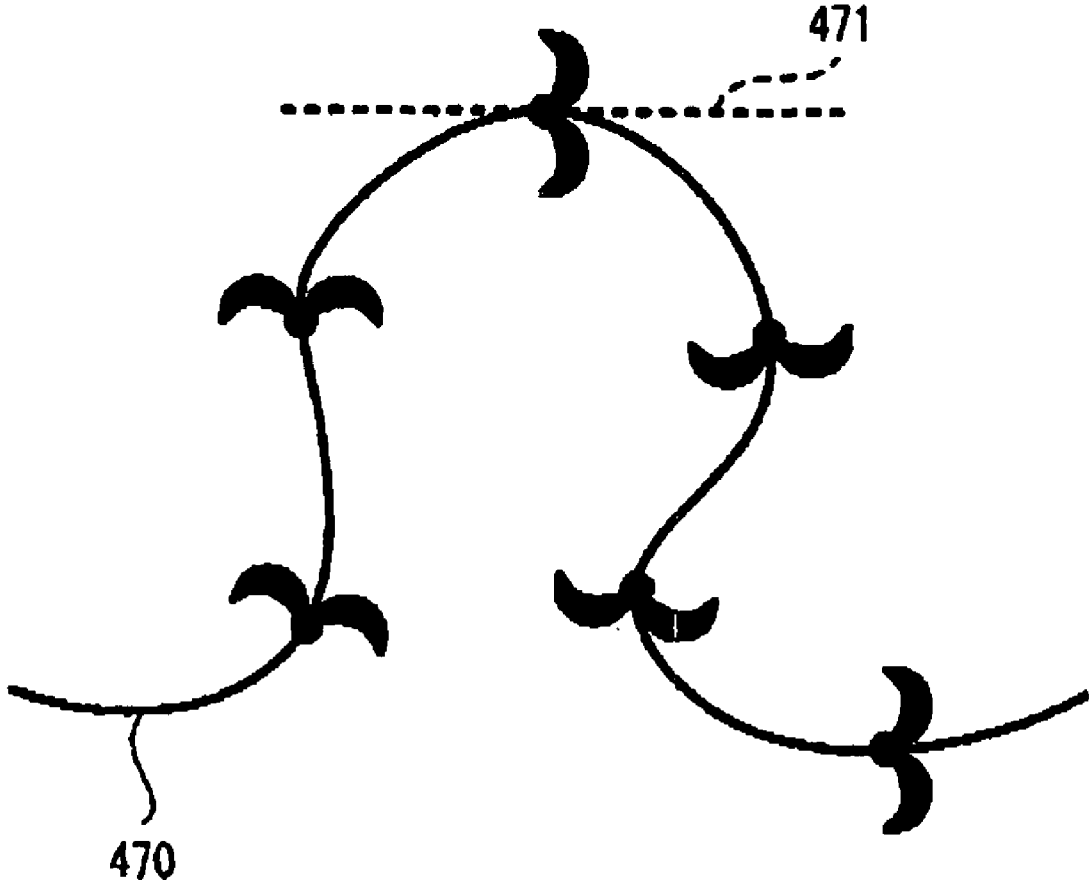
FIG. 56 is an explanatory diagram showing a state where the unit patterns are disposed at the disposition points on the curve path in its retreating direction.

FIG. 56 shows a state where the unit patterns may be disposed in such a manner as to be oriented in the "retreating direction of the curve path". As shown in FIG. 56, the unit patterns may be disposed along a tangent vector 471 of the curve path 470 in such a manner that their upper sides may face the retreating direction of the curve path 470. In this case, in the stitch creation processing (S15 of FIG. 5), the coordinates of the needle drop points which form the unit pattern may be rotated around the unit reference point 451 (see FIG. 54). If the inclination of the tangent vector 471 is 180 degrees with respect to the x-axis (faces the negative direction of the x-coordinate (leftward in FIG. 56), the coordinates may be rotated by −90 degrees. The coordinates after the rotation may be stored in the stitch information storage area 1209 as those of the needle drop points of the unit pattern.

Figure 57:
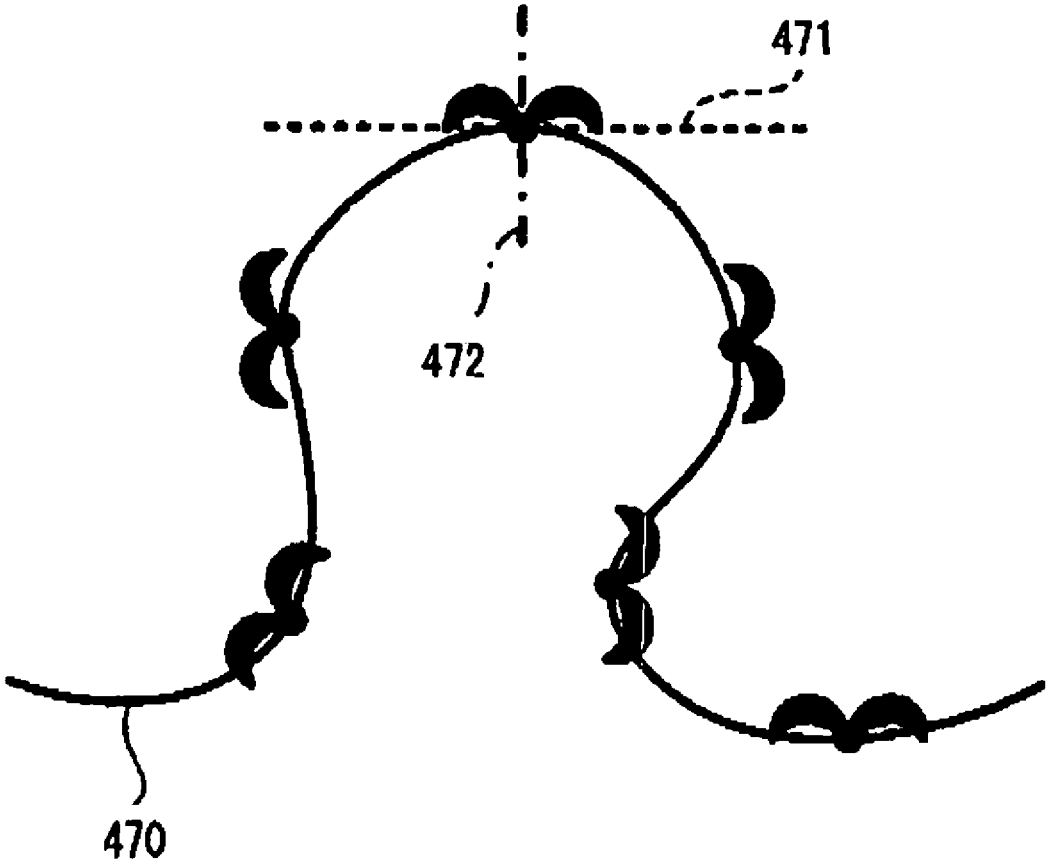
FIG. 57 is an explanatory diagram showing a state where the unit patterns are disposed rightward at the disposition points on the curve path with respect to its advancing direction.

FIG. 57 shows an example when the unit patterns are disposed in such a manner as to be oriented in the "rightward direction with respect to the advancing direction of the curve path". As shown in FIG. 57, the unit patterns may be disposed along a perpendicular vector 472 of the tangent vector 471 of the curve path 470 in such a manner that their upper sides may face upward. In this case, in the stitch creation processing (S15 of FIG. 5), the coordinates of the needle drop points, which form the unit pattern, may be rotated around the unit reference point 451 (see FIG. 54). If the inclination of the perpendicular vector 472 is 90 degrees with respect to the x-axis (faces the negative direction of the y-axis (upward in FIG. 55)), the coordinates may be rotated by 0 degrees. The coordinates after the rotation may be stored in the stitch information storage area 1209 as those of the needle drop points of the unit pattern.

Figure 58:
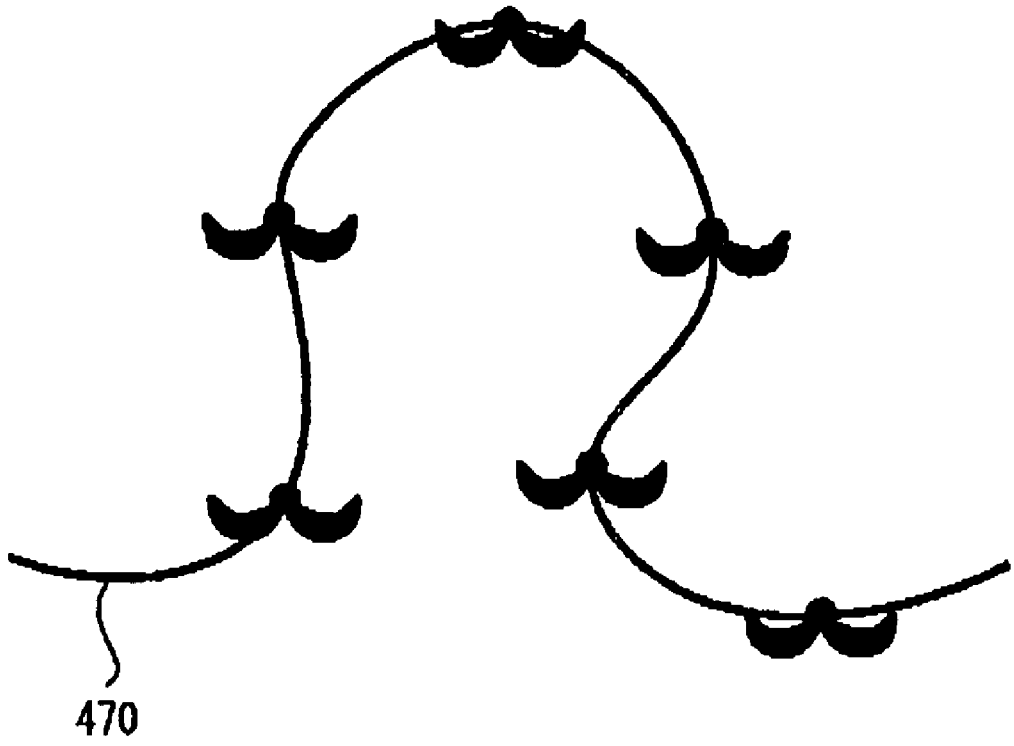
FIG. 58 is an explanatory diagram showing a state where the unit patterns are disposed at the disposition points on the curve path downward of the sewing area.

FIG. 58 shows an example when the unit patterns are disposed in such a manner as to be oriented in the "downward direction of the sewing area 119 (in the increasing direction along the y-axis). As shown in FIG. 58, the unit patterns may all face downward (in the increasing direction along the y-axis). In this case, in the stitch creation processing (S15 of FIG. 5), the coordinates of the needle drop points which form the unit pattern may be rotated around the unit reference point 451 (see FIG. 54) by 180 degrees. The coordinates after the rotation may be stored in the stitch information storage area 1209 as those of the needle drop points of the unit pattern.

The orientation of the unit patterns is not limited to these. Also, the number of the orientations of the unit patterns is not limited to one, so that a plurality of orientation may be used sequentially.

Figure 59:
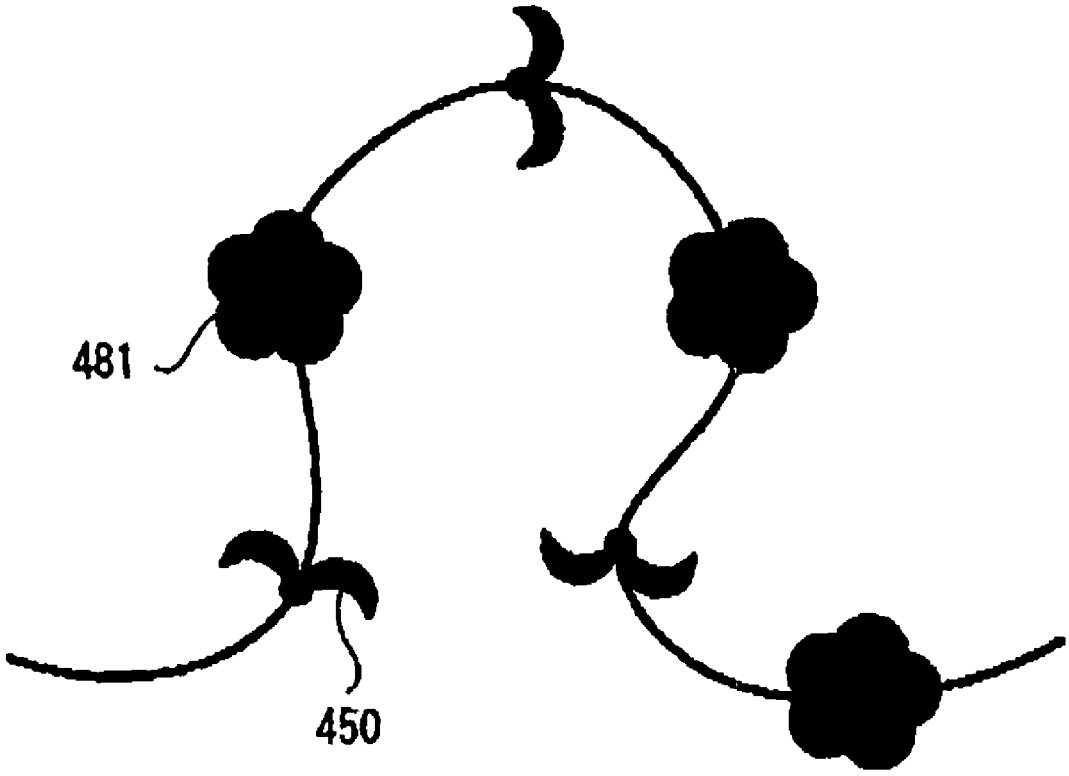
FIG. 59 is an explanatory diagram showing a state after sewing where two types of unit patterns (the unit pattern shown in FIG. 54 and a flower-shaped unit pattern) have been stored in a set.
Figure 60:
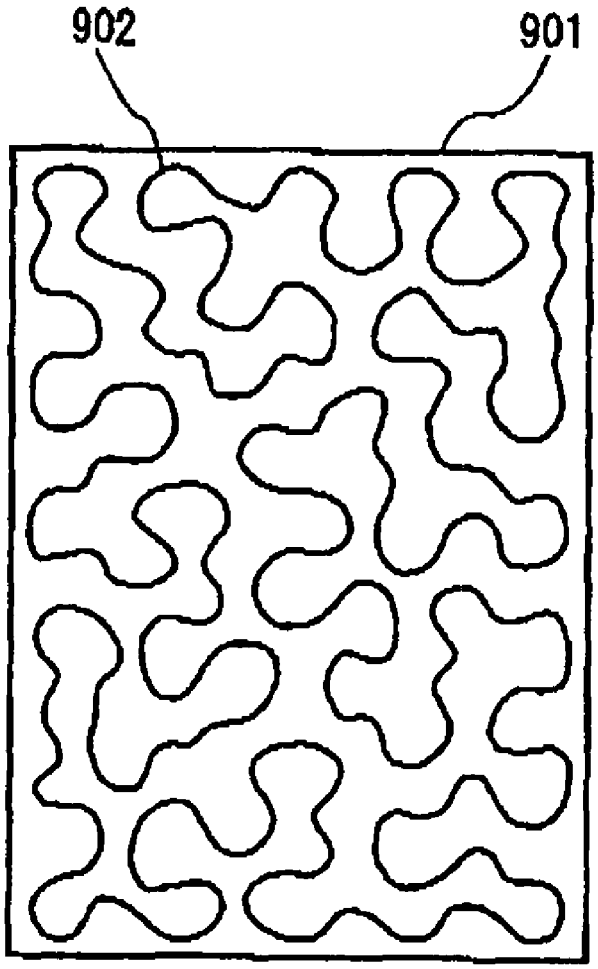
FIG. 60 is a schematic diagram showing a state where a stippling stitch has been sewn.

Although the above embodiment has selected one kind of unit pattern, a plurality of unit patterns may be stored in a set in the unit pattern storage area 122. In this case, the plurality of unit patterns may be disposed in sequence. For example, if two unit patterns of a unit pattern 450 and a flower-shaped unit pattern 481 shown in FIG. 54 are stored in the unit pattern storage area 122 as a set, as shown in FIG. 59, the sets of two kinds of the unit patterns may be disposed sequentially so that the unit patterns 450 and 481 are disposed alternately.

The number of the kinds of the unit patterns need not be two, but, of course, may be larger than two, for example, 3, 4, or 100. Further, as shown in FIG. 59, the unit patterns 450 and 481 may both be disposed to face the advancing direction of the curve path. These unit patterns, however, may respectively face different directions. Moreover, a user may specify the orientation of each of the unit patterns. Instead of storing the plurality of unit patterns in a set, they may be stored independently from each other in the unit pattern storage area 122 to permit the user to select any one of the unit patterns to be disposed. In this case, the user may select the orientation of each of the unit patterns or may select the orientation of the patterns as a whole.

Instead of setting the same disposing interval for all the unit patterns, the disposing interval may be set for each of the unit patterns. For example, in an example shown in FIG. 59, different interval values of 10 mm and 15 mm may be set after the unit patterns 450 and 481 respectively. In this case, a smaller value may be used in determination of the disposing position. Although the above embodiment has permitted the user to enter a disposing interval, a predetermined value may be set. For example, the disposing interval may be determined for each of unit patterns, or on the basis of the area or size of the sewing area or the size of the unit patterns.

In the above embodiment, a determined size for each of the unit patterns may be stored in the unit pattern storage area 122. However, only basic information of the graphic of the unit patterns may be stored beforehand, to permit the user to specify the size of the unit patterns.

In the above embodiment, the needle drop points used to create stitches of the unit patterns may be inserted into the needle drop points used to create stitches of the curve path, and may thereby create the information of the needle drop points. That is, the information may be the sewing data for sewing decorative patterns together with the stippling stitch line. However, the sewing data may be separately prepared for sewing the stippling stitch line and the decorative patterns. For example, if different thread colors are employed for the stippling stitch and the decorative patterns, it may be useful to create different information for the needle drop points of the stippling stitch and the decorative patterns. If a plurality of colors is employed for the decorative patterns, the needle drop point information may be created for each of the colors. In such a case, the needle drop point information of the stippling stitch may be created from the information of the needle drop points on the curve path alone, without inserting the needle drop point information of the decorative patterns as described above. On the other hand, the information of the needle drop points of the decorative patterns may be created from only the needle drop points inserted into the information of the needle drop points created from the curve path in the above-described embodiment. Then, based on the previously created sewing data, a so-called multi-needle type embroidery sewing machine equipped with a plurality of needle bars may be used for sewing in place of the embroidery sewing machine 3 of the above-described embodiment. In this case, if thread spools for desired thread colors are set to the respective needle bars beforehand, it may eliminate the trouble to replace the thread spool each time the thread color is changed.

In the above-described embodiment, the height of a unit pattern may be added as an offset when determining the size of a unit area. However, the value to be added is not limited to the height of the unit pattern itself but may include its multiplied value by a predetermined value (for example, 0.9, 1.1, or 1.2). Further, the offset of the sewing area is not limited to the (height of the unit pattern)×½. The value by which the height of the unit pattern is multiplied is not limited to ½, but may be any other predetermined value (for example, 0.55 or 0.6). In the above embodiment, when determining a disposition point, the expected disposition point may be moved by 1/10 of the distance from the last disposition point (disposition interval) each time, up to five times. However, the movement distance and the number of times of the movement are not limited to these. The movement distance may be any other value of 1/9 or 1/11 of the distance from the last disposition point or any other value, such as 0.2 mm, not based on the distance from the last disposition point. Also, although the processing may be terminated when the disposition point has been moved to the middle between the last disposition point and the expected disposition point, it may be moved more than or less than five times. Of course, the number of times depend on the movement distance.

In the above embodiment, one reference distance may be set and used to determine the size of the unit area and the radius of the circle when creating the transformed stitch path by moving the branch points. However, different values may be inputted for a reference distance for the size of the unit area and a reference distance for the radius of the circle. Rather than causing the user to enter the reference distance, a predetermined value may be used as the reference distance. Further, the reference distance may be determined on the basis of the area or the size of a sewing area.

In the above embodiment, the stitch path starting point may be determined as the branch point closest to the starting point. Instead of the branch point, a point on the side line segment closest to the starting point may be employed. This also holds true for the stitch path ending point. Similarly, although the starting point and the ending point are on the profile line 111 of the sewing area 119 in the embodiment, they may be set in the sewing area 119. Further, rather than making the user specify the starting point and the ending point, arbitrary points may be set by a program.

In the above-described embodiment, when creating the initial stitch path 310, branch points may be traced in the clockwise direction along the profile line of the sewing area 119. However, they may also be traced counterclockwise.

In the movement processing (S6 of FIG. 5), the sequence of the branch points on the stitch path may be used as the argument by the random number generation program to obtain reproducibility with any other value, for example, the coordinates of the branch point may be used instead. Further, values to be given as the arguments may be stored in an array so that those values may be used sequentially from the first one in the array. Further, the reproducibility may not always be required, and the argument may take on a different value each time. For example, a time may be used as the argument. Rather than using the random number generation program, an array storing values to be used in probability judgment may be stored beforehand so that the values may be sequentially read from the array and used. Further, rather than determining whether to actually move the stitch path based on the probability, the path may be actually moved for a predetermined number of times if any of the movement patterns applies. Further, instead of making determination on whether to actually move the stitch path, the stitch path may be moved each time any of the movement patterns applies.

In the above-described embodiment the vertexes of one unit area (regular hexagon), that is, the branch points on its profile line may be traced to determine whether the stitch path is to be moved. However, instead of tracing the branch points on the profile line of one unit area, the branch points on an outer periphery of a plurality of the unit areas may be traced to determine whether the stitch path may be moved.

In the above embodiment, all of the branch points on the stitch path 410 may be moved to create the transformed stitch path 510. Rather than moving all the branch points, however, only some of the points may be moved. For example, only the branch points having sequences of even numbers or those as multiples of 3 may be moved, or it may be determined whether to move each of the branch points at a predetermined probability by a random number. Further, only the first movement or the second movement may be performed. Even further, it may be arranged such that only the first movement would be performed on some points, only the second movement would be performed on other points, and both the first movement and the second movement would be performed on the other points.

In the above-described embodiment, it may be determined whether to move the stitch path if the movement pattern A or B applies in the movement processing (S6 of FIG. 5 and FIG. 6), and different probabilities are employed in the "mode 1", "mode 2", and "mode 3" to determine to actually move the stitch path. The "mode 1", "mode 2", and "mode 3" may be applied in this order, whose probabilities may increase stepwise in this order. This creates sewing data used to form stitches of a design having a well-balanced shape. The probabilities for these modes are not limited to those given in the above-described embodiment and a different value may be set for each mode. Further, a larger number of or a smaller number of modes may be provided. In such a case, it may also be preferable to set the probabilities such that the modes to be applied later correspond to higher probabilities, because the processing time may be shortened. Also, the stepwise modes need not be provided.

In the "mode 1", when the movement pattern A applies, the case may be further classified into two cases according to whether its target point is on the initial stitch path 310 or not. Further, when the movement pattern B applies, the case may be classified into two cases according to whether the next clockwise branch point of the current target point has been newly determined as a point on the stitch path when the stitch path was moved because the movement pattern B applied, and the current target point is a vertex facing a vertex which was the target point in the regular hexagon when the stitch path was moved. As a result, different probabilities may be used for the different cases. The conditions for the classification based on the target point are not limited to the above-described conditions. The classification may be made based on other conditions, and in the larger number of cases.

When the movement pattern A or B applies, instead of determining whether to actually move the stitch path, the stitch path may be just moved every time the movement pattern A or B applies.

In the above-described embodiment, the probability in the mode 3 may be set to 1 for both of the movement patterns A and B. Consequently, the processing to move the stitch paths may be repeated until there is no more stitch path (which may be moved) to which the movement pattern A or B may be applied. However, instead of repeating the processing until there is no more movable stitch path, the movement processing may be terminated even when there still remains a movable stitch path.

Further, the present disclosure is not limited to an embodiment of using the embroidery sewing machine 3 to sew a stippling stitch onto a work cloth held by the embroidery frame 31. For example, a stippling stitch may be sewn while a work cloth is moved by controlling the driving of a needle bar swinging mechanism (not shown) that may swing the needle bar 35 horizontally and a feed dog mechanism (not shown) that may drive the feed dog (not shown) back and forth or from front to back and from side to side, based on the embroidery data of the stippling stitches. Alternatively, they may be sewn by controlling the driving of only the feed mechanism without driving the needle bar mechanism.

As described above, according to the present disclosure, it is possible to obtain the sewing data required to easily form with the sewing machine stitches of a high quality design in which unit patterns are disposed on a stitch path which include at least a curve-like portion and which may be created by the above-described sewing data creation apparatus or entered from an outside computer.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A sewing data creation apparatus for creating sewing data required for sewing by a sewing machine, the apparatus comprising:

a unit pattern storage device that stores pattern data of a unit pattern of a predetermined design;

a pattern disposition device that determines a position of the unit pattern stored in the unit pattern storage device on a stitch path, the stitch path including at least a curve-like portion;

a sewing data creation device that creates the sewing data for forming stitches on the stitch path and stitches of the unit pattern at the position determined by the pattern disposition device;

a profile line network creation device that continuously arranges unit areas with a predetermined shape in a sewing area to create a profile line network, the profile line network including an aggregate of profile lines of the arranged unit areas and providing a basis for creating the stitch path;

a starting point-and-ending point determination device that determines a starting point and an ending point of the stitch path from points on the profile line network;

a path creation device that creates the stitch path by connecting the starting point and the ending point on the profile line network in an intersection-less line;

a movement determination device that determines whether a partial path may be moved in such a manner as to be longer on the profile line of at least one unit area where the partial path is disposed, the partial path being a part of the stitch path created by the path creation device and continuously disposed on the profile line of the at least one of the unit areas;

a movement device that moves the partial path determined to be moved by the movement determination device in such a manner that the partial path is longer on the profile line of the at least one unit area; and an adjustment device that adjusts the stitch path by causing the movement device to move the partial path until there is no more partial path determined to be moved by the movement determination device, wherein the pattern disposition device determines the position on the stitch path adjusted by the adjustment device.

2. The sewing data creation apparatus according to claim 1, wherein the pattern disposition device further comprises:

a disposition determination device that determines whether the unit pattern is disposed in a circle having a predetermined radius and a center at an expected position to which the unit pattern is expected to be disposed;

a first expected position movement device that moves the expected position in a first predetermined direction on the stitch path if the unit pattern is determined to be in the circle by the disposition determination device; and a disposition definition device that defines the expected position as the position if the unit pattern is determined not to be in the circle by the determination device.

3. The sewing data creation apparatus according to claim 2, further comprising:

a disposition interval specification device that specifies a disposition interval at which the unit patterns are to be disposed on the stitch path, wherein the predetermined radius is determined on the basis of the disposition interval specified by the disposition interval specification device.

4. The sewing data creation apparatus according to claim 3, wherein the first expected position movement device moves the expected position by a movement distance determined on the basis of the disposition interval.

5. The sewing data creation apparatus according to claim 2, further comprising:

a determination repeat control device that causes the disposition determination device to make at least a second determination after the expected position is moved by the first expected position movement device; and a second expected position movement device that moves the expected position from the expected position previously moved by the first expected position movement device in a second predetermined direction opposite to the first predetermined direction if the disposition determination device determines that the unit pattern is disposed in the circle after the determination repeat control device causes the disposition determination device to make at least the determination and the first expected position movement device moves the expected position at least a predetermined number of times.

6. The sewing data creation apparatus according to claim 1, wherein:

the pattern data which is stored in the unit pattern storage device contains at least one of a shape and a size of a plurality of unit patterns; and the sewing data creation device creates the sewing data used to form stitches of a plurality of the unit patterns in a predetermined sequence at the positions determined by the pattern disposition device.

7. The sewing data creation apparatus according to claim 1, further comprising:

an orientation specification device that specifies an orientation of the unit pattern when the unit pattern is disposed on the stitch path, wherein the sewing data creation device creates the sewing data used to form stitches of the unit pattern in accordance with the orientation specified by the orientation specification device.

8. The sewing data creation apparatus according to claim 1, further comprising a sewing area determination device that determines a second area as the sewing area, the second area obtained by moving an outer periphery of a first area inward by a predetermined distance based on the pattern data stored in the unit pattern storage device.

9. The sewing data creation apparatus according to claim 1, further comprising:

a reference distance specification device that specifies a reference distance used as a reference when creating the stitch path; and a reference distance adjustment device that adds a length of the unit pattern to the reference distance specified by the reference distance specification device, wherein a size of the unit area is determined on the basis of the reference distance to which the length of the unit pattern is added by the reference distance adjustment device.

10. The sewing data creation apparatus according to claim 1, further comprising a transformation device that moves an arbitrary point on a sectioned path while two endpoints of the sectioned path are fixed, thereby transforming a shape of the sectioned path, the sectioned path being obtained by sectioning the stitch path adjusted by the adjustment device based on a predetermined condition.

11. The sewing data creation apparatus according to claim 10, further comprising a curve processing device that changes the stitch path transformed by the transformation device into a curve.

12. A sewing data creation apparatus for creating sewing data required for sewing by a sewing machine, the apparatus comprising:

a unit pattern storage device that stores pattern data of a unit pattern of a predetermined design;

a pattern disposition device that determines a position of the unit pattern stored in the unit pattern storage device on a stitch path, the stitch path including at least a curve-like portion; and a sewing data creation device that creates the sewing data for forming stitches on the stitch path and stitches of the unit pattern at the position determined by the pattern disposition device;

an input device that inputs base line information indicating the stitch path, wherein the pattern disposition device determines the position on the stitch path indicated by the base line information inputted by the input device;

a disposition determination device that determines whether the unit pattern is disposed in a circle having a predetermined radius and a center at an expected position to which the unit pattern is expected to be disposed;

a first expected position movement device that moves the expected position in a first predetermined direction on the stitch path if the unit pattern is determined to be in the circle by the disposition determination device; and a disposition definition device that defines the expected position as the position if the unit pattern is determined not to be in the circle by the determination device.

13. The sewing data creation apparatus according to claim 12, further comprising:

a disposition interval specification device that specifies a disposition interval at which the unit patterns are to be disposed on the stitch path, wherein the predetermined radius is determined on the basis of the disposition interval specified by the disposition interval specification device.

14. The sewing data creation apparatus according to claim 13, wherein the first expected position movement device moves the expected position by a movement distance determined on the basis of the disposition interval.

15. The sewing data creation apparatus according to claim 12, further comprising:

a determination repeat control device that causes the disposition determination device to make at least a second determination after the expected position is moved by the first expected position movement device; and a second expected position movement device that moves the expected position from the expected position previously moved by the first expected position movement device in a second predetermined direction opposite to the first predetermined direction if the disposition determination device determines that the unit pattern is disposed in the circle after the determination repeat control device causes the disposition determination device to make at least the determination again and the first expected position movement device moves the expected position at least a predetermined number of times.

16. The sewing data creation apparatus according to claim 12, wherein:

the pattern data which is stored in the unit pattern storage device contains at least one of a shape and a size of a plurality of unit patterns; and the sewing data creation device creates the sewing data used to form stitches of a plurality of the unit patterns in a predetermined sequence at the positions determined by the pattern disposition device.

17. The sewing data creation apparatus according to claim 12, further comprising:

an orientation specification device that specifies an orientation of the unit pattern when the unit pattern is disposed on the stitch path, wherein the sewing data creation device creates the sewing data used to form stitches of the unit pattern in accordance with the orientation specified by the orientation specification device.

18. A computer-readable recording medium storing a sewing data creation program for creating sewing data used for sewing by a sewing machine, the program comprising:

unit pattern acquisition instructions for acquiring pattern data of a unit pattern of a predetermined design;

pattern disposition instructions for determining a position of the unit pattern acquired in the unit pattern acquisition instructions on a stitch path, the stitch path including at least a curve-like portion;

sewing data creation instructions for creating the sewing data used to form stitches on the stitch path and stitches of the unit pattern at the position determined in the pattern disposition instructions;

profile line network creation instructions for continuously arranging unit areas with a predetermined shape in a sewing area to create a profile line network, the profile line network including an aggregate of profile lines of the arranged unit areas and providing a basis for creating the stitch path;

starting point-and-ending point determination instructions for determining a starting point and an ending point of the stitch path from points on the profile line network;

path creation instructions for creating the stitch path by connecting the starting point and the ending point on the profile line network in an intersection-less line;

movement determination instructions for determining whether a partial path may be moved in such a manner as to be longer on the profile line of at least one unit area where the partial path is disposed, the partial path being a part of the stitch path created by the path creation instructions and continuously disposed on the profile line of the at least one of the unit areas;

movement instructions for moving the partial path determined to be moved by the movement determination instructions in such a manner that the partial path is longer on the profile line of the at least one unit area; and adjustment instructions for adjusting the stitch path by causing the movement instructions to move the partial path until there is no more partial path determined to be moved by the movement determination instructions;

wherein the pattern disposition instructions determine the position on the stitch path adjusted by the adjustment instructions.

* * * * *